US010060142B2

(12) United States Patent
Haessler et al.

(10) Patent No.: US 10,060,142 B2
(45) Date of Patent: Aug. 28, 2018

(54) VERTICALLY ELEVATING MOBILE WORK PLATFORM

(71) Applicant: Haessler Inc., Guelph (CA)

(72) Inventors: Wolfgang Haessler, South Hampton (CA); Mickey Brydges, London (CA); Jonathan Vallier, Burlington (CA); Eric Nielsen, Melancthon (CA); David Desroches, Little Britain (CA)

(73) Assignee: HAESSLER INC., Guelph (CA)

( * ) Notice: Subject to any disclaimer, the term of this patent is extended or adjusted under 35 U.S.C. 154(b) by 133 days.

(21) Appl. No.: 15/177,556

(22) Filed: Jun. 9, 2016

(65) Prior Publication Data

US 2016/0362284 A1 Dec. 15, 2016

Related U.S. Application Data

(63) Continuation of application No. PCT/CA2014/051188, filed on Dec. 9, 2014.
(Continued)

(51) Int. Cl.
*E04G 1/22* (2006.01)
*E04G 1/18* (2006.01)
(Continued)

(52) U.S. Cl.
CPC ..... *E04G 1/22* (2013.01); *B66F 11/04* (2013.01); *E04G 1/18* (2013.01); *E04G 1/24* (2013.01); *E04G 2001/244* (2013.01)

(58) Field of Classification Search
CPC ..... E04G 1/18; E04G 1/22; B66F 11/04
See application file for complete search history.

(56) References Cited

U.S. PATENT DOCUMENTS 849,222 A * 4/1907 Flemming ..... B66F 11/04 14/43
2,763,339 A 9/1956 North
(Continued)

FOREIGN PATENT DOCUMENTS

CN 2672022 Y 1/2005
CN 202625764 U 12/2012
(Continued)

OTHER PUBLICATIONS

One Source Equipment Rentals, "Aerial Work Platforms".

*Primary Examiner* — Colleen M Chavchavadze
(74) *Attorney, Agent, or Firm* — Bereskin & Parr LLP/S.E.N.C.R.L., s.r.l.

(57) ABSTRACT

A mobile lifting apparatus includes (a) a bottom tower section having a first bottom sidewall and an opposed second bottom sidewall; (b) a top tower section coupled to and vertically translatable relative to the bottom tower section; (c) a work platform coupled to and vertically translatable with the top tower section; and (d) an elevating assembly operable to translate the top tower section relative to the bottom tower section between a raised position in which a work surface of the work platform is at an elevation above the bottom tower section, and a lowered position in which the top tower section and the work surface are at least partially nested within the bottom tower section with the work surface at an elevation below upper edges of the first and second bottom sidewalls for reducing the entry and exit height of the work platform.

28 Claims, 40 Drawing Sheets

Related U.S. Application Data

(60) Provisional application No. 61/913,629, filed on Dec. 9, 2013, provisional application No. 62/059,011, filed on Oct. 2, 2014.

(51) Int. Cl.
*B66F 11/04* (2006.01)
*E04G 1/24* (2006.01)

(56) References Cited

U.S. PATENT DOCUMENTS

| | | | | | |
|---|---|---|---|---|---|
| 2,948,363 | A * | 8/1960 | Hopfeld | B66F 11/04 | 182/141 |
| 3,000,473 | A * | 9/1961 | Reynolds | B66F 11/04 | 182/69.4 |
| 3,360,078 | A * | 12/1967 | Hopfeld | B66F 11/04 | 187/222 |
| 3,871,478 | A * | 3/1975 | Bushnell, Jr. | B66F 11/04 | 182/148 |
| 4,638,887 | A | 1/1987 | Kishi | | |
| 5,310,018 | A | 5/1994 | Lahaie | | |
| 5,481,988 | A * | 1/1996 | Dess | B66B 9/16 | 108/106 |
| 8,590,921 | B2 * | 11/2013 | Benson | B62B 3/008 | 182/123 |
| 2003/0213647 | A1 | 11/2003 | St. Germain | | |

FOREIGN PATENT DOCUMENTS

| | | | |
|---|---|---|---|
| DE | 921172 | | 12/1954 |
| DE | 19912050 | | 10/2000 |
| DE | 20104959 | | 8/2001 |
| EP | 244060 | B1 | 2/1987 |
| EP | 1812333 | B1 | 8/2007 |
| FR | 2474009 | A1 | 7/1981 |
| GB | 2513481 | A | 10/2014 |
| JP | H0473370 | | 3/1992 |
| WO | 9715522 | A1 | 5/1997 |

* cited by examiner

VERTICALLY ELEVATING MOBILE WORK PLATFORM

RELATED APPLICATIONS

This application is a continuation of PCT/CA2014/051188 filed Dec. 9, 2014, which claims the benefit of U.S. Provisional Application No. 61/913,629 filed Dec. 9, 2014 and U.S. Provisional Application No. 62/059,011 filed Oct. 2, 2014, both of which are incorporated herein in their entirety by this reference to them.

FIELD

The teachings described herein relate generally to a mobile lifting apparatus for raising and lowering a work platform that is sized to accommodate one or more persons in a standing position.

BACKGROUND

WO97/15522 (White et al.) discloses a movable cage assembly provided for use in conjunction with a portable personnel lift. The personnel lift has a multi-sectional telescoping mast which moves between a lower, retracted position where the cage assembly is below the top of the mast and an elevated position where the movable cage assembly is raised above the top of the mast to eliminate work envelope obstructions by the mast. A cage support beam is carried by the central mast section and the cage assembly is movable on the cage support beam between a lower position which provides ground level entry when the mast is retracted and a raised position wherein the cage is above the top of the mast. A clamshell-type cage assembly is also provided wherein the upper safety rail pivots between a raised position which facilitates easy entry into the cage wherein the user does not have to stoop or use either hand to hold the cage open. The safety rail is then pulled downwardly by the user once he has entered the cage.

U.S. Pat. No. 4,638,887 (Kishi) discloses an elevating apparatus that includes a base such as a mobile chassis, a platform, a telescopic boom assembly connecting the base and the platform together, the telescopic boom assembly being composed of a plurality of telescopically coupled booms axially aligned with each other, at least one first hydraulic cylinder disposed in the telescopic boom assembly for extending and contracting the telescopic boom assembly, a pair of second parallel hydraulic cylinders operatively coupled between the telescopic boom assembly and the base for tilting the telescopic boom assembly with respect to the base, a pair of parallel third hydraulic cylinders operatively coupled between the telescopic boom assembly and the platform for keeping the platform substantially parallel to the base, and a hydraulic control system for operating the first, second, and third hydraulic cylinders in synchronism to move the platform toward and away from the base in a substantially perpendicular relation to the base while the platform is stably maintained parallel to the base.

EP 244,060 (Ream et al.) discloses a pedestal scaffold having a base member on which is mounted a mast bearing a work platform and comprising a plurality of telescopically nested mast sections which are substantially rectangular in cross section. Means for extending the mast upwardly by relative telescopic displacement of the mast sections are provided. The scaffold is characterised in that at least some said mast sections are thin-walled tubes of sheet metal with rounded corners, each being provided with at least one stiffening rib extending longitudinally in a side wall thereof, a set of inwardly projecting corner slide blocks having respective inner surfaces complementing the shape of and adapted to slide against outer corner surfaces of an inwardly adjacent mast section and a set of outwardly projecting corner slide blocks having respective outer surfaces complementing the shape of and adapted to slide against inner corner surfaces.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

Referring to one broad aspect of the teachings disclosed herein, a mobile lifting apparatus for raising and lowering one or more persons may include a bottom tower section. The bottom tower section may have a first bottom sidewall and an opposing second bottom sidewall that is horizontally spaced apart from the first bottom sidewall in a lateral direction. The first bottom sidewall may have a first laterally inner surface and a first wall length in a longitudinal direction that is generally horizontal and orthogonal to the lateral direction. The second bottom sidewall may have a second laterally inner surface laterally spaced apart from the first inner surface by a bottom inner width and a second wall length in the longitudinal direction. A top tower section may be coupled to, and be vertically translatable relative to, the bottom tower section. The top tower section may include a top carriage sized to fit between the first bottom sidewall and the second bottom sidewall. A work platform may be coupled to, and may be vertically translatable with, with the top carriage. The work platform may include a generally horizontal work surface which may have a first surface portion. The first surface portion may overlie the top carriage and may be sized to accommodate at least one person standing on the first surface portion. The first surface portion may have a first surface portion length in the longitudinal direction that is less than the first wall length and a first surface portion width in the lateral direction that is less than the bottom inner width. An elevating assembly may be operable raise and lower the top tower section relative to the bottom tower section. The top tower section may translatable to a lowered position in which the top carriage and the first surface portion are disposed laterally between the first and second bottom sidewalls. The work surface may include a second surface portion extending longitudinally outwardly from the first surface portion. When the top tower section is in the lowered position the second surface portion may extend longitudinally outboard the first and second bottom side walls.

The top tower section may include a first top sidewall extending from the top carriage and an opposing second top sidewall laterally spaced apart from the first top sidewall. The first surface portion may be disposed laterally between the first and second top sidewalls.

The first and second bottom sidewalls may at least partially bound a bottom tower section interior and when the top tower section is in the lowered position the top tower section may be at least substantially nested within the bottom tower section interior.

The first surface portion length that may be at least about 45 cm and the first surface portion width may be at least about 45 cm.

The lifting apparatus may have an overall apparatus width in the lateral direction. The first bottom sidewall may have a first laterally outer surface, the second bottom sidewall may have a second laterally outer surface laterally spaced apart from the first laterally outer surface by a tower outer width that is substantially equal to the overall apparatus width.

The lifting apparatus may be sized to fit through a standard doorway.

The overall apparatus width may be equal to or less than a width of a standard doorway, and may be equal to or less than about 81 cm.

When the top tower section is in the lowered position the lifting apparatus may have an overall apparatus height in the vertical direction that is less than the height of a standard doorway, and may be equal to or less than about 205 cm.

The lifting apparatus may include a first wheel assembly and a second wheel assembly longitudinally spaced apart from the first wheel assembly by a wheel assembly spacing distance. The first and second wall lengths may be substantially equal to the wheel assembly spacing distance.

The bottom tower section may have a bottom front face and a bottom rear face longitudinally spaced apart from the front face, and the first and second bottom sidewalls may extend longitudinally between the bottom front and rear faces. A lower portion of the front face may include a bottom front wall extending laterally between the first and second bottom sidewalls and an upper portion of the bottom front face may be open. When the top tower section is in the lowered position the work platform may overhang the bottom front wall and extend longitudinally through the open upper portion of the bottom front face.

Configuring the lifting apparatus such that the work surface of the work platform can be partially nested within the tower sections and can be lowered to an elevation that is lower than the upper edges of the bottom tower section may allow the step-in or entry height of the work platform to be maintained within a desired range, such as, for example, between about 70 cm and about 100 cm, and optionally between about 88 cm and about 94 cm. In the illustrated example, the entry height of the work platform is about 90 cm.

Optionally, the bottom tower section may include a bottom front cover that is moveably coupled to the bottom tower section and is movable from a first stowed position in which the bottom front cover is generally clear of the open upper portion of the front face, and a first deployed position in which the bottom front cover generally covers all or a part of the open upper portion of the bottom front face when the tower is at least partially extended.

The bottom front cover may be coupled to the top tower section so that raising the top tower section relative to the bottom tower section moves the bottom front cover toward the first deployed position.

The bottom front cover may include a first front cover panel and a second front cover panel. The first and second front cover panels may be vertically translatable relative to the first and second bottom sidewalls between a respective front panel lowered position corresponding to the first stowed position and in which the panels generally overlap the bottom front wall in horizontally offset relation, and a respective front panel raised position corresponding to the first deployed position and in which the first and second front cover panels are vertically displaced.

The first and second bottom sidewalls may have respective sidewall thicknesses and the bottom front wall may have a front wall thickness that is at least about twice the sidewall thicknesses.

A lower portion of the bottom rear face may include a bottom rear wall extending laterally between the first and second bottom sidewalls and an upper portion of the bottom rear face may be open. When the top tower section is in the lowered position the work platform may overhang the bottom rear wall and may extend longitudinally through the open portion of the bottom rear face.

The bottom tower section may include a bottom rear cover that is moveably coupled to the bottom tower section and is movable from a second stowed position in which the bottom rear cover is generally clear of the open portion of the bottom rear face and a second deployed position in which the bottom rear cover generally covers the open portion of the bottom rear face.

The bottom rear cover may be movable with the top tower section so that raising the top tower section relative to the bottom tower section moves the bottom rear cover toward the second deployed position.

The bottom rear cover may include a first rear cover panel and a second rear cover panel. The first and second rear cover panels may be vertically translatable relative to the first and second bottom sidewalls between a respective rear panel lowered position corresponding to the second stowed position and in which the rear panels generally overlap the bottom rear wall in horizontally offset relation, and a respective rear panel raised position corresponding to the second deployed position and in which the first and second rear cover panels are vertically displaced.

At least one intermediate tower section may be disposed between the bottom tower section and the top tower section. Each intermediate tower section may be sized to fit laterally between the first and second bottom sidewalls and may be vertically translatable relative to the bottom tower section. Each intermediate tower section may include a respective intermediate section first sidewall and an opposing respective intermediate section second section laterally spaced part from the respective intermediate section first sidewall. The top tower section may be coupled to and vertically translatable relative to an upper most one of the at least one intermediate tower section.

Each intermediate tower section may include a respective intermediate section front face and an opposing respective intermediate section rear face longitudinally spaced apart from the respective intermediate section font face and the respective intermediate section first and second sidewalls extending longitudinally between the respective intermediate section front and rear faces. A lower portion of each respective intermediate section front face may include a respective intermediate section bottom wall extending laterally between the respective intermediate section first and second sidewalls and an upper portion of each respective intermediate section front face may be open. When the top tower section is in the lowered position the open portion of each respective intermediate section front face may be vertically aligned with the open portion of the bottom front face and the work platform may overhang each respective intermediate section front wall and extends longitudinally through the open portion of each respective intermediate section front face.

Each intermediate tower section may include a respective intermediate section front cover that is moveably coupled to the respective intermediate tower section and is movable from a stowed position in which it is spaced apart from the open portion of the respective intermediate section front face, and a deployed position in which each respective intermediate section front cover generally covers the open portion of each respective intermediate section front face.

The first and second bottom sidewalls may include respective upper edges and when the top tower section is in the lowered position, the first surface portion may be disposed at a lower elevation than the first and second bottom sidewall upper edges.

In accordance with some aspects of the teachings disclosed herein, a lifting apparatus for raising and lowering one or more persons may include a bottom tower section including a first bottom sidewall and an opposed second bottom sidewall spaced apart from the first bottom sidewall in a lateral direction. The first and second bottom sidewalls may extend generally vertically and the bottom tower section may include a bottom track extending vertically and supported by the first and second bottom sidewalls. At least a first intermediate tower section may be sized to fit laterally between the first and second bottom walls and may be vertically translatable relative to the bottom tower section. The first intermediate tower section may include a first carriage that has a first side adjacent the first bottom sidewall and a second side adjacent the second bottom sidewall. The first carriage may be supported by the bottom track and may be vertically translatable along the bottom track. The first carriage may be constrained by the bottom track so that the first and second sides vertically translate in unison whereby tilting of the first intermediate tower section relative to the bottom tower section in the lateral direction is inhibited. A top tower section may be coupled to and may vertically translatable relative to the first intermediate tower section. A work platform may be affixed to and may be translatable with the top tower section. The work platform may include a generally horizontal work surface. An elevating assembly may be operable to raise and lower the first intermediate tower section and the top tower section relative to the bottom tower section.

The first carriage may include a first end extending between the first and second sides of the first carriage and a second end longitudinally spaced apart from the first end. The first carriage may be constrained by the bottom track so that the first and second ends vertically translate in unison, whereby tilting of the first intermediate tower section relative to the bottom tower section in the longitudinal direction is inhibited.

The first intermediate tower section may include a first section first sidewall adjacent the bottom first sidewall and a first section second sidewall adjacent the bottom second sidewall and a first section track extending vertically and supported by the first section first and second sidewalls. The top tower section may include a top carriage supported by the first section track and vertically translatable along the first section track. The top carriage may include a first side adjacent the first section first sidewall, a second side adjacent the first section second sidewall, a first end extending between the first and second sides and a second end longitudinally spaced apart from the first end. The top carriage may be constrained by the first section track so that the first side, second side, first end and second end of the top carriage vertically translate in unison whereby tilting of the top tower section relative to the first intermediate tower section in the longitudinal direction and in the lateral direction is inhibited.

The first intermediate tower section may include a first section first sidewall adjacent the bottom first sidewall and a first section second sidewall adjacent the bottom second sidewall and a first section track extending vertically and supported by the first section first and second sidewalls. A second intermediate tower section may have a second carriage supported by the first section track and vertically translatable along the first section track. The second carriage may include a first side adjacent the first section first sidewall, a second side adjacent the first section second sidewall, a first end extending between the first and second sides and a second end longitudinally spaced apart from the first end. The second carriage may be constrained by the first section track so that the first side, second side, first end and second end of the second carriage vertically translate in unison whereby tilting of the second intermediate tower section relative to the first intermediate tower section in the longitudinal direction and in the lateral direction is inhibited.

The second intermediate tower section may include a second section first sidewall adjacent the first section first sidewall and a second section second sidewall adjacent the first section second sidewall and a second section track extending vertically and supported by the second section first and second sidewalls. The top tower section may include a top carriage supported by the second section track and vertically translatable along the second section track. The top carriage may include a first side adjacent the second section first sidewall, a second side adjacent the second section second sidewall, a first end extending between the first and second sides and a second end longitudinally spaced apart from the first end. The top carriage may be constrained by the second section track so that the first side, second side, first end and second end of the top carriage vertically translate in unison whereby tilting of the top tower section relative to the second intermediate tower section in the longitudinal direction and in the lateral direction is inhibited.

The bottom track may include at least one bottom guide member connected to each of the first and second bottom sidewalls, and the first carriage may include at least one first carriage roller engaging each bottom guide member, and wherein each of the first carriage rollers are linked together to rotate in unison with each other.

The first section track may include at least one first section guide member connected to each of the first section first and second sidewalls, and the second carriage may include at least one second carriage roller engaging each first section guide member. Each of the second carriage rollers may be linked together to rotate in unison with each other.

The second section track may include at least one second section guide member connected to each of the second section first and second sidewalls, and the top carriage may include at least one top carriage roller engaging each second section guide member. Each of the top carriage rollers may be linked together to rotate in unison with each other.

The bottom, first section and section guide members may include vertically extending racks. The first carriage, second carriage and top carriage rollers may include pinions engaging respective ones of the racks.

The elevating assembly may include a lift actuator coupled to the first carriage rollers to drive rotation of the first carriage rollers. Driving the first carriage rollers in a first direction may raise the first intermediate tower section relative to the bottom tower section.

The lift actuator may include a first motor coupled to the first carriage rollers. The first motor may be mounted on the first carriage and may be movable with the first carriage.

The lift actuator may include a second motor be coupled to the second carriage rollers to drive rotation of the second carriage rollers. Driving the second carriage rollers in the first direction may raise the second intermediate tower section relative to the first intermediate tower section.

The second motor may be mounted on the second carriage and may be movable with the second carriage.

The second motor may be operable independently from the first motor.

The lift actuator may include a third motor coupled to the top carriage rollers to drive rotation of the top carriage rollers. Driving the top carriage rollers in the first direction may raise the top tower section relative to the second intermediate tower section.

The third motor may be mounted on the top carriage and may be movable with the top carriage.

The third motor may be operable independently from at least one of the first motor and the second motor.

The lift actuator may be operable to simultaneously drive the first carriage rollers, the second carriage rollers and the top carriage rollers whereby the first intermediate tower section, second intermediate tower section and top tower section are raisable in unison.

Each of the first intermediate, second intermediate and top carriages may include a respective gear train linking the respective carriage rollers.

At least one of the first intermediate, second intermediate and top carriage gear trains may be self-braking and may resist rotating in a second direction that is opposite the first direction.

The lifting apparatus may include at least one controller communicably linked to the first motor, second motor and third motor to control operation of the first motor, second motor and third motor.

The at least one controller may include a first controller mounted on and movable with the first carriage for controlling the first motor, a second controller mounted on and movable with the second carriage for controlling the second motor and a third controller mounted on and movable with the top carriage for controlling the third motor.

The first motor, second motor and third motor may be electric motors and the lift actuator may be free from hydraulic actuators.

The first and second bottom sidewalls may each include at least one bracing member to resist deflection of at least one of the first and second bottom sidewalls and the bottom track.

The first bottom sidewall may include a generally vertically extending first wall front edge and a generally vertically extending first wall rear edge longitudinally spaced apart from the first wall front edge, and the at least one bracing member on the first bottom sidewall may include a first front upright adjacent the first wall front edge and a first rear upright adjacent the first wall rear edge.

The bottom guide members may include a first front rack attached to the first front upright and a first rear rack attached to the first rear upright.

The work surface may have a first surface portion, the first surface portion overlying the top carriage and being sized to accommodate at least one standing person and wherein the top tower section is translatable to a lowered position in which the top carriage and the first surface portion are disposed laterally between the first and second bottom sidewalls.

In accordance with some aspects of the teachings disclosed herein, a mobile lifting apparatus for raising and lowering one or more persons may include a tower assembly having a bottom tower section including a first bottom sidewall and an opposed second bottom sidewall spaced apart from the first bottom sidewall in a lateral direction. The first and second bottom sidewalls may extend generally vertically and the bottom tower section may include a bottom track extending vertically and supported by the first and second bottom sidewalls. At least a first intermediate tower section may be sized to fit laterally between the first and second bottom walls and vertically translatable relative to the bottom tower section. The first intermediate tower section may include a first carriage having a first side adjacent the first bottom sidewall and a second side adjacent the second bottom sidewall, the first carriage is supported by the bottom track and vertically translatable along the bottom track and is constrained by the bottom track so that the first and second sides vertically translate in unison whereby tilting of the first intermediate tower section relative to the bottom tower section in the lateral direction is inhibited. A top tower section may be coupled to and vertically translatable relative to the first intermediate tower section, and a work platform coupled to and translatable with the top tower section. The work platform may include a generally horizontal work surface. An elevating assembly may be operable to raise and lower the first intermediate tower section and the top tower section relative to the bottom tower section. The apparatus may also include a first wheel assembly for rollingly engaging a surface and a second wheel assembly for rollingly engaging the surface. The second wheel assembly may be horizontally spaced apart from the first wheel assembly. A lower portion of the bottom tower section may be disposed horizontally between and secured to the first and second wheel assemblies.

Each of the first and second wheel assemblies comprises at least one wheel rotatable about a respective axis and a horizontal plane containing a bottom face of the bottom tower assembly is at an elevation below each wheel axis.

The first wheel assembly may include at least two steerable wheels each pivotable about a respective vertical steering axis and each rotatable about a respective horizontal wheel axis, and wherein a horizontal plane intersecting a lower portion of the bottom track is at an elevation below each horizontal wheel axis.

The first wheel assembly may be mounted to a front face of the bottom tower section, and the second wheel assembly may mounted to a rear face of the bottom tower section that is opposite and longitudinally spaced apart from the front face.

The first wheel assembly may include at least two steerable wheels and at least one electric steering motor to steer the steerable wheels.

The first wheel assembly may include at least one electric propulsion motor to drive rotation of at least one of the steerable wheels.

The first intermediate tower section may translatable to a lowered position relative to the bottom tower section in which the first carriage is less than 60 cm above the surface.

The first intermediate tower section may be translatable to a lowered position in which the work surface is less than about 100 cm above the surface.

The first and second wheel assemblies may be adjustable to raise and lower the tower assembly relative to the surface. When the first intermediate tower section and the top tower section are raised relative to the bottom tower section the first and second wheel assemblies may lower the tower assembly so that a bottom face of the bottom tower section is less than about 2 cm above the surface.

The bottom track may include a plurality of racks, each rack extending along the length of the vertical extent of the bottom section, and each rack may have a lower rack end that is disposed at an elevation below the axis of rotation of the steerable wheels.

According to some aspects, the teaching herein discloses a tower assembly that can be extended and retracted to raise and lower a platform (or other payload carrier) supported by the tower assembly. The tower assembly includes a bottom tower section and a top tower section. The bottom tower section can include a bottom track, and the top tower section can include a top carriage that is supported by, and translatable along, the bottom track. Optionally, the tower assembly can include at least one intermediate tower section, and each intermediate tower section can include (i) a respective intermediate carriage for translatably engaging the track of a next-lower tower section, and (ii) a respective intermediate track mounted in fixed relation to the respective intermediate carriage for translatably supporting the carriage of the next higher tower section.

In an example with a single intermediate tower section, the intermediate tower section may include an intermediate carriage engaged with the bottom track of the bottom section. The intermediate section may have an intermediate track mounted to the intermediate carriage to translate with the carriage, and the top carriage of the top tower section may have rollers engaged with, and translatable along, the intermediate track.

In an example with two intermediate tower sections, the first intermediate tower section may include a first intermediate carriage engaged with the bottom track of the bottom section. The first intermediate section may have a first intermediate track mounted to the first intermediate carriage to translate with the first intermediate carriage. The second intermediate section may have a second intermediate carriage engaged with the first intermediate track of the first intermediate section. The second intermediate section may have a second intermediate track mounted to the first intermediate carriage to translate with the second intermediate carriage. The top carriage of the top tower section may have rollers engaged with, and translatable along, the second intermediate track.

Each track may comprise a respective set of toothed racks, and the respective carriage supported by each respective rack may comprise a set of rollers in the form of toothed pinions each engaged with a respective rack. The engagement of the pinion teeth with the rack teeth requires that vertical translation of the pinion along the rack (even a small amount of translation) is associated with a particular amount of rotation of the pinion. The engagement of the corresponding teeth may inhibit "slipping" of the carriage along the rack without rotation of the pinion.

Furthermore, the rollers of each carriage may be coupled together by, for example, a transmission system including one or more shafts and/or one or more gears, such that all the pinions of any one particular carriage must rotate in unison. No pinion of any one particular carriage can rotate without all the other pinions rotating the same amount. This can inhibit tilting of the carriage relative to the track, since in order to tilt, one side of the carriage would typically need to translate more or less than another side of the carriage. The presence of the pinions at longitudinally and laterally spaced-apart locations of the carriage (e.g. four pinions each at respective corners of a rectangular-shaped carriage and constrained to rotate in unison) facilitates equal vertical translation of all portions of the carriage. The constrained carriage helps to provide a telescoping-like tower structure that has a satisfactory degree of lateral, anti-tilt, stability, independent of overlapping a lower portion of a next-higher tower section with an upper portion of a next-lower tower section.

DRAWINGS

The drawings included herewith are for illustrating various examples of articles, methods, and apparatuses of the teaching of the present specification and are not intended to limit the scope of what is taught in any way.

Figure 1:
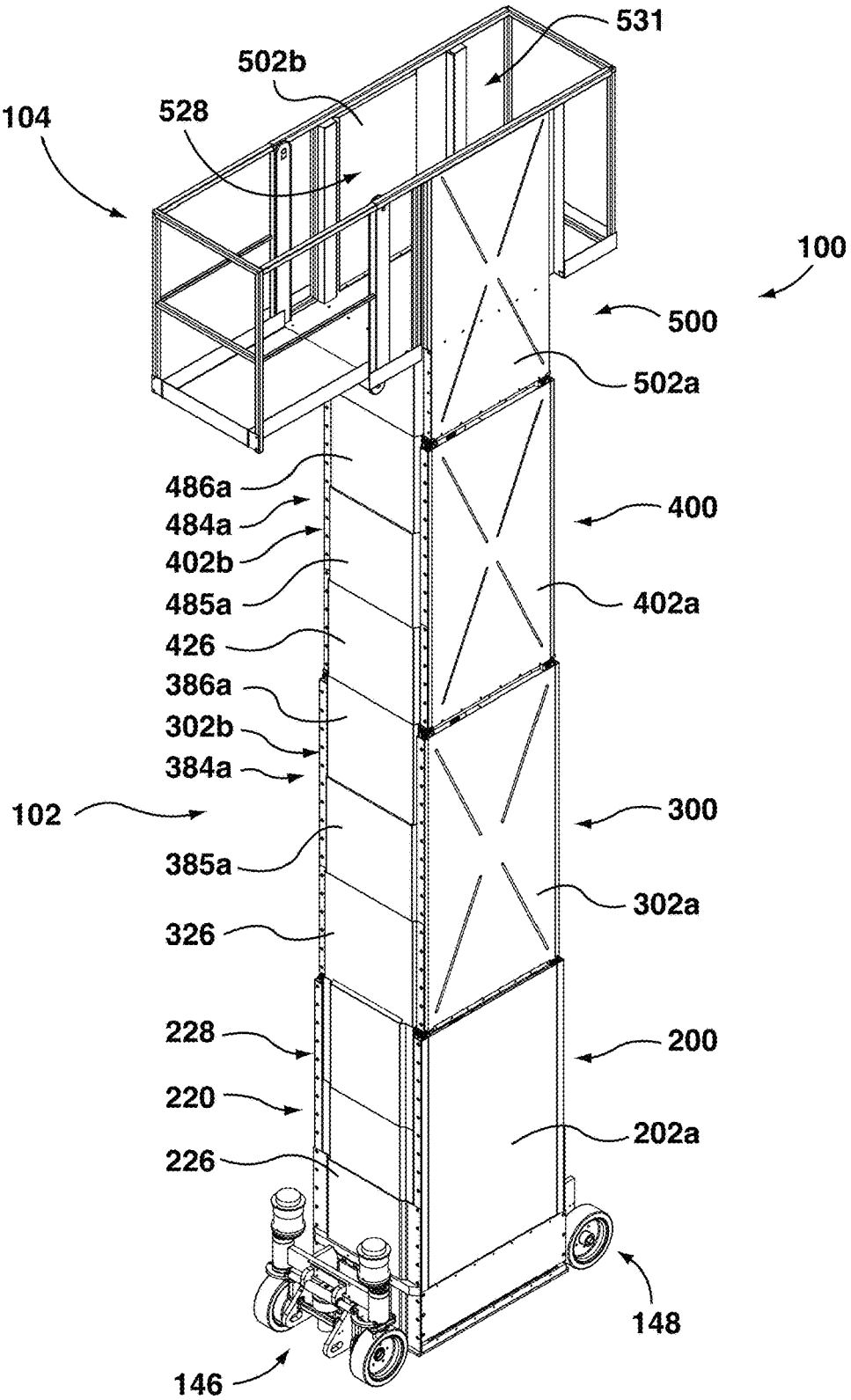
FIG. 1 is a perspective view of an example of a lifting apparatus with a tower in an extended configuration.
Figure 8:
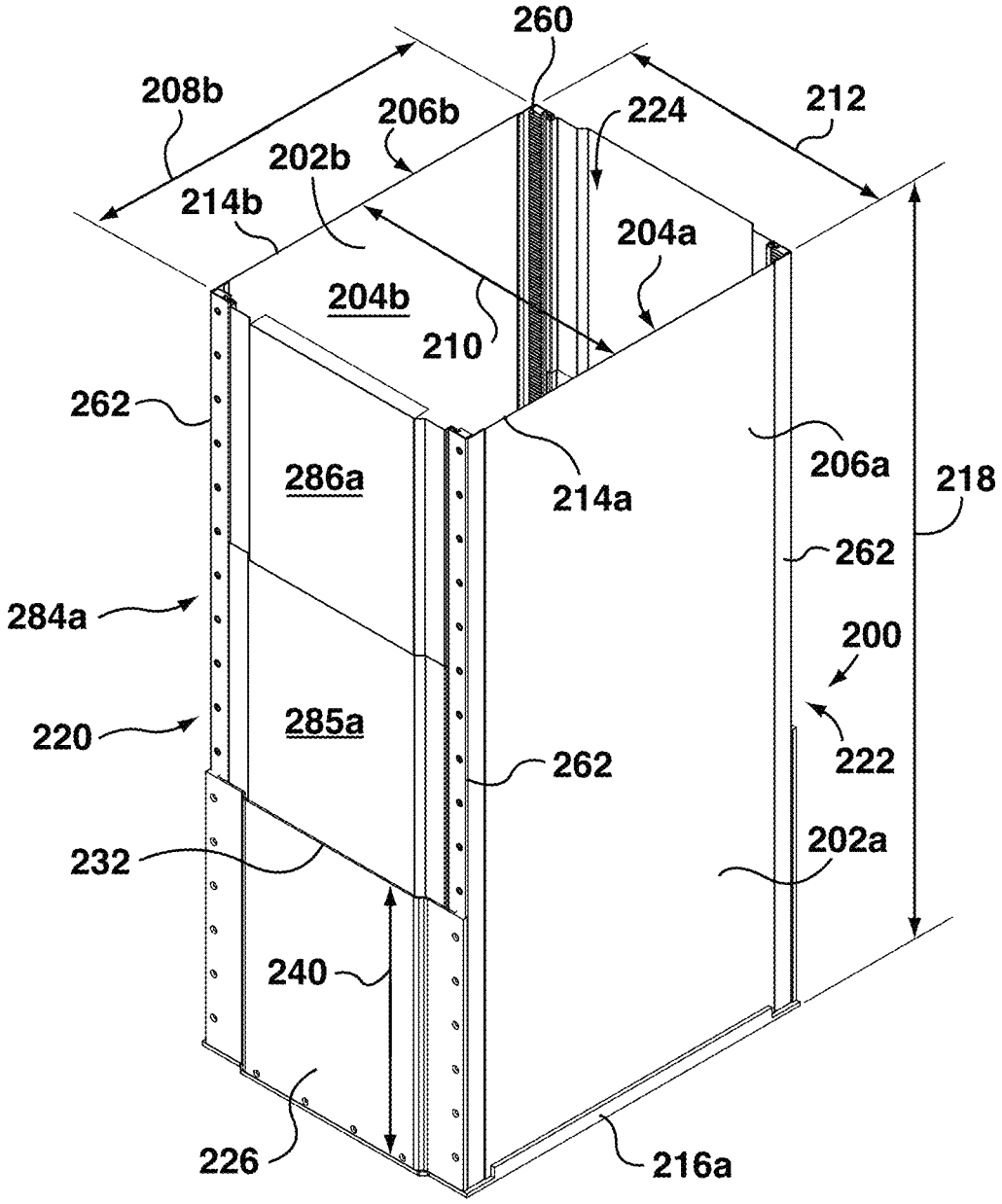
FIG. 8 is a perspective view of a portion of the tower of the lifting apparatus FIG. 1.
Figure 9:
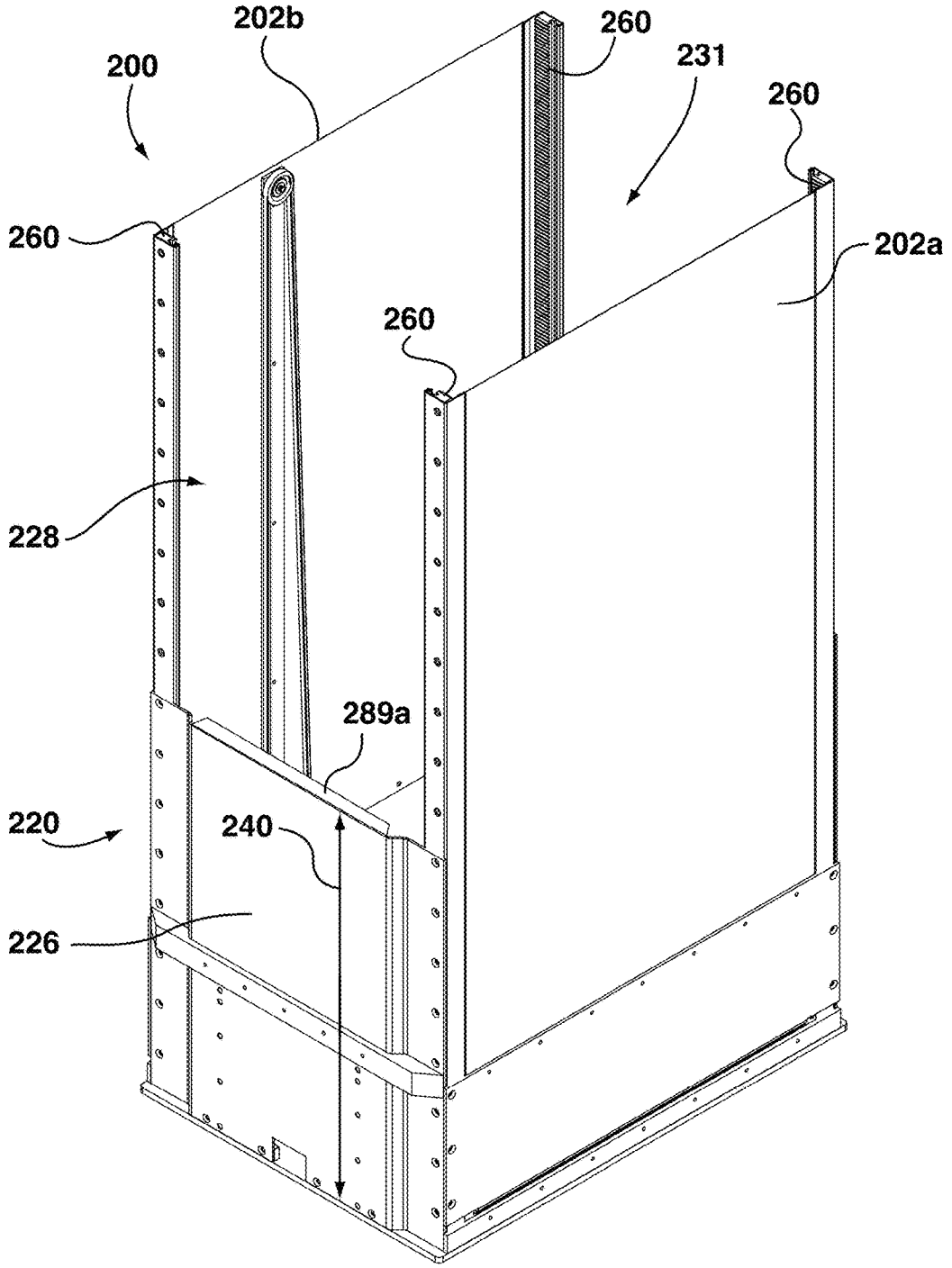
FIG. 9 is a perspective view of the portion of the tower of FIG. 8, with front and rear covers in a stowed position.
Figure 9A:
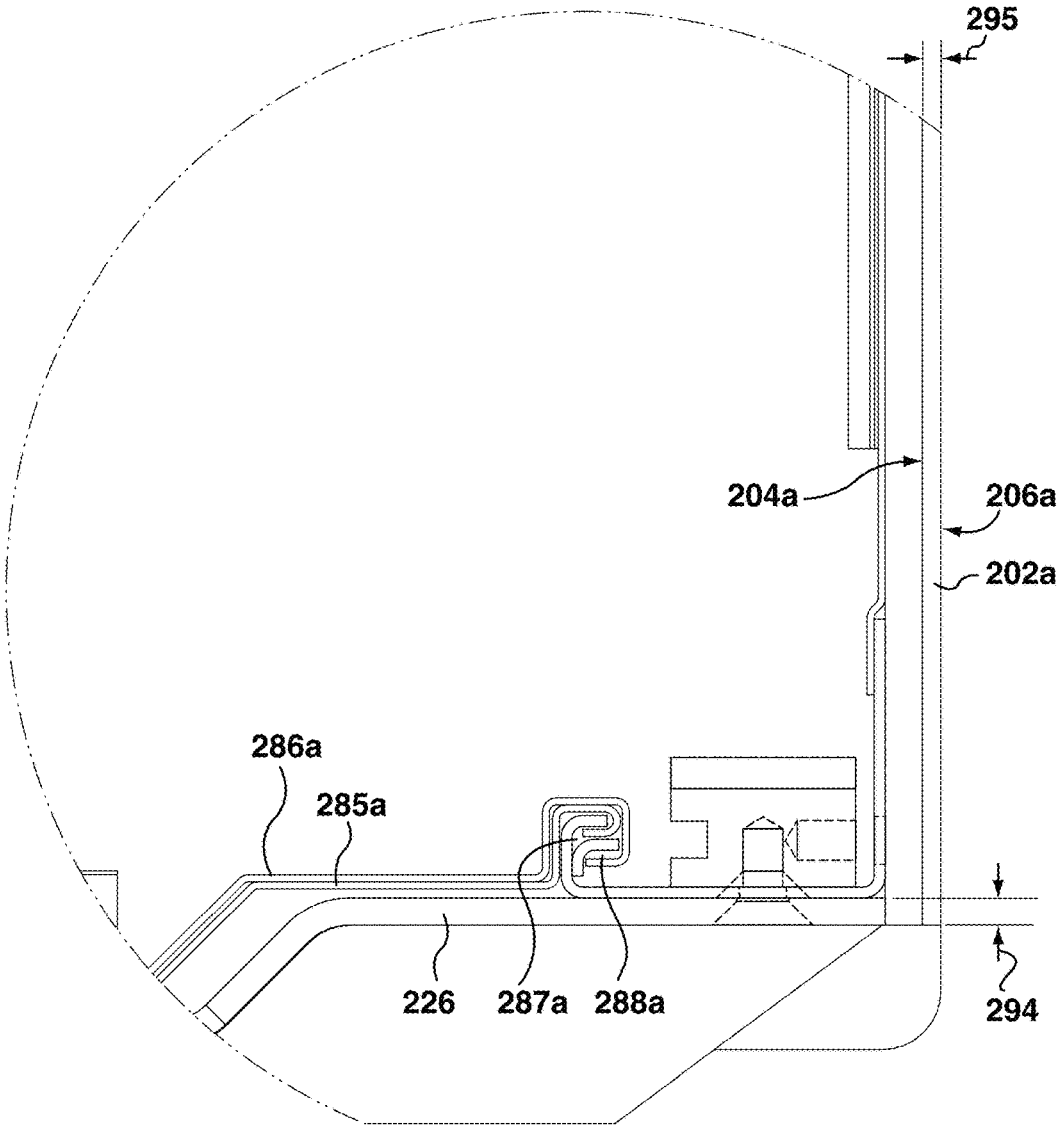
Figure 10:
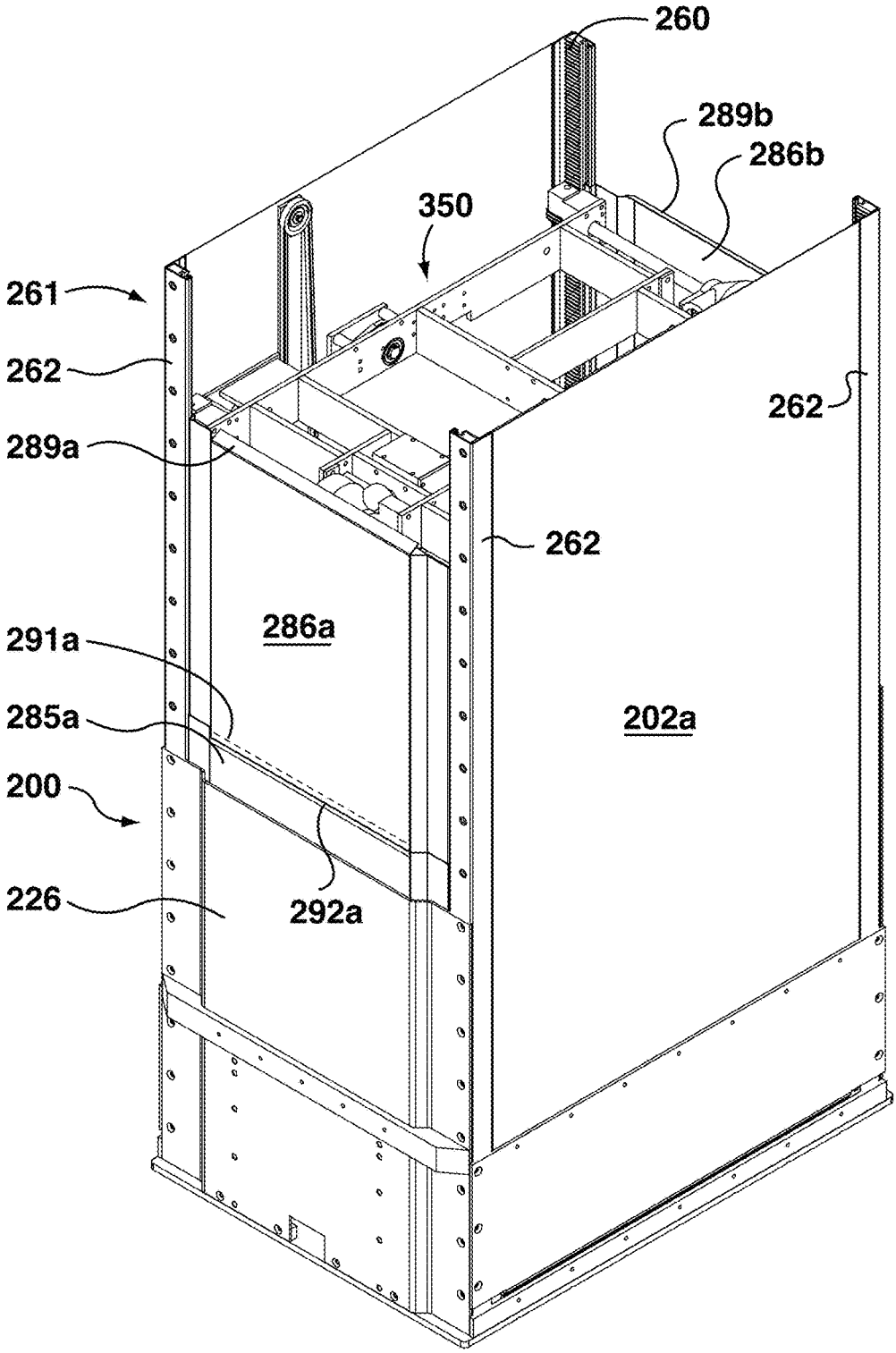
Figure 11:
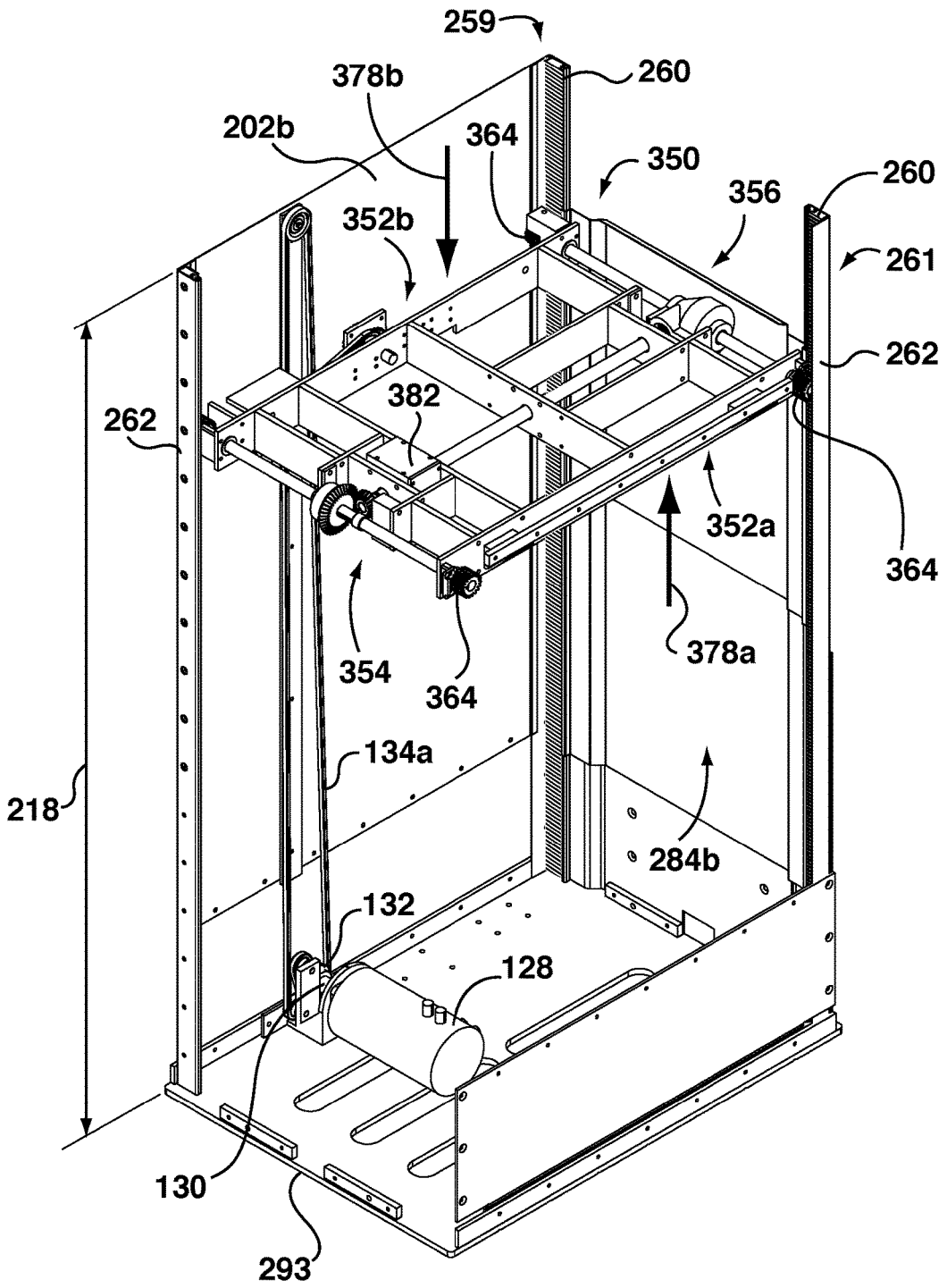
Figure 12:
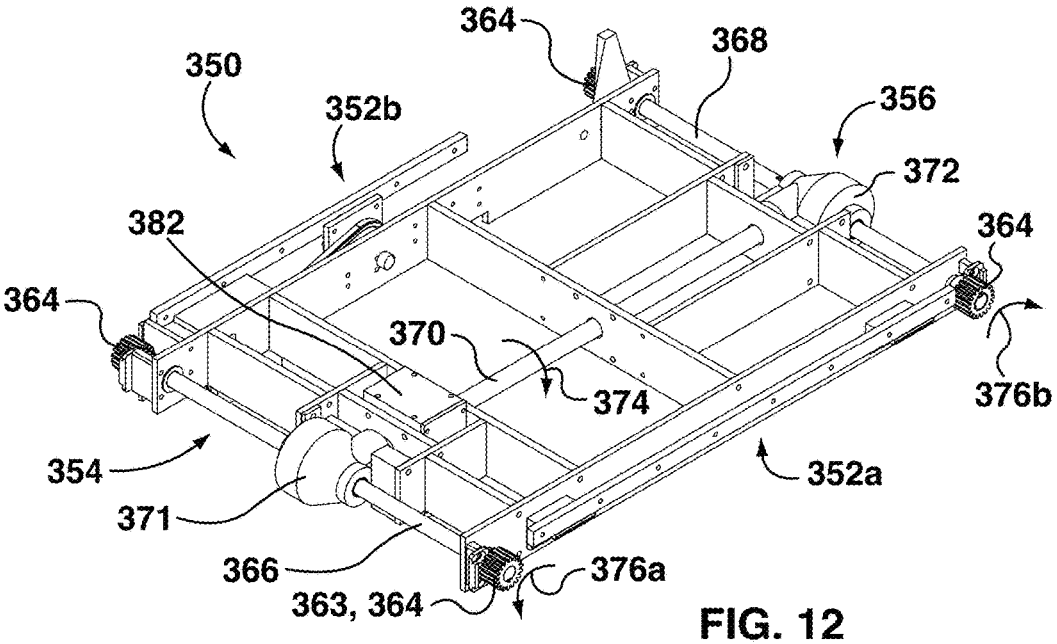
Figure 13:
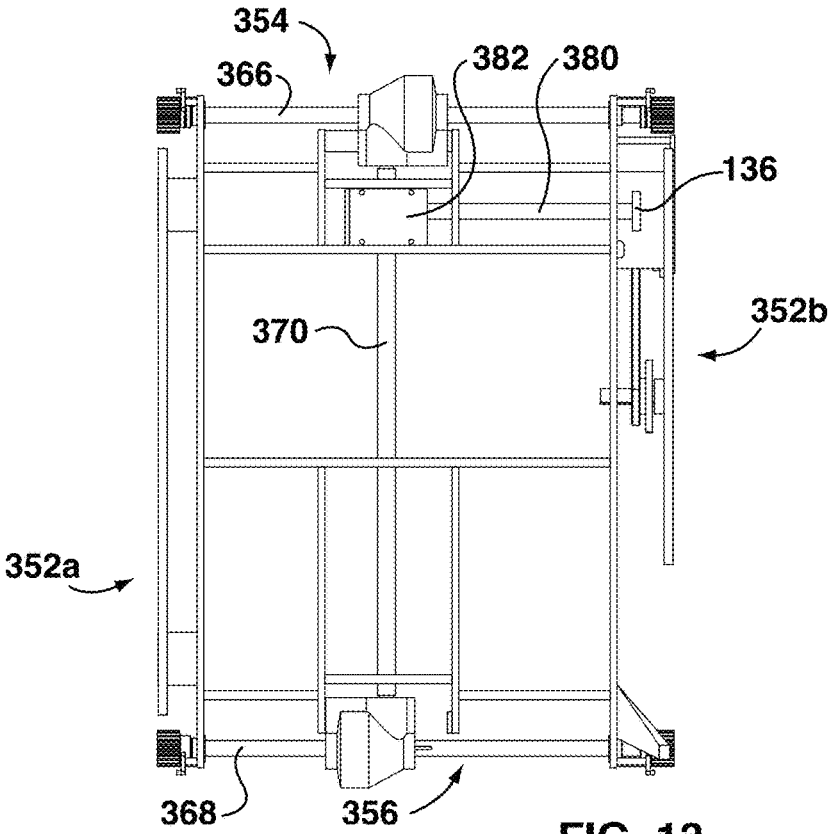
Figure 14:
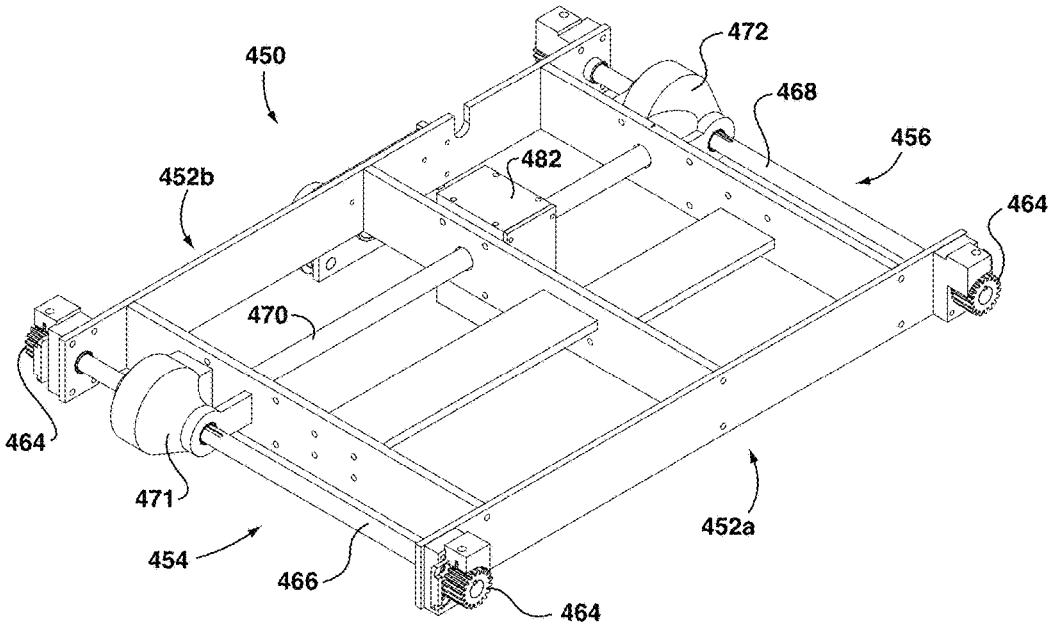
Figure 15:
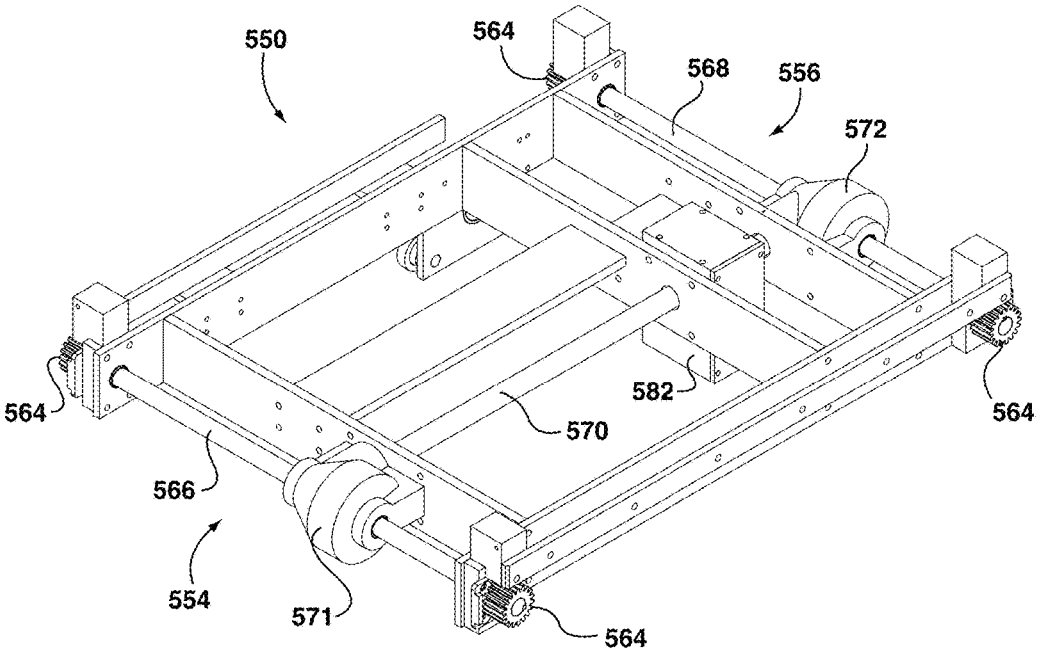
Figure 16:
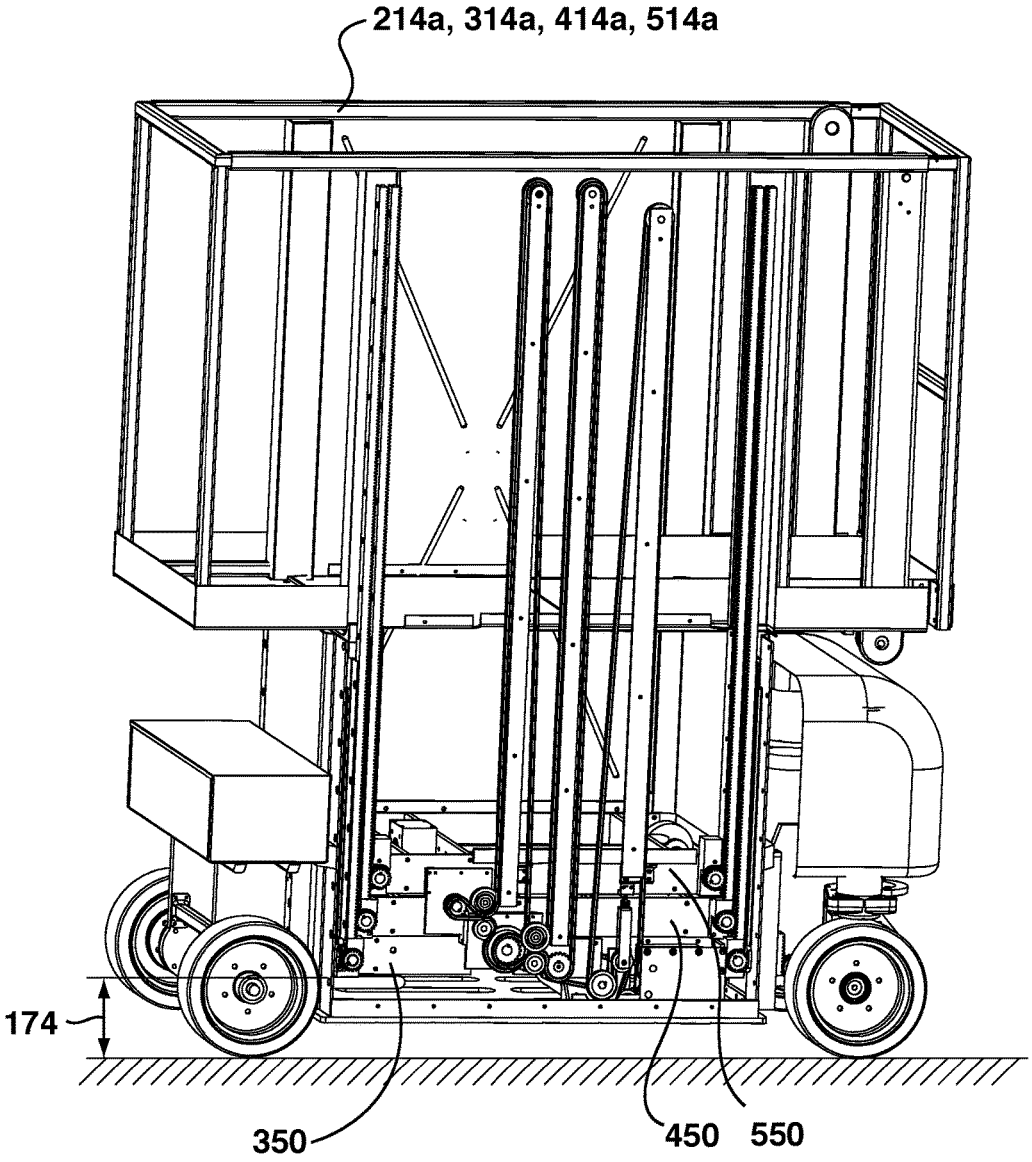
Figure 17:
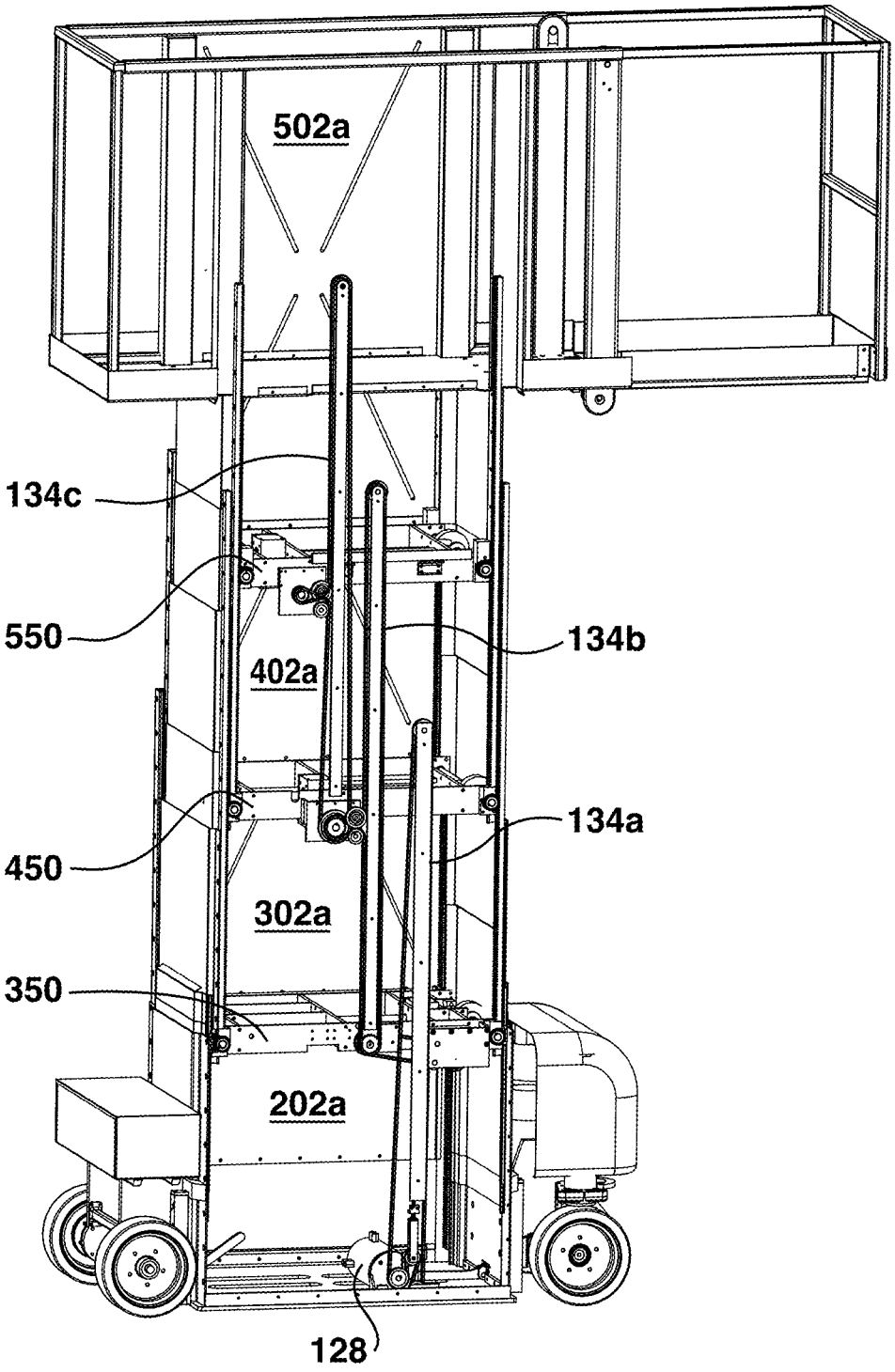
Figure 18:
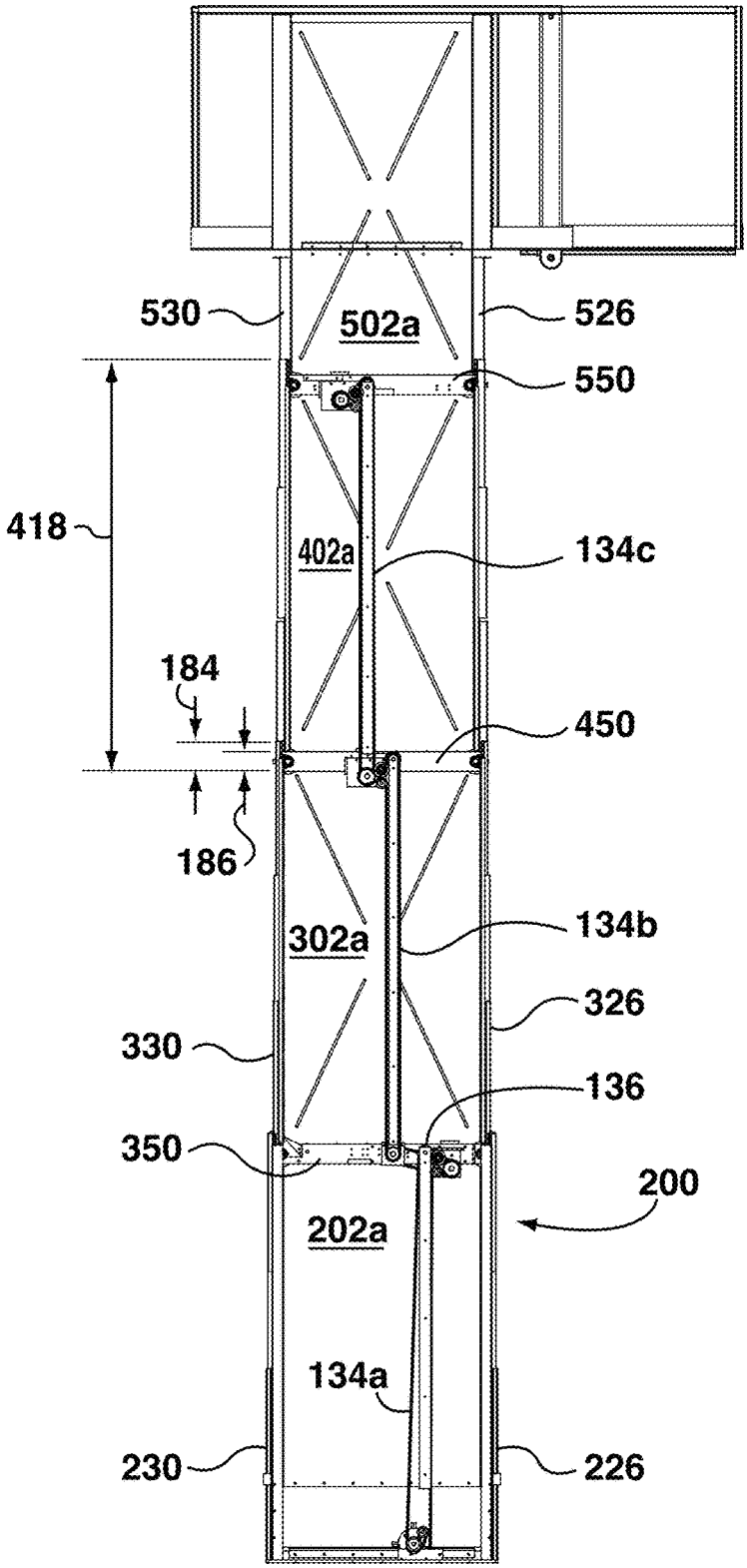
Figure 19:
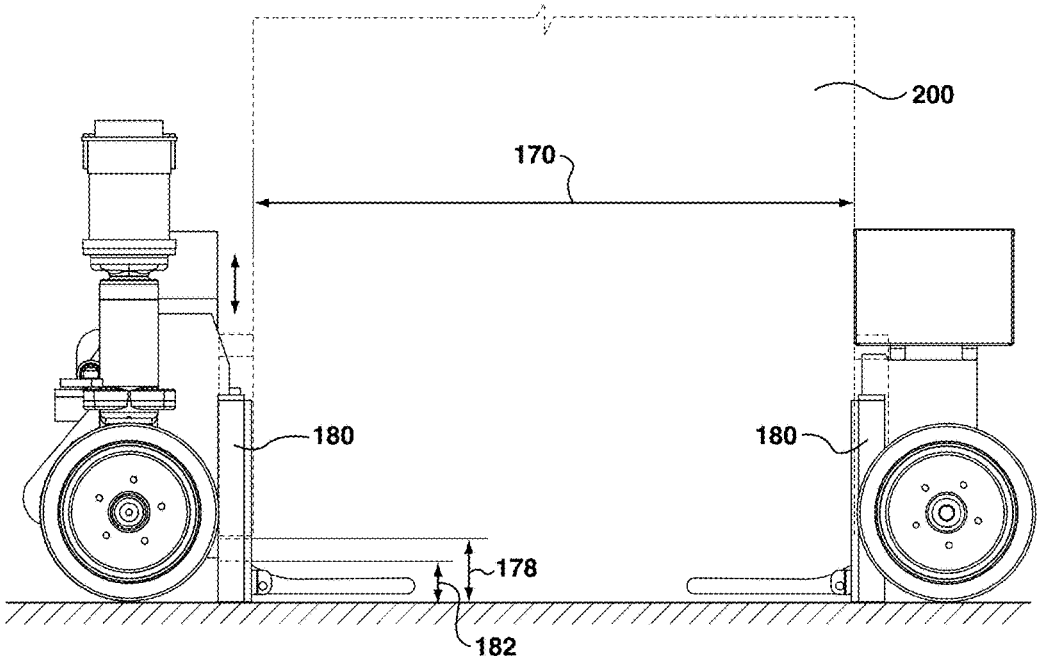
Figure 20:
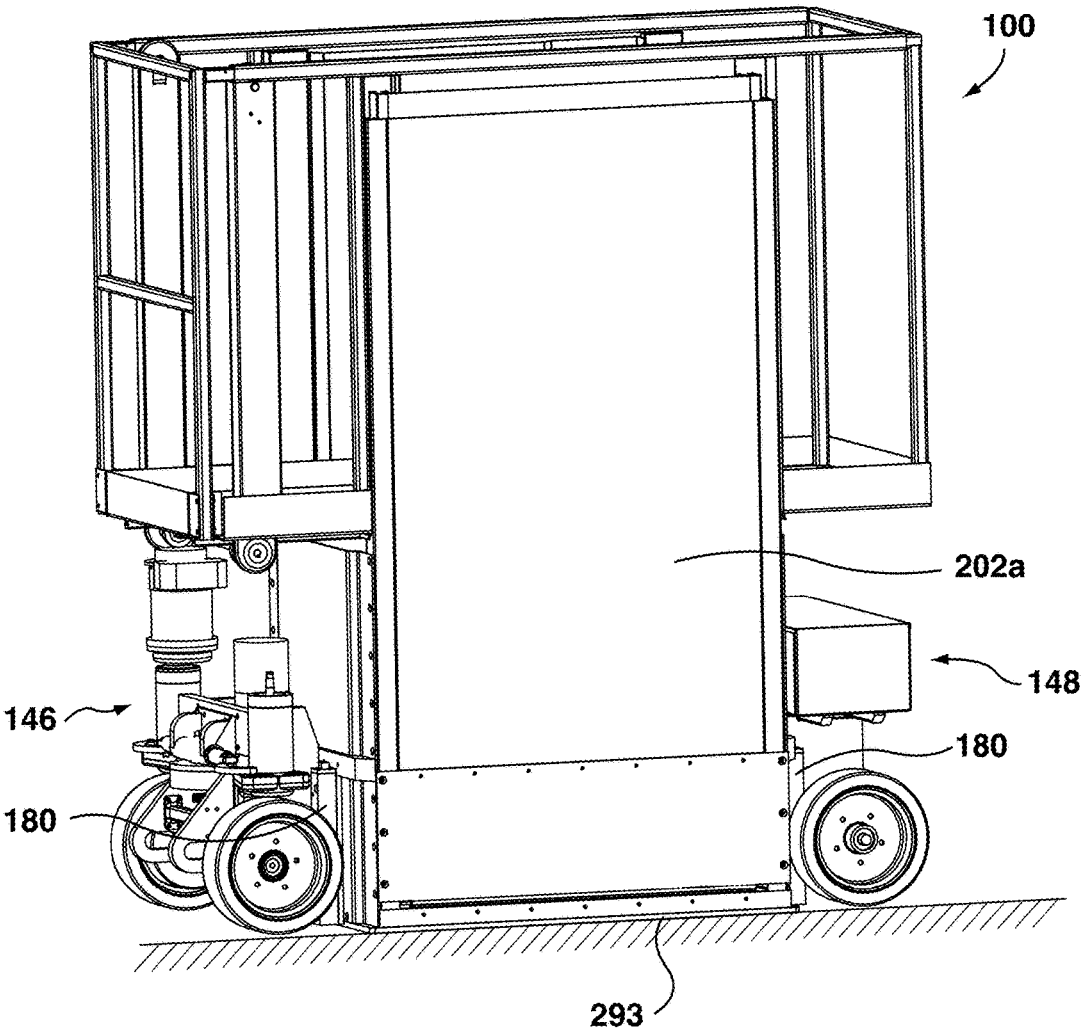
Figure 21:
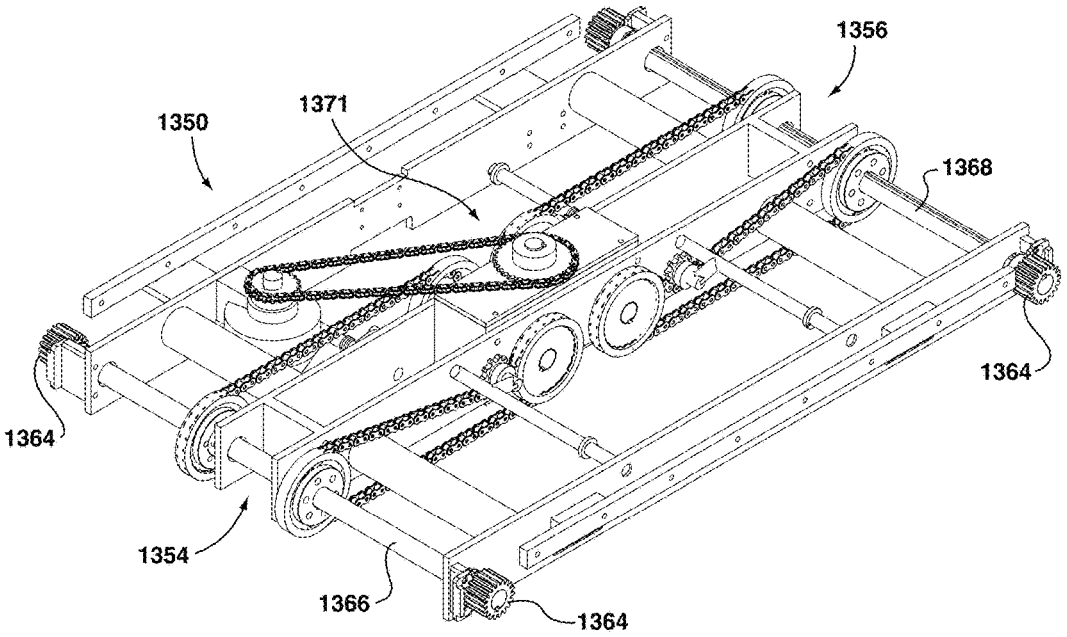
Figure 22:
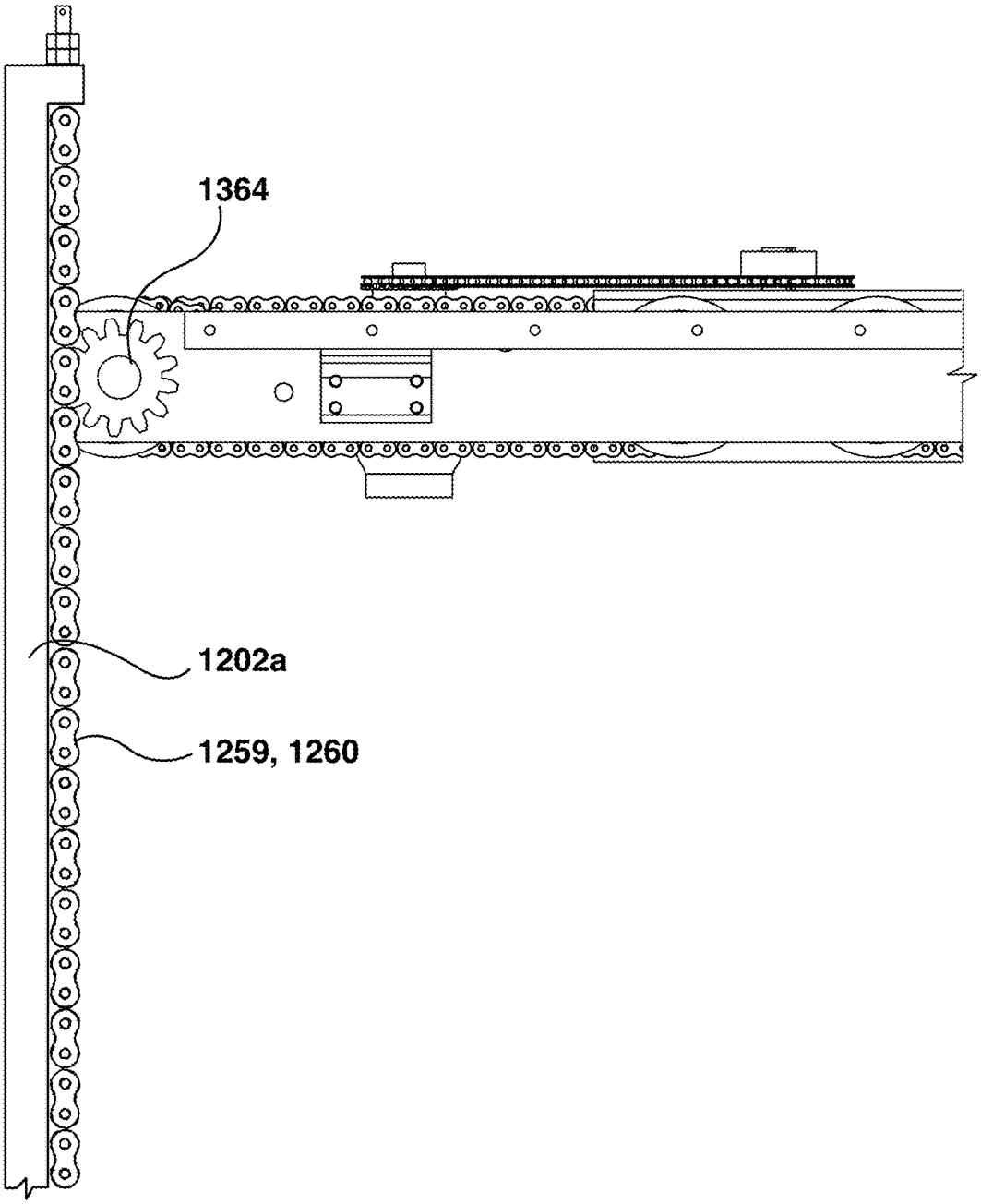
Figure 23:
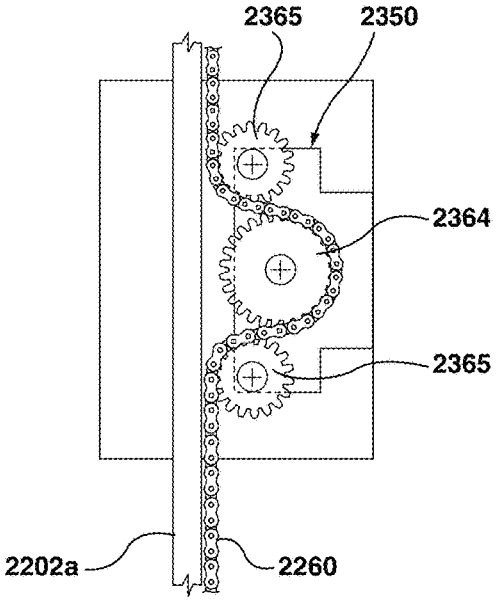
Figure 24:
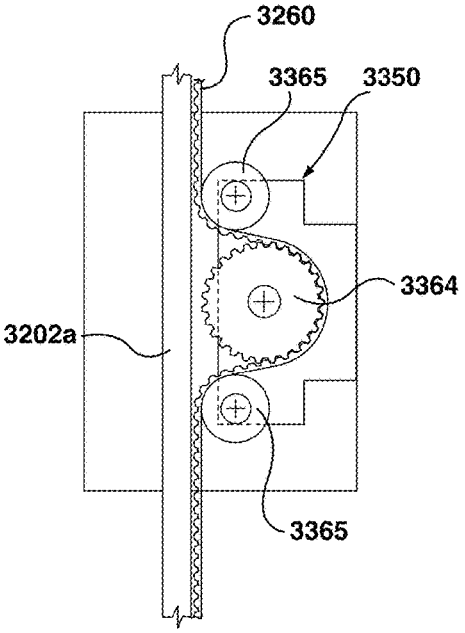
Figure 25:
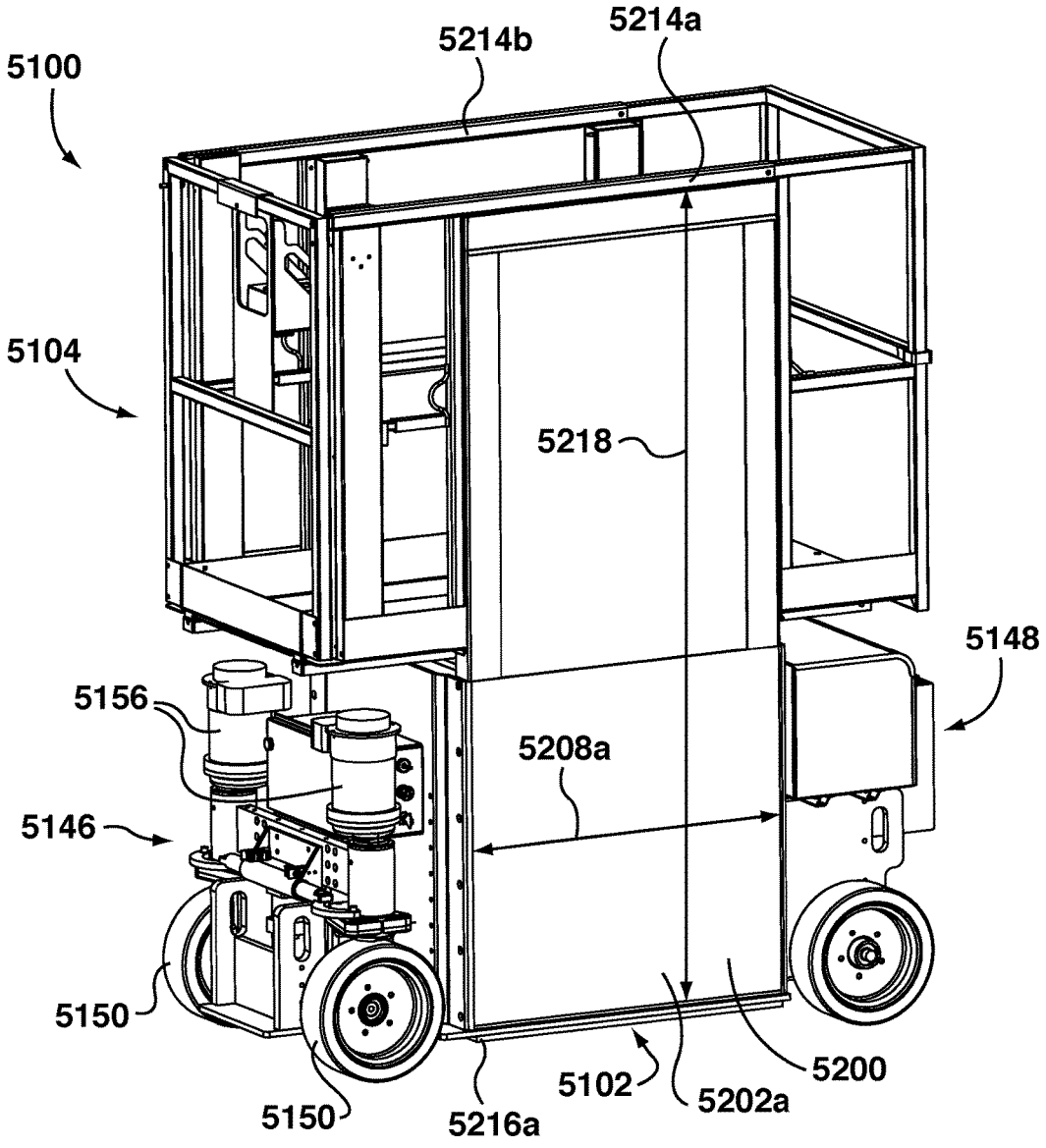
Figure 26:
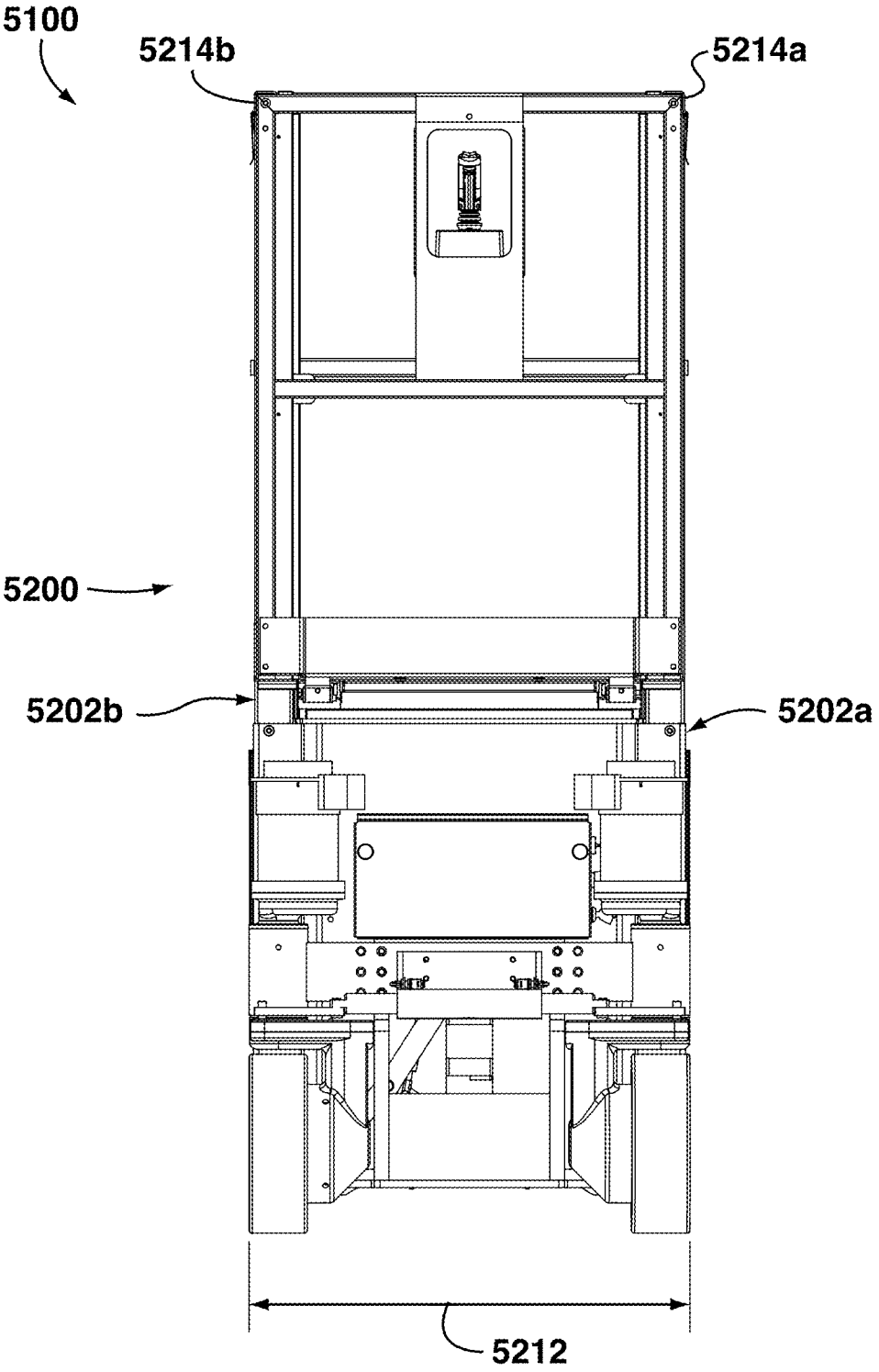
Figure 27:
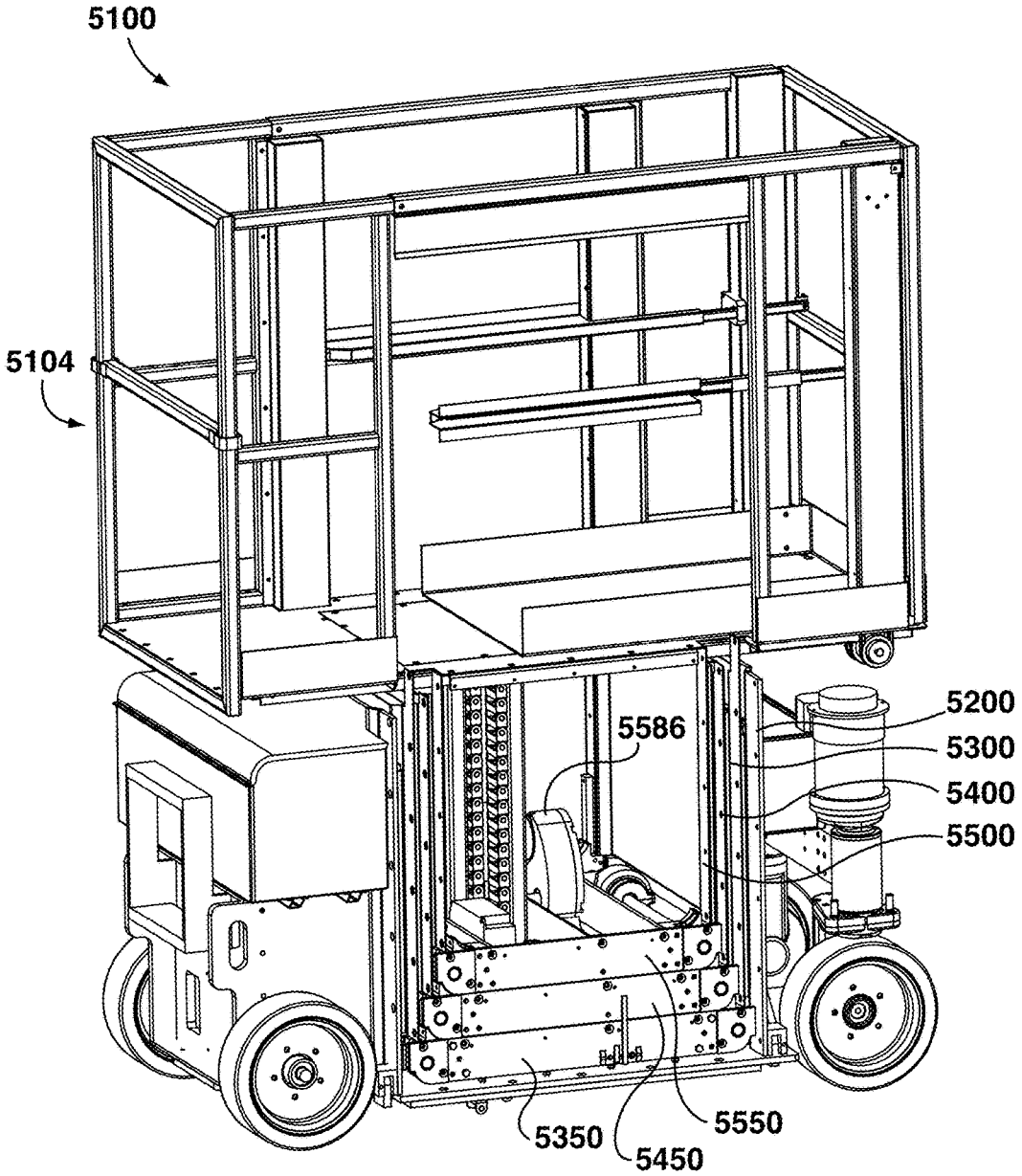
Figure 28:
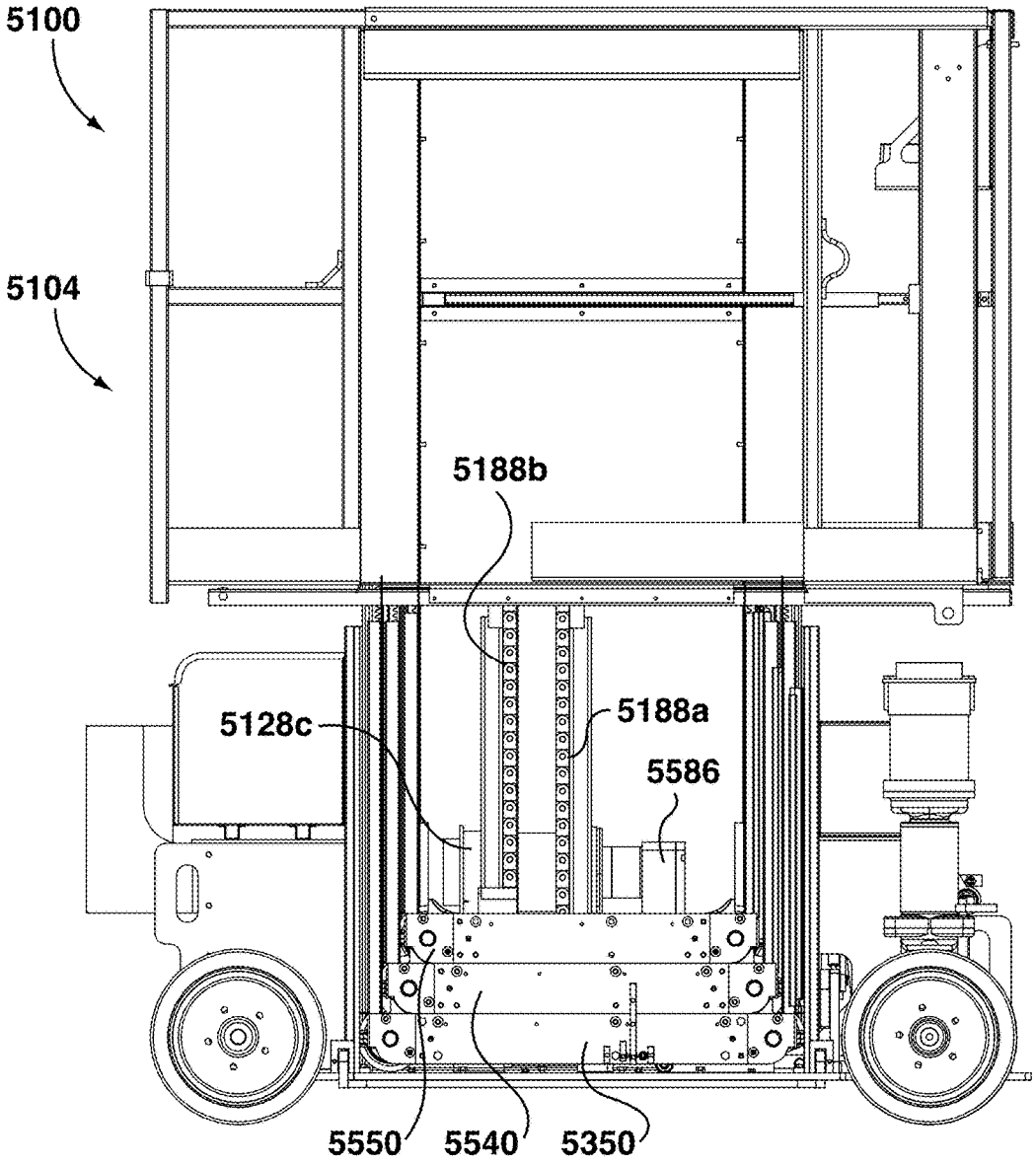
Figure 29:
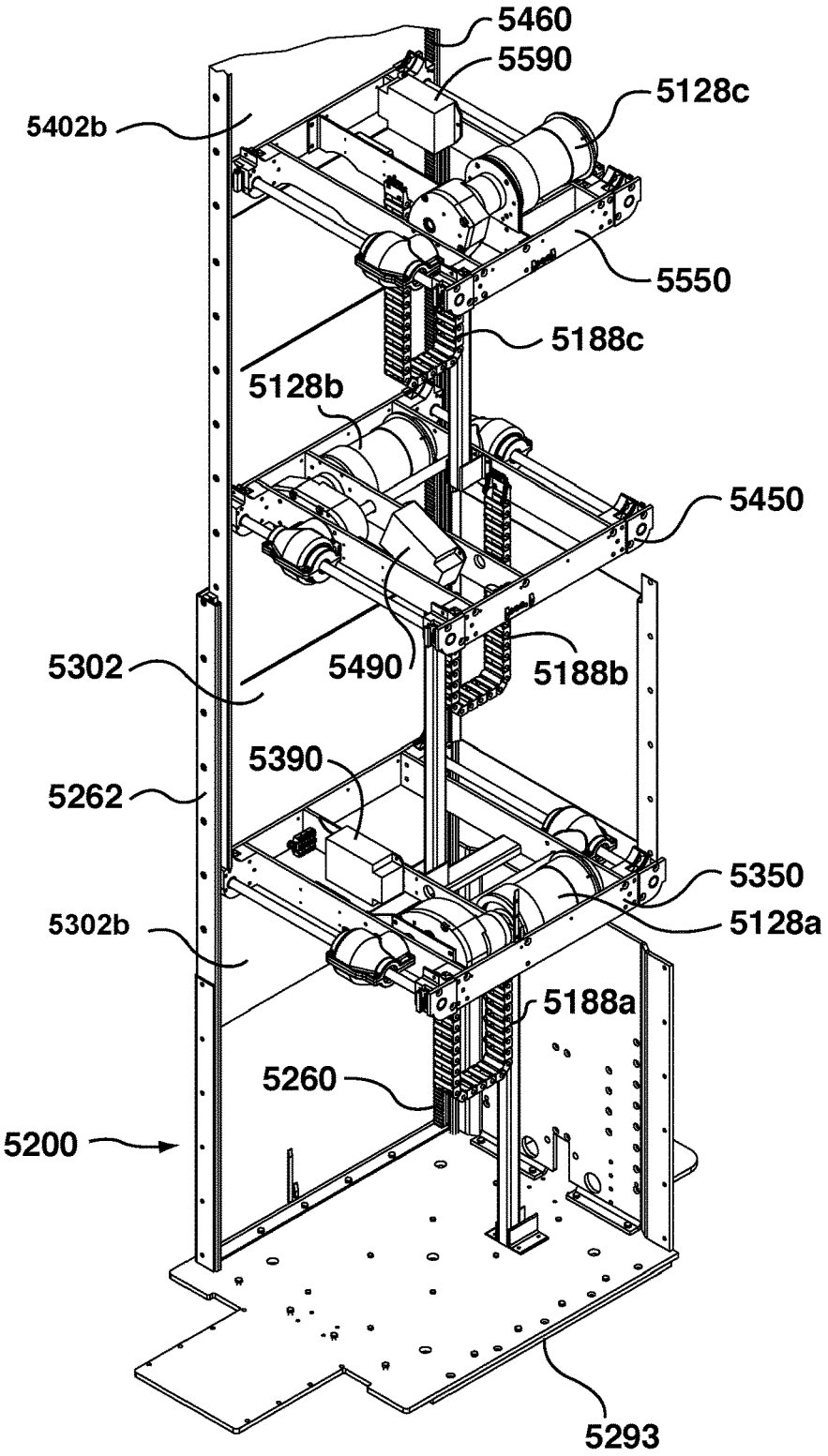
Figure 30:
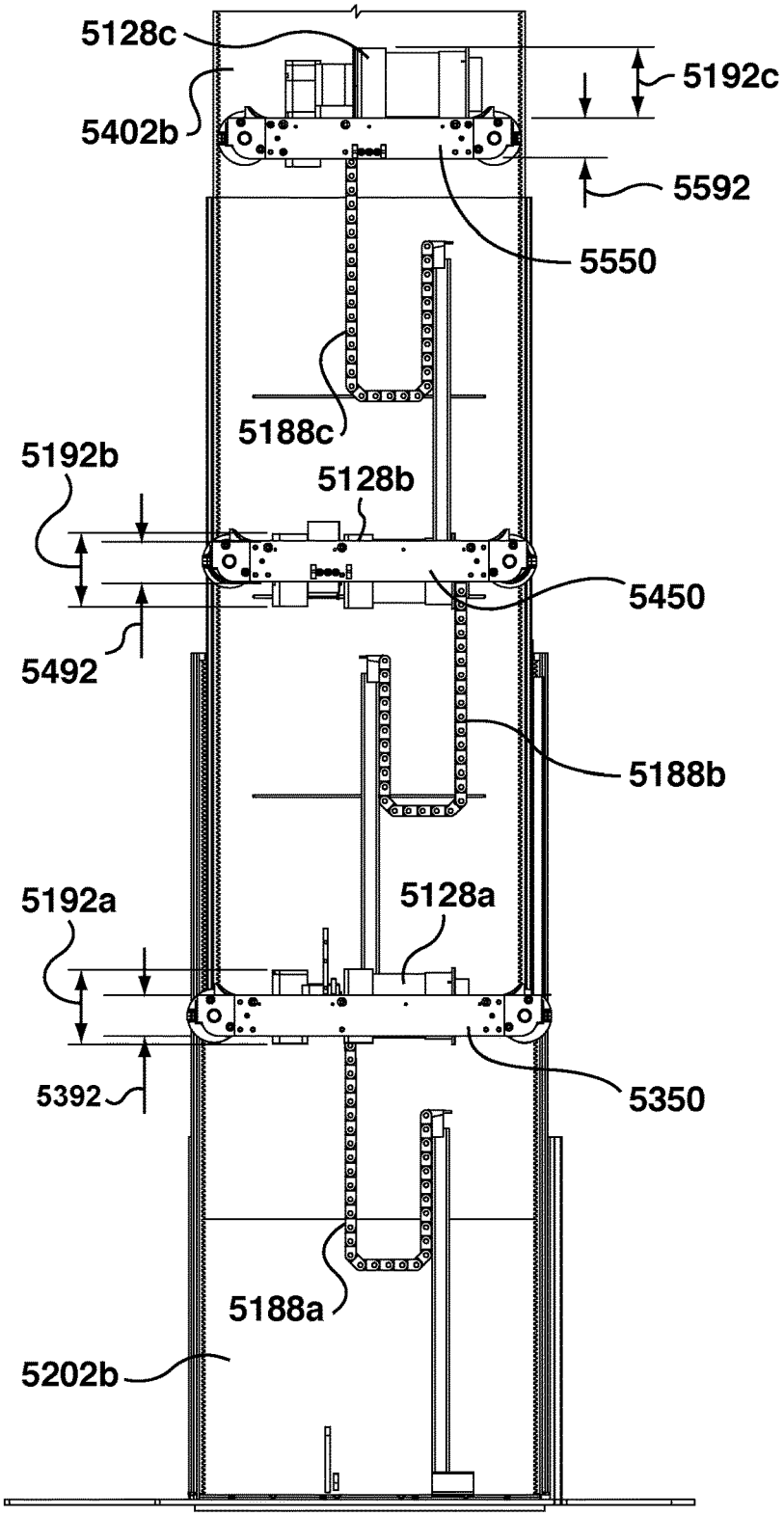
Figure 31:
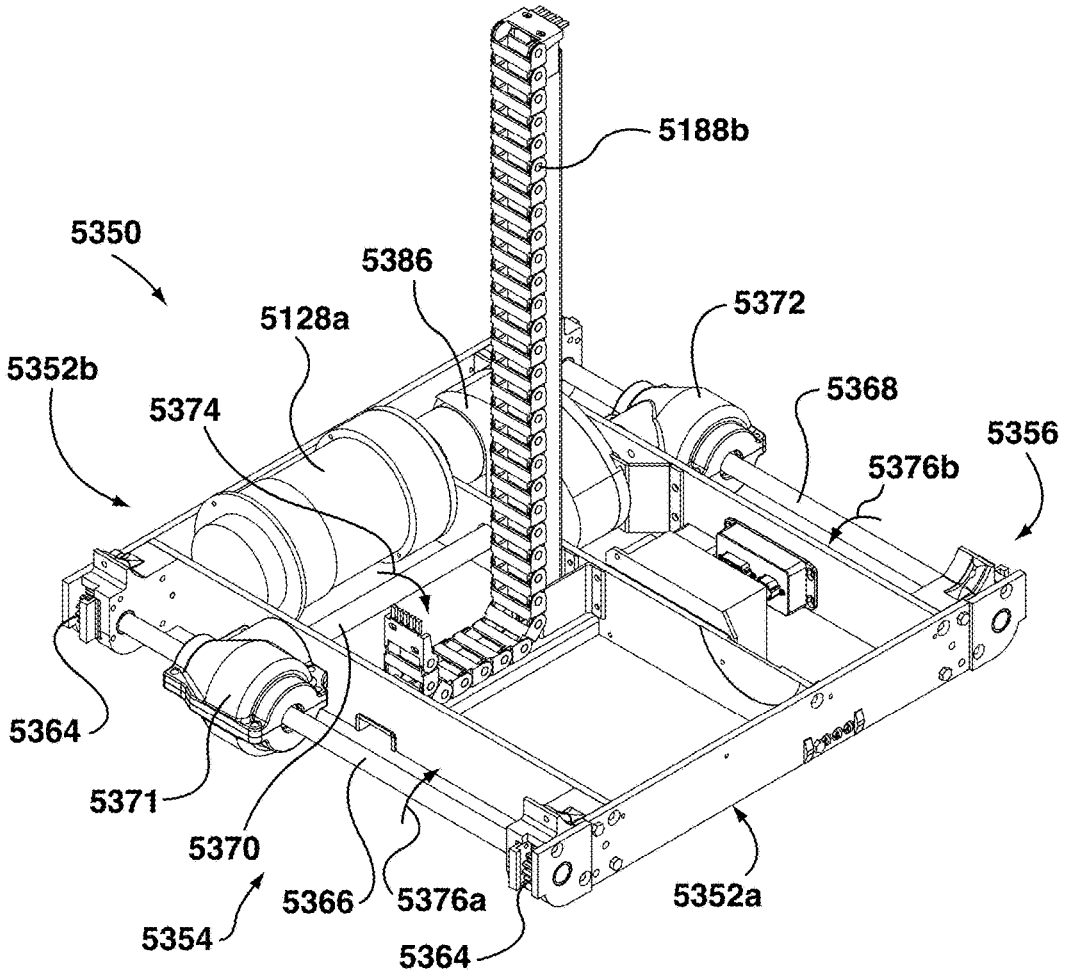
Figure 32:
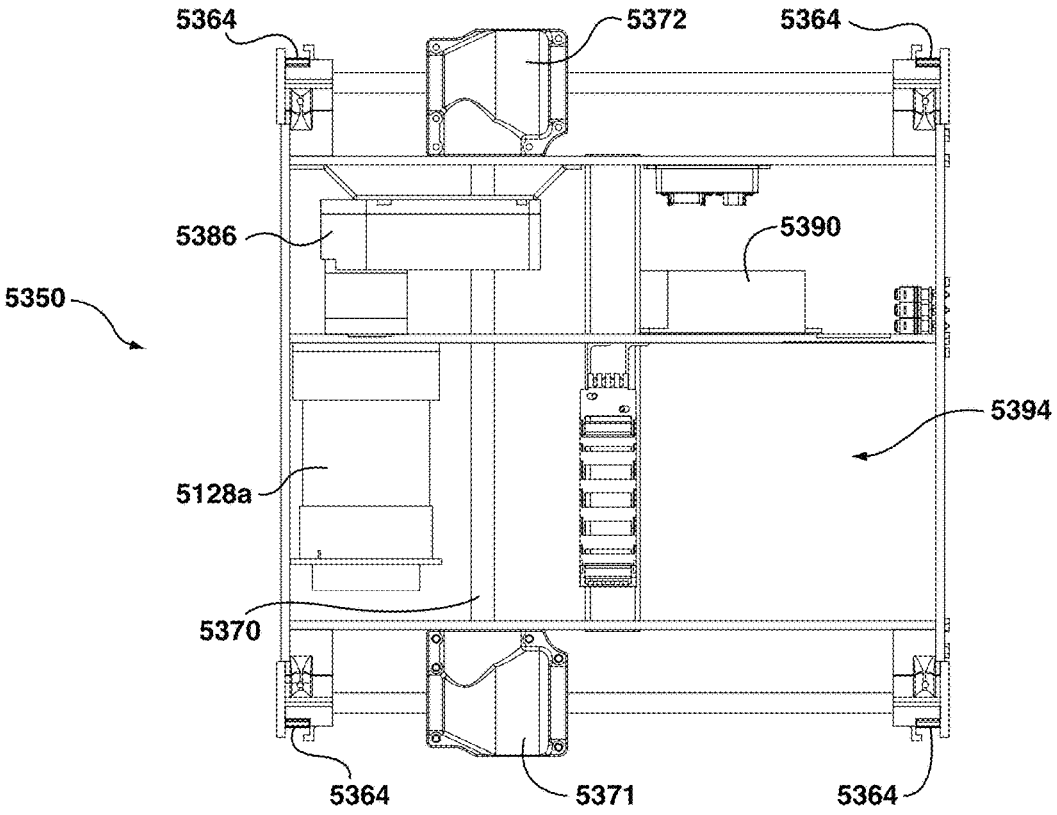
Figure 33:
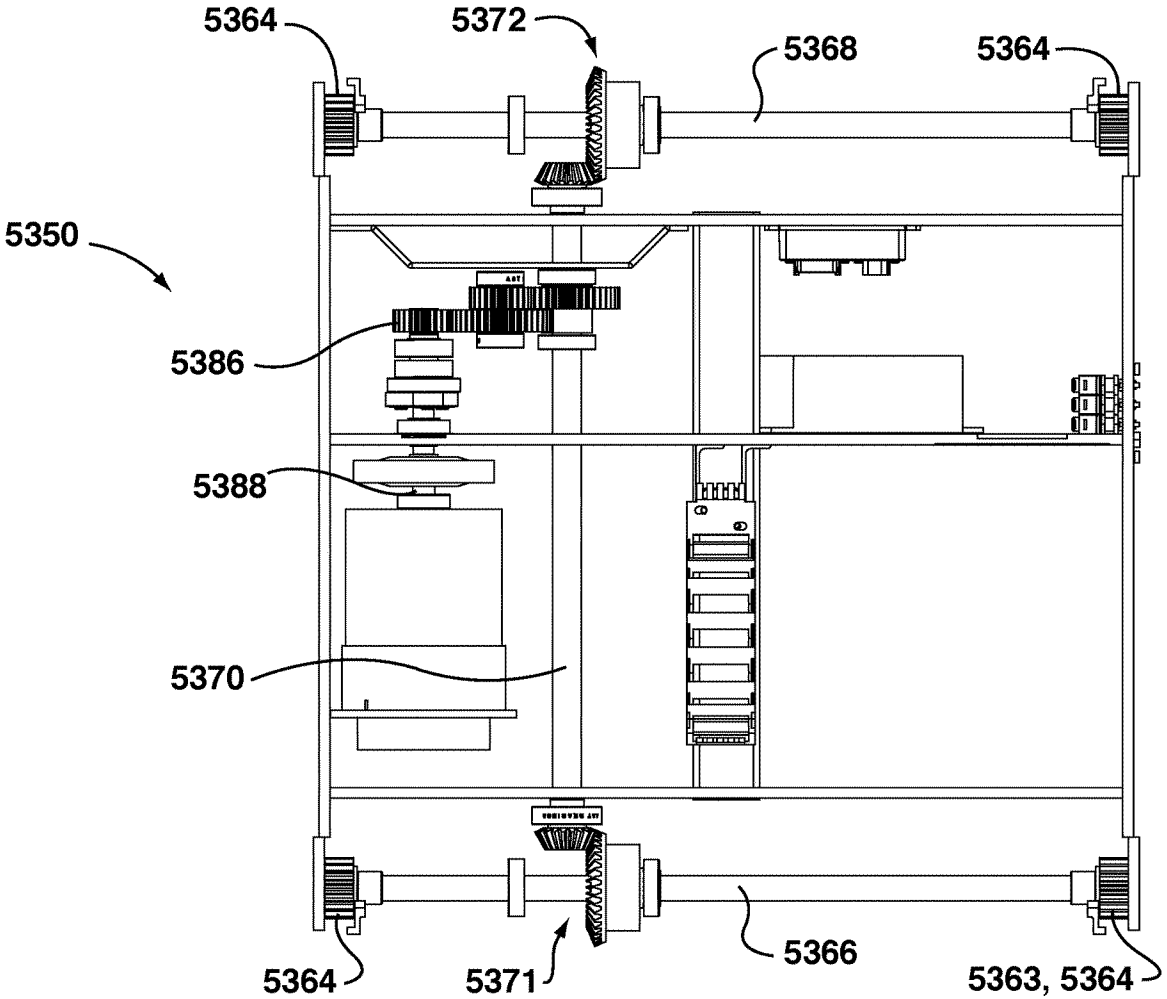
Figure 34:
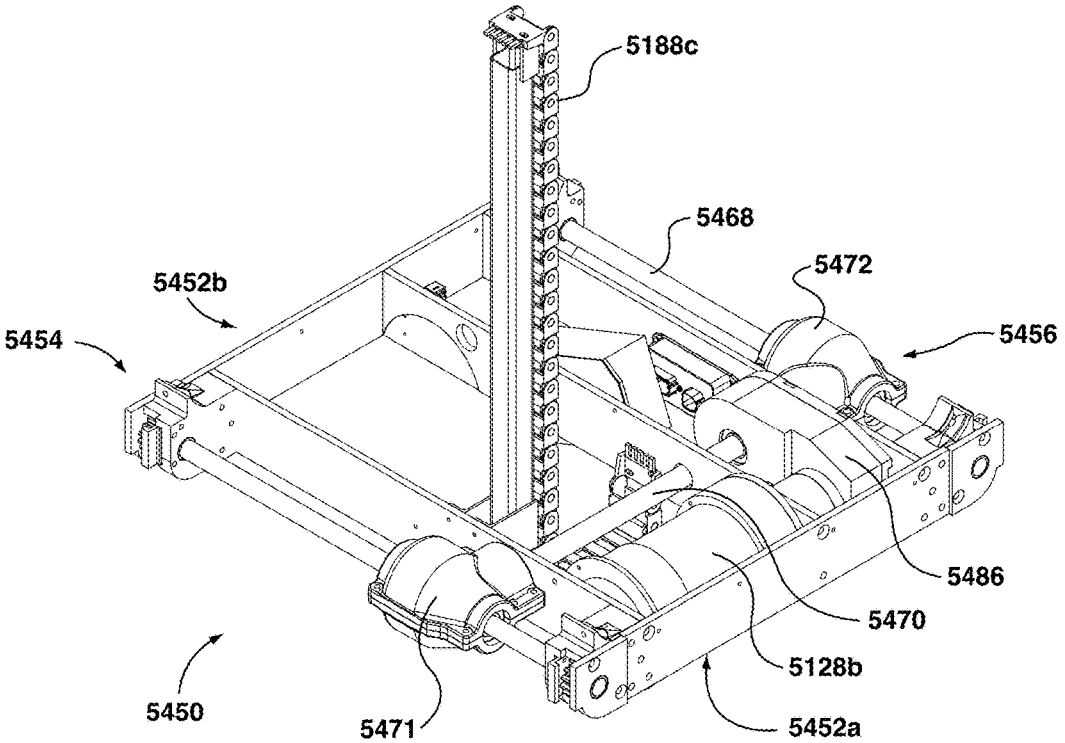
Figure 35:
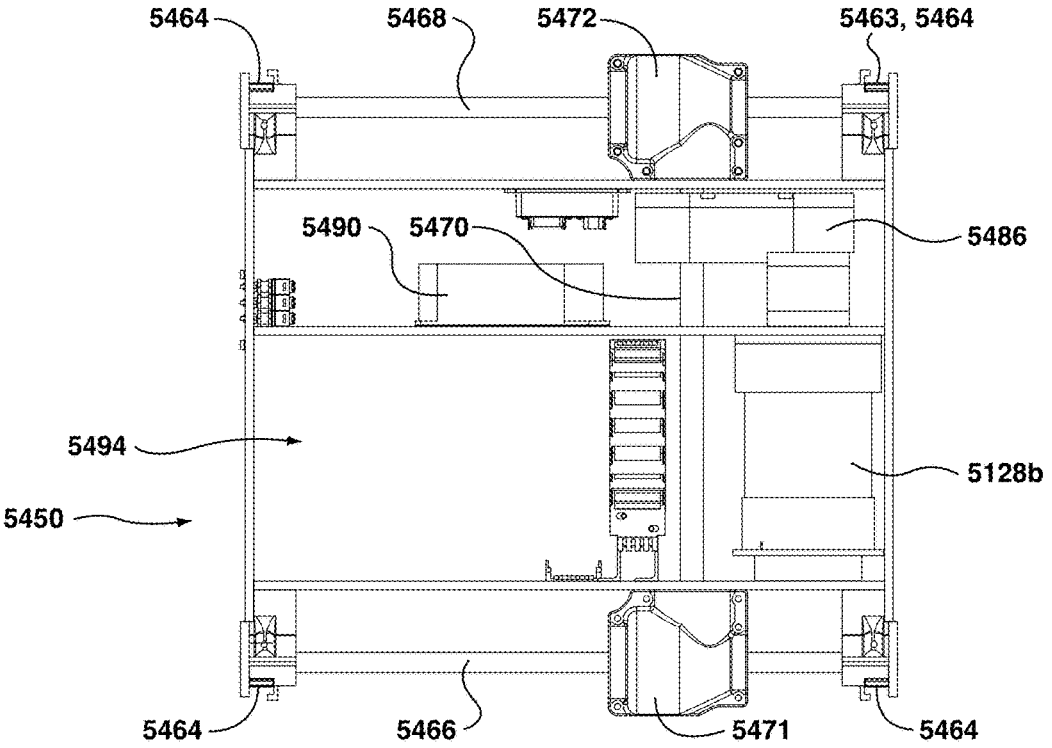
Figure 36:
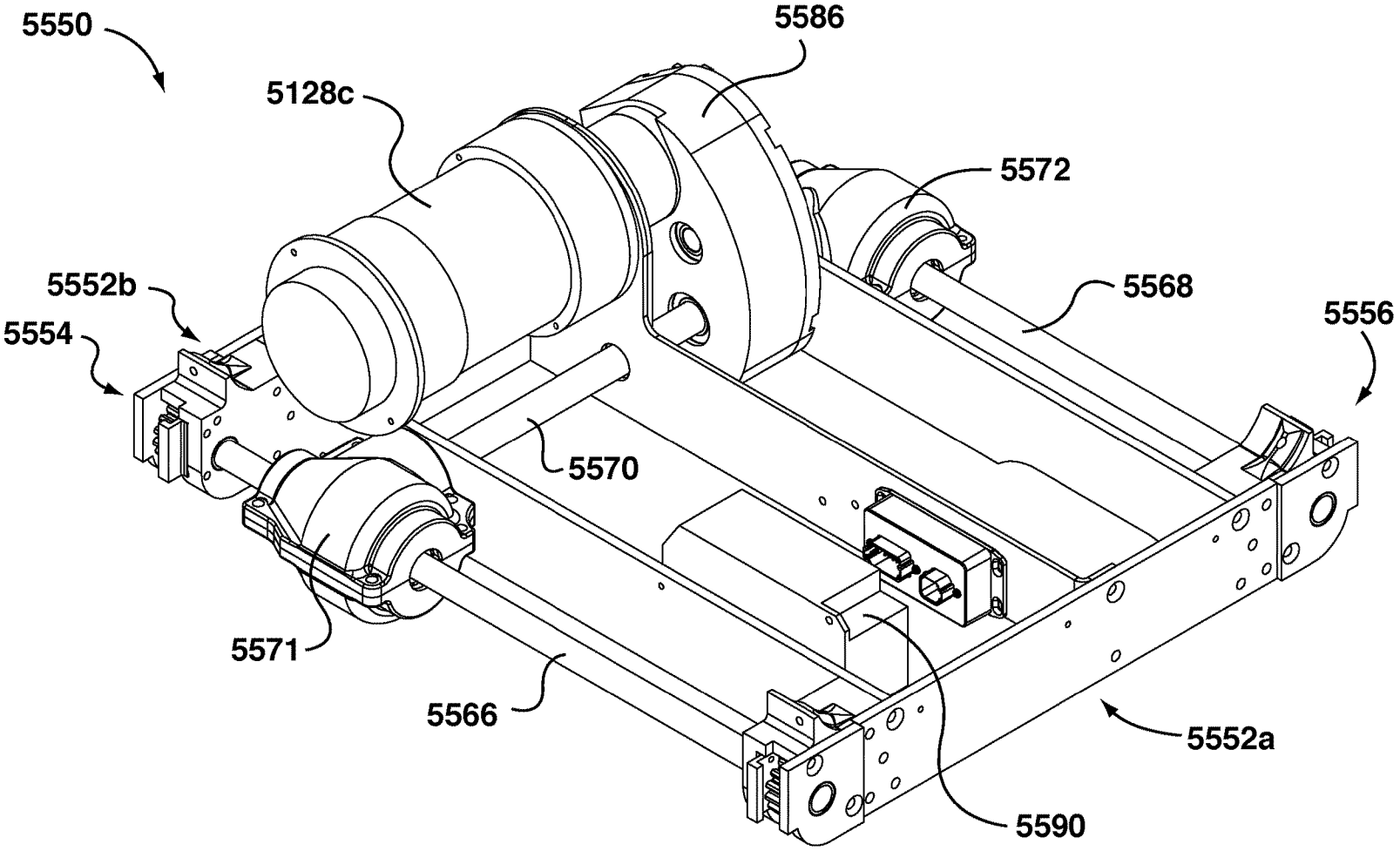
Figure 37:
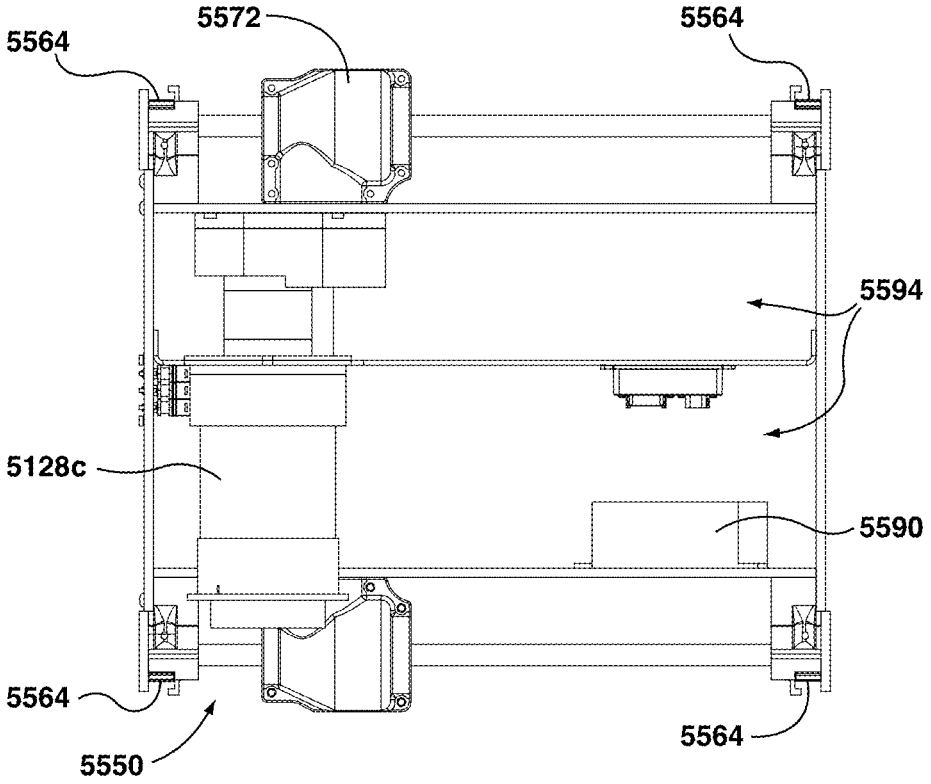
Figure 38:
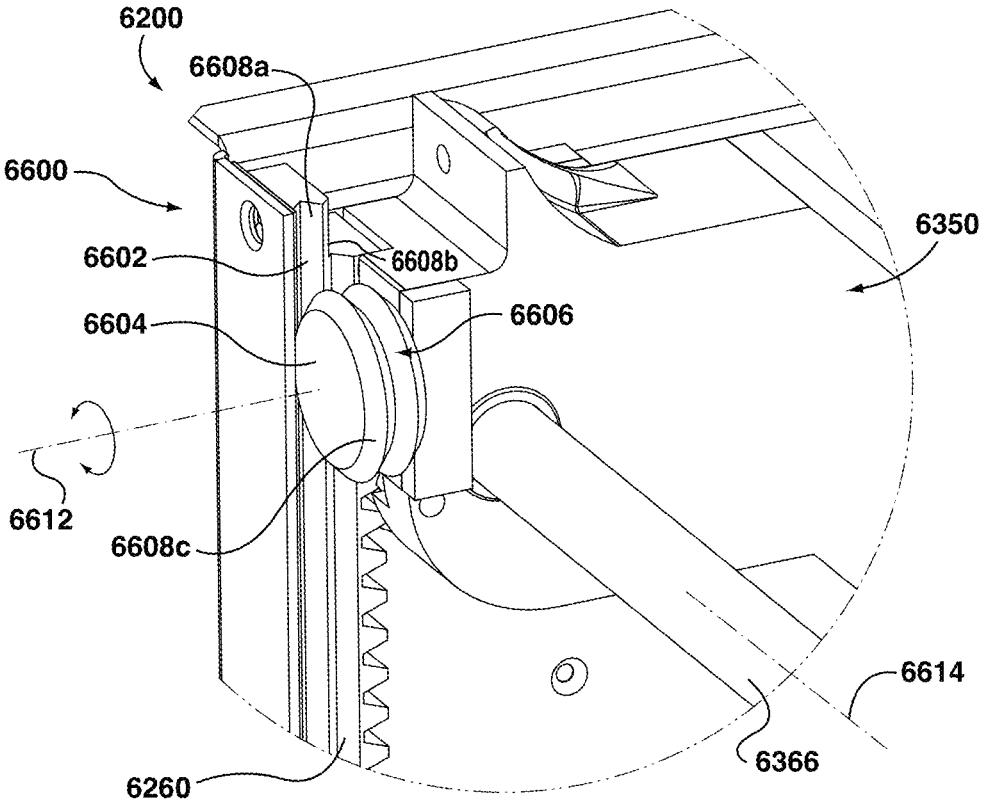
Figure 39:
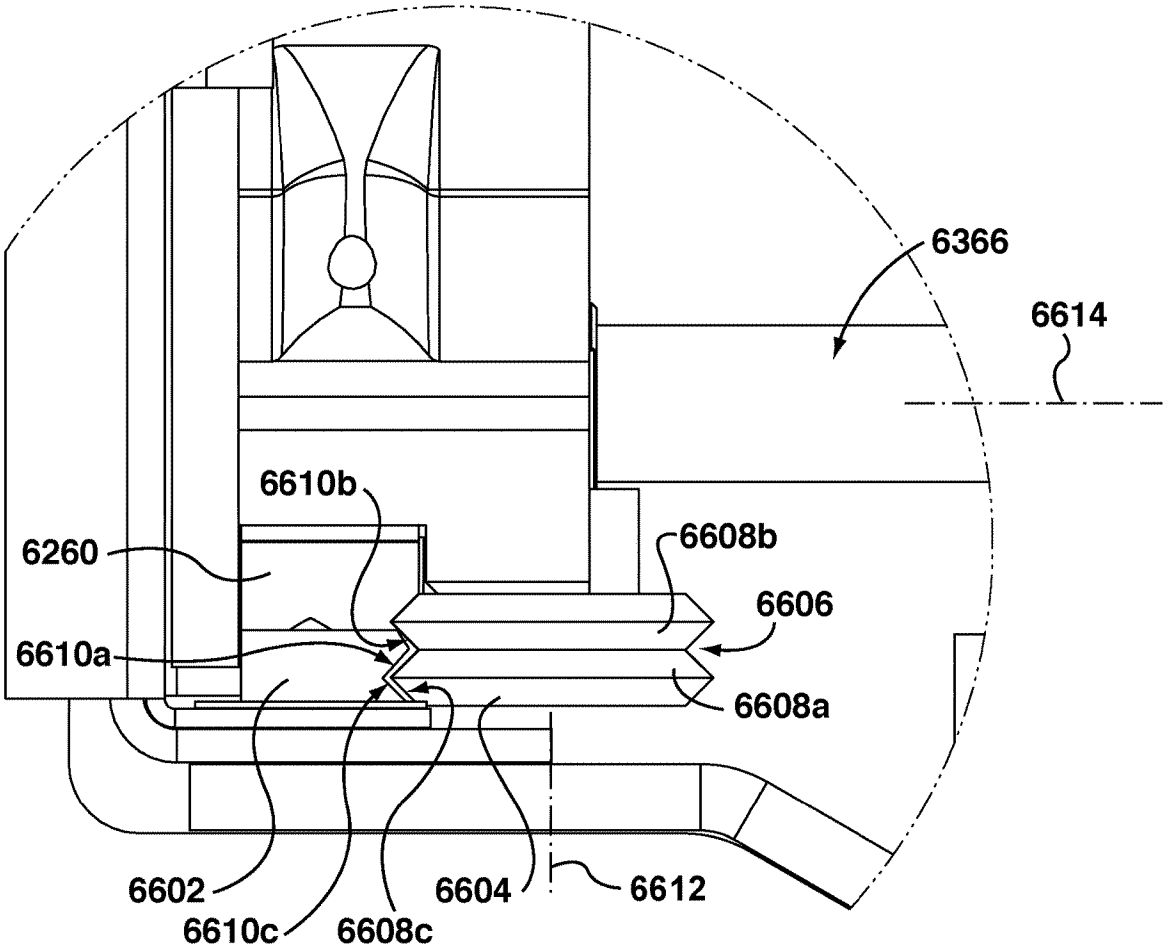
Figure 40:
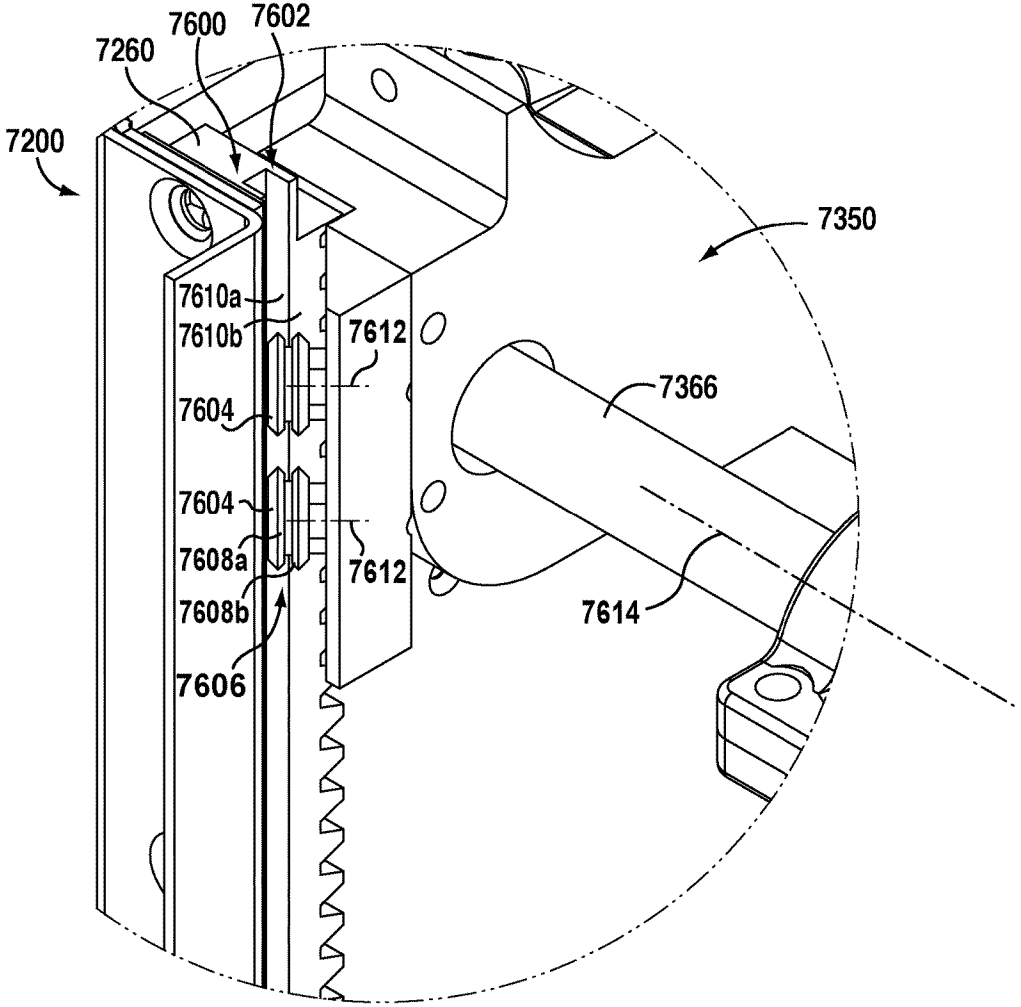
Figure 41:
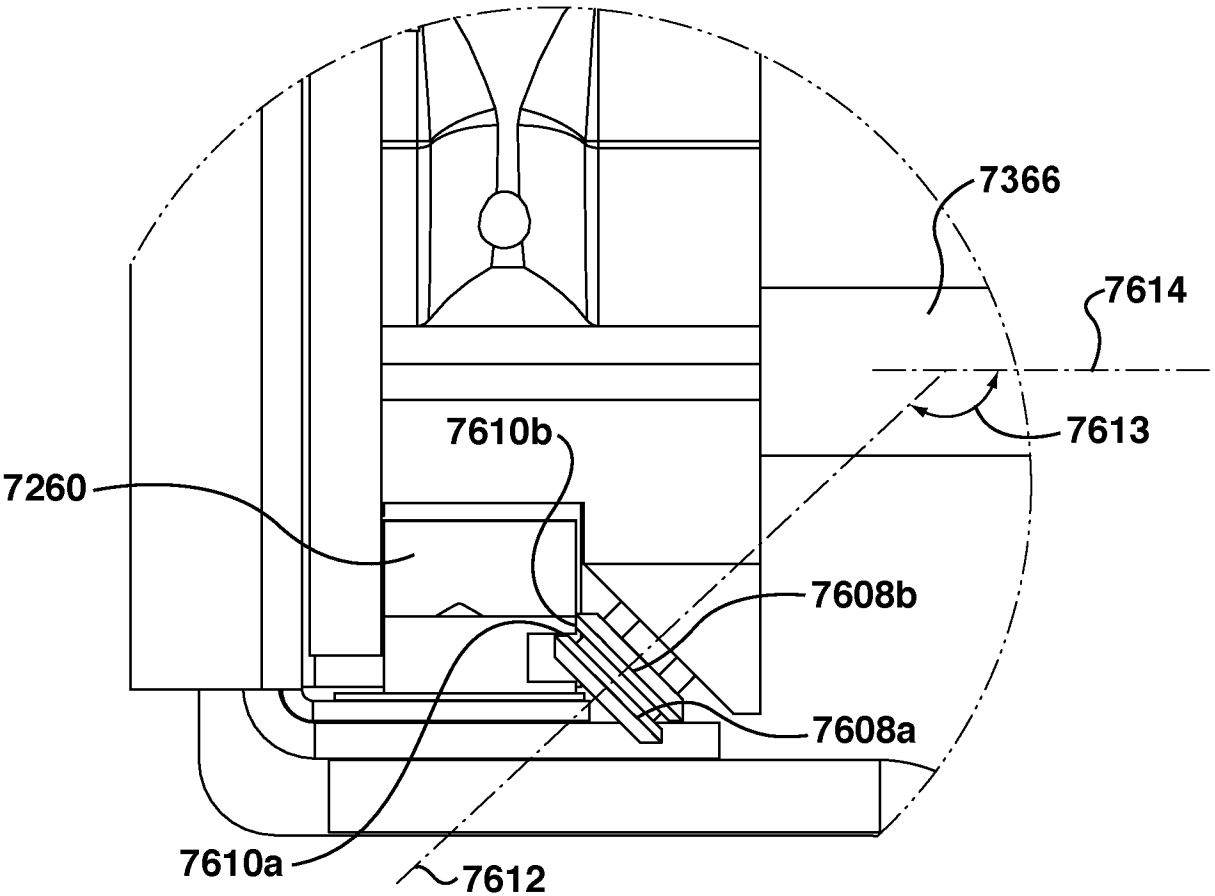

FIG. 9*a* is an enlarged, top view of a portion of the tower of FIG. 9;

FIG. 10 is a perspective view of the portion of the tower of FIG. 8, with front and rear covers partially deployed;

FIG. 11 is a perspective view of the portion of the tower of FIG. 8, with some elements removed;

FIG. 12 is a perspective view of a carriage portion of the structure of FIG. 10;

FIG. 13 is a top view of the carriage portion of FIG. 12;

FIG. 14 is a perspective view of another carriage coupleable to an intermediate section of the lifting apparatus of FIG. 1;

FIG. 15 is a perspective view of another carriage coupleable to the top section of the lifting apparatus of FIG. 1;

FIG. 16 is side view of the tower of the lifting apparatus of FIG. 1 with sidewalls removed and in a retracted configuration;

FIG. 17 is a side view of the tower of FIG. 16 in a partially extended configuration;

FIG. 18 is a side view of the tower of FIG. 16 in an extended configuration;

FIG. 19 is a side view of wheel assemblies of the lifting apparatus of FIG. 1;

FIG. 20 is a perspective view of the lifting apparatus of FIG. 1 in a transport configuration;

FIG. 21 is a perspective view of another example of a carriage;

FIG. 22 is a side view of the carriage of FIG. 21 and a portion of a bottom tower section;

FIG. 23 is a schematic view of a portion of another example of a carriage and a portion of a bottom tower section;

FIG. 24 is a schematic view of a portion of another example of a carriage and a portion of a bottom tower section;

FIG. 25 is a perspective view of another example of a lifting apparatus;

FIG. 26 is an end view of the lifting apparatus of FIG. 25;

FIG. 27 is a perspective view of the lifting apparatus of FIG. 25 with sidewalls removed;

FIG. 28 is a side view of the lifting apparatus of FIG. 25 with sidewalls removed;

FIG. 29 is a perspective view of a portion of the tower assembly of the lifting apparatus of FIG. 25;

FIG. 30 is a side view of the structure of FIG. 29;

FIG. 31 is a perspective view of a carriage portion of the lifting apparatus of FIG. 27;

FIG. 32 is a top view of the structure of FIG. 31;

FIG. 33 is a top view of the structure of FIG. 31 with covers removed;

FIG. 34 is a perspective view of another example of a carriage portion;

FIG. 35 is a top view of the structure of FIG. 34;

FIG. 36 is a perspective view of another example of a carriage portion;

FIG. 37 is a top view of the structure of FIG. 36;

FIG. 38 is a perspective view of a portion of a tower section and a carriage from another example of a lifting apparatus;

FIG. 39 is a top view of the structure of FIG. 38;

FIG. 40 is a perspective view of a portion of a tower section and a carriage from another example of a lifting apparatus; and FIG. 41 is a top view of the structure of FIG. 40.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 3:
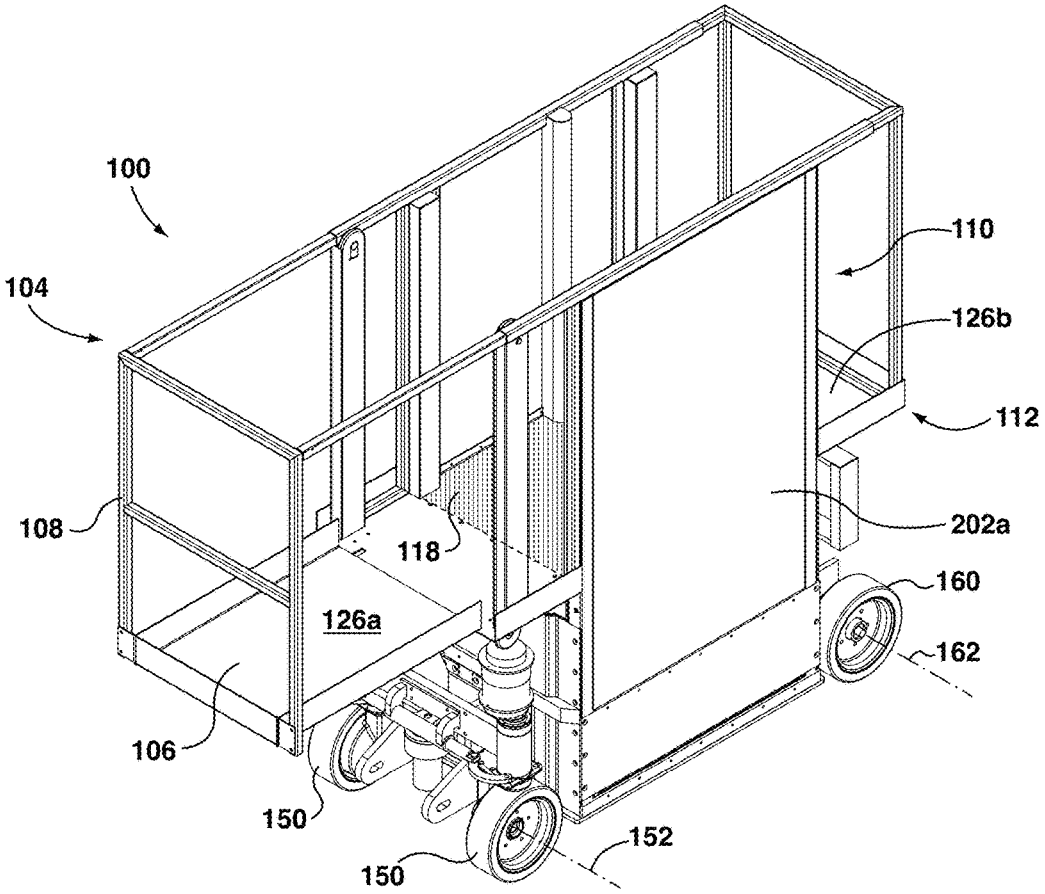
FIG. 3 is a perspective view of the lifting apparatus of FIG. 1 with the tower in a retracted configuration.

Referring to FIG. 1, an example of a mobile lifting apparatus 100 for raising and lowering one or more persons includes a tower assembly 102 having a bottom tower section 200, a top tower section 500, and a work platform 104 supported by the top tower section 500. An elevating assembly is provided to raise and lower the top tower section 500 relative to the bottom tower section 200 so that the tower assembly 102 can be moved between extended (FIG. 1) and retracted configurations (FIG. 3). The tower assembly may also include one or more intermediate tower sections. In the example illustrated, the tower assembly includes a first intermediate tower section 300 and a second intermediate tower section 400.

Referring also to FIG. 8, the bottom tower section 200 has a generally rectangular shape when viewed in horizontal cross-section, with front and back ends spaced apart from each other in a longitudinal direction, and left and right sides spaced apart from each other in a lateral direction. In the illustrated example, the bottom tower section 200 includes a first bottom sidewall 202*a* and an opposing second bottom sidewall 202*b* that is horizontally spaced apart from the first bottom sidewall 202*a*. The first bottom sidewall 202*a* has a first laterally inner surface 204*a*, an opposed outer surface 206*a* and a first wall length 208*a* extending in the longitudinal direction. The second bottom sidewall 202*b* has a second laterally inner surface 204*b*, laterally spaced apart from the first inner surface by a bottom inner width 210, and an opposed outer surface 206*b*. The second bottom sidewall has a second wall length 208*b* that extends in the longitudinal direction that is generally equal to the first wall length 208*a*. The distance between the outer surfaces 206*a* and 206*b* defines a tower outer width 212. Each sidewall also extends vertically between respective upper edges 214*a* and 214*b* and lower edges 216*a* and 216*b* and defines a bottom tower section height 218.

The bottom tower section 200 has a front face 220 and a rear face 222 longitudinally spaced apart from the front face 220. In the illustrated example the first and second bottom sidewalls 202*a* and 202*b* extend continuously between the bottom front and rear faces 220 and 222. In this example, the front face 220, rear face 222 and the first and second bottom sidewalls 202*a* and 202*b* co-operate to form a lower periphery and generally define an interior 224 of the bottom tower section 200.

Referring also to FIG. 9, in the illustrated example, a lower portion of the front face 220 includes a relatively shorter bottom front wall 226 extending laterally between the first and second bottom sidewalls 202*a* and 202*b*. In the illustrated example, an upper portion 228 of the bottom front face 220 does not include a fixed wall member and can be left open. Similarly, in the example illustrated, a lower portion of the bottom rear face 222 includes a bottom rear wall 230 (FIG. 2) extending laterally between the first and second bottom sidewalls 202*a* and 202*b*. An upper portion 231 of the bottom rear face 222 also does not include a fixed wall member, and can be left open. The bottom front and rear walls 226 and 230 have respective upper edges 232 and 234 and have substantially the same height 240 in the vertical direction. The side edges of the bottom front and rear walls 226 and 230 are coupled to each of the bottom sidewalls 202*a* and 202*b*, and in this configuration the bottom front and rear walls 226 and 230 may help resist lateral deflection of the bottom sidewalls 202*a* and 202*b*. In the example illustrated the bottom front wall 226 and the bottom rear wall 230 help to resist deflection of the first and second bottom sidewalls 202*a* and 202*b* in a direction away from or toward each other. This may help increase the stiffness of the bottom tower section 200 (and other tower sections may have an analogous construction).

Optionally, the bottom front and rear walls 226 and 230 may have a wall thickness 294 that is greater than the thickness 295 of the bottom sidewalls 202*a* and 202*b*. Referring to FIG. 9*a*, in the illustrated example, the bottom sidewalls 202*a* and 202*b* are formed from 16 or 18 gauge sheet steel, which has a thickness of about 0.12 cm to about 0.18 cm and the bottom front and rear walls 226 and 230 are formed from 9 gauge sheet steel, which has a thickness of about 0.38 cm. In this configuration, the thickness of the bottom front and rear walls 226 and 230 is about twice the thickness of the bottom sidewalls 202*a* and 202*b*, and may be more than twice the thickness. Alternatively, the bottom front and rear walls 226 and 230 may be approximately the same thickness as the bottom sidewalls 202*a* and 202*b*. Providing relatively thicker front and rear walls 226 and 230 may help increase the strength of the front and rear walls 226 and 230, which may help stiffen the bottom tower section 200 and help resist both inward and outward deflection of the first and second bottom sidewalls 202*a* and 202*b*.

Optionally, some or all of the tower sections may be provided with one or more bracing members to help resist lateral deflection of the respective sidewalls. For example, the bottom tower section 200 may be provided with at least one bracing member 261 to help limit deflection of the first and second bottom sidewalls 202*a* and 202*b*. The strength and configuration of the bracing members may be selected based on their expected loading. For example, the bracing member on the bottom tower section 200 may be stronger than the bracing member on the top tower section 500, as the top tower section 500 does not need to support as much weight as the bottom tower section 200. Referring to FIG. 10, in the illustrated example the bracing members are provided in the form of uprights 262 configured as angle members. The uprights 262 extend substantially the entire height of the first and second bottom sidewalls 202*a* and 202*b*, and may help resist both inward and outward deflection of the first and second bottom sidewalls 202*a* and 202*b*.

In the illustrated example, the first intermediate tower section 300, the second intermediate tower section 400 and the top tower section 500 have some structural similarities with the bottom tower section 200, and like features are identified using like reference characters incremented by 100, 200 and 300 respectively.

Figure 6:
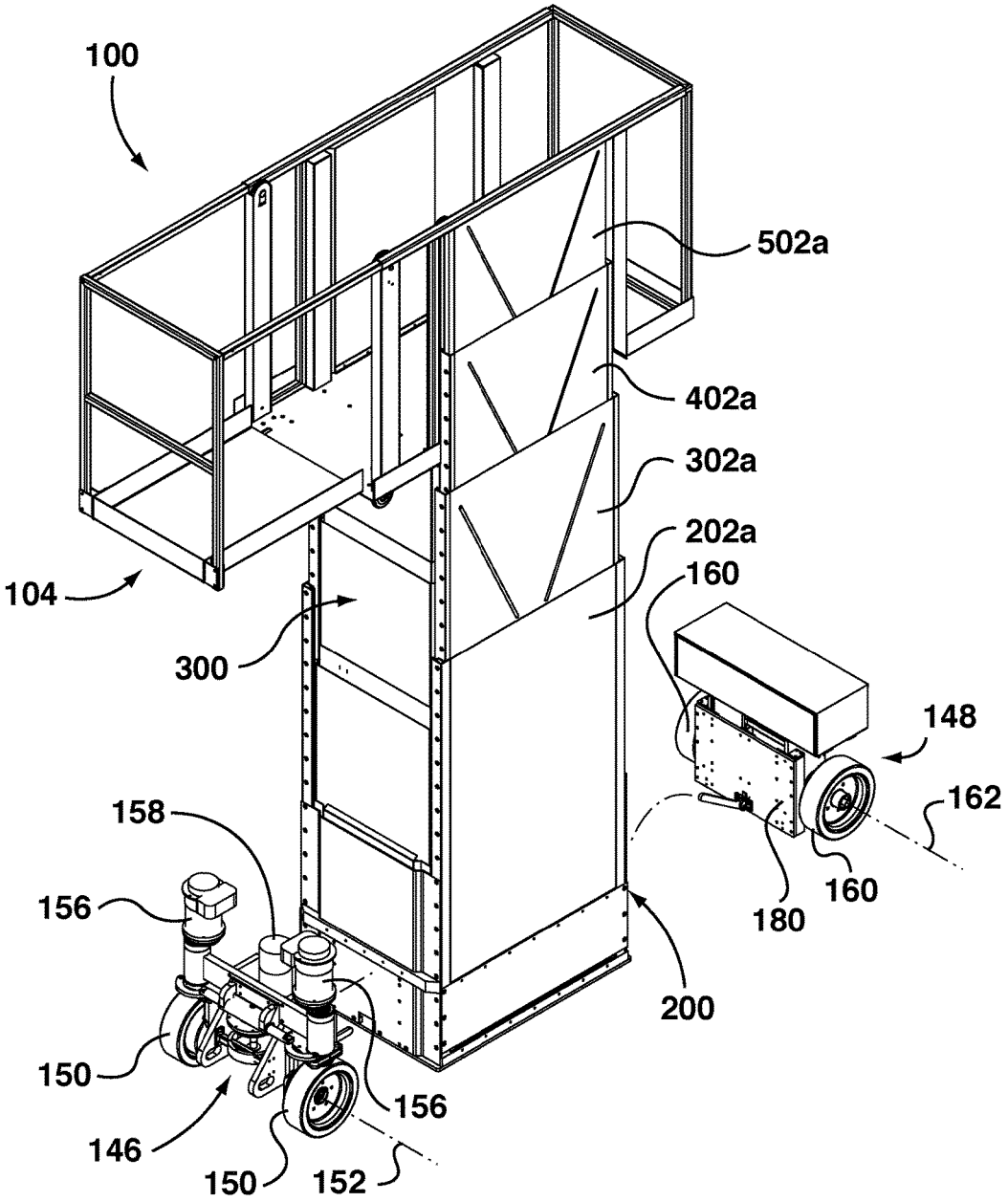
FIG. 6 is a perspective view of the lifting apparatus of FIG. 1 with the tower in a partially extended configuration and wheel assemblies detached.

Referring to FIG. 6, in the illustrated example the first intermediate tower section 300 is sized to nest within the interior 224 of the bottom tower section 200, and to fit laterally between the first and second bottom sidewalls 202*a* and 202*b*. The first intermediate tower section 300 is also vertically translatable relative to the bottom tower section 200. Referring to FIG. 17, in the illustrated example, the first intermediate tower section 300 includes a first carriage 350, which is configured to engage with and translate relative to the bottom tower section 200. Referring also to FIG. 11, the first carriage 350 can engage the first and second bottom sidewalls 202*a* and 202*b* and may help stabilize the first intermediate tower section 300 relative to the bottom tower section 200. Optionally, the carriage 350 may also be configured to provide some or all of the lifting force required to translate the first intermediate tower section 300 relative to the bottom tower section 200. The carriage 350 can also function as a base-like member that can anchor and support the weight of other portions of the first intermediate tower section 300, and the weight of the additional tower sections 400 and 500 that may be connected above the first intermediate tower section 300, along with the weight of the work platform 104 and any people or materials on the platform 104.

Referring to FIGS. 12 and 13, in the illustrated example, the first carriage 350 includes a frame that that has a first carriage first side 352*a* adjacent the first bottom sidewall 202*a* and a first carriage second side 352*b* adjacent the second bottom sidewall 202*b*. The first carriage 350 also includes a first carriage first end 354 extending between the first and second sides 352*a* and 352*b* of the first carriage 350 and a first carriage second end 356 longitudinally spaced apart from the first end 354.

Referring to FIG. 1, in the example illustrated, the first intermediate tower section 300 also includes a first section first sidewall 302*a* adjacent the first bottom sidewall 202*a* and a first section second sidewall 302*b* adjacent the second bottom sidewall 202*b*. The first intermediate tower section 300 also includes, a front face 320 having a front wall 326 and an upper portion 328 that can remain open, and a rear face 322 having a rear wall 330 and an upper portion 331 that can remain open. In the illustrated example, the first section first and second sidewalls 302*a* and 302*b*, the front wall 326 and the rear wall 330 extend from, and are supported by, the frame of the first carriage 350.

In the illustrated example, the second intermediate tower section 400 is generally similar to the first intermediate tower section 300 and is sized to fit laterally between the first and second sidewalls 302*a* and 302*b* of the first intermediate tower section. Referring to FIG. 14, the second intermediate tower section 400 includes a second carriage 450 with a frame that has a second carriage first side 452*a* adjacent the first section first sidewall 302*a*, a second carriage second side 452*b* adjacent the first section second sidewall 302*b*, a second carriage first end 454 extending between the first and second sides 452*a* and 452*b* and a second carriage second end 456 longitudinally spaced apart from the first end.

Referring to FIG. 1, the second intermediate tower section 400 also includes a second section first sidewall 402*a* adjacent the first section first sidewall 302*a* and a second section second sidewall 402*b* adjacent the first section second sidewall 302*b*. The second intermediate tower section also includes a second section front face 420 having a second section front wall 426 and a second section upper portion 428 that can remain open, and a second section rear face 422 having a second section rear wall 430 and an upper portion 431 that can remain open. In the illustrated example, the sidewalls 402*a* and 402*b*, the front wall 426 and the rear wall 430 extend from, and are supported by, the frame of the second carriage 450.

Figure 2:
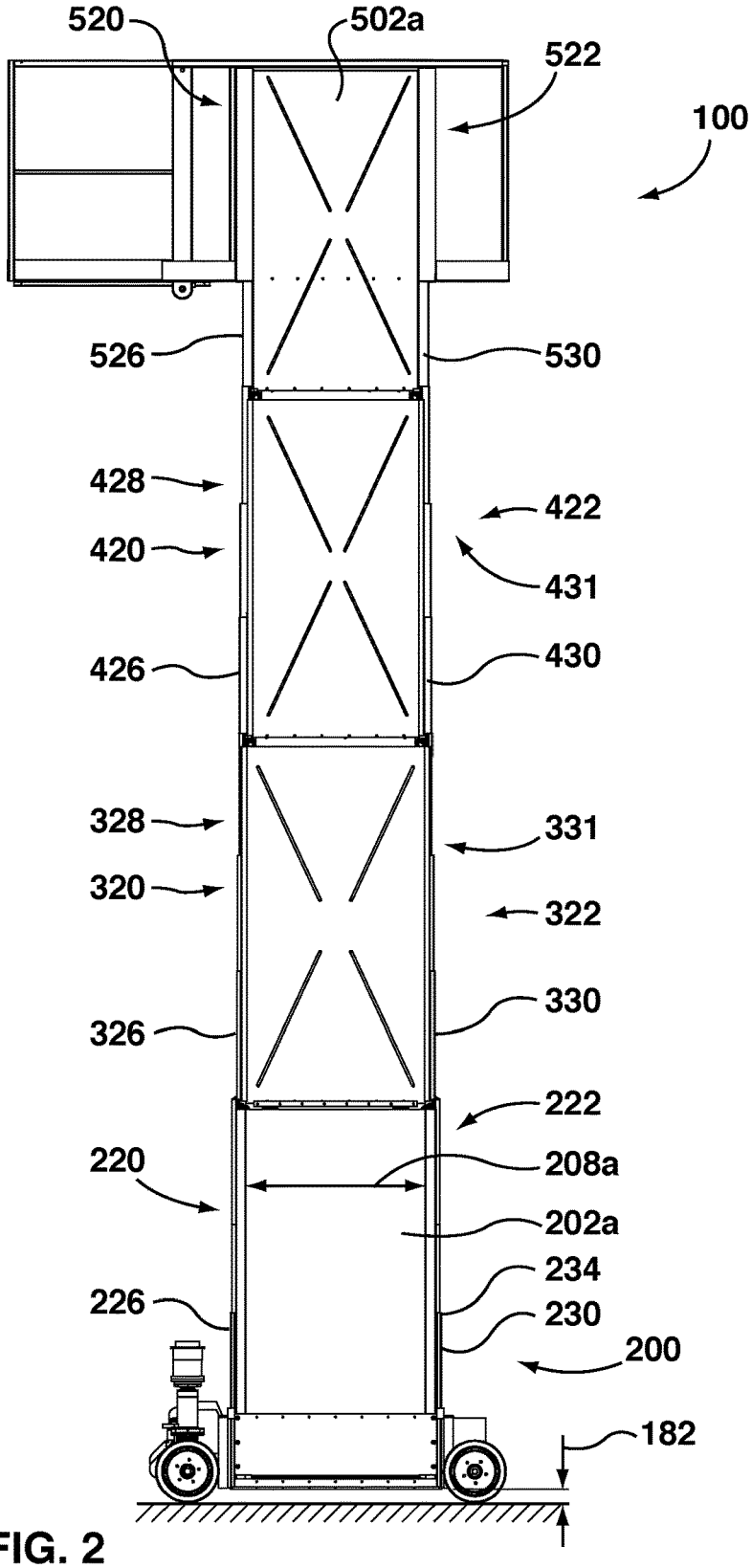
FIG. 2 is a side view of the lifting apparatus of FIG. 1.

Referring to FIG. 2, in the illustrated example, the top tower section 500 includes a top carriage 550 (FIG. 15) that is sized to fit between the respective sidewalls 202*a* and 202*b*, 302*a* and 302*b*, and 402*a* and 402*b* of the supporting tower sections 200, 300 and 400. The top carriage 550 also underlies and supports at least a portion of the weight of the work platform 104.

Referring to FIG. 15, in the illustrated example, the top carriage 550 includes a top carriage first side 552*a* adjacent the second section first sidewall 402*a*, a top carriage second side 552*b* adjacent the second section second sidewall 402*b*. The top carriage also includes a top carriage first end 554 extending between the first and second sides 552*a* and 552*b* and an opposing top carriage second end 556.

Optionally, the top tower section 500 may also include top sidewalls extending generally upwardly from the top carriage 550 and surrounding at least a portion of the work platform 104. Referring to FIG. 1, in the illustrated example, the top tower section 500 includes a first top sidewall 502*a* and an opposing second top sidewall 502*b*. The top tower section 500 also includes a top front face 520 having a top front wall 526 and an upper portion 528 that can remain open, and a rear face 522 having a rear wall 530 and an upper portion 531 that can remain open.

Referring also to FIG. 2, in the illustrated example, the tower sections 200, 300, 400 and 500 are configured so that when the tower assembly 102 is retracted, (e.g. when the top tower section 500 is in the lowered position of FIG. 3) the first intermediate tower section 300 nests substantially entirely within the bottom tower section 200, the second intermediate tower section 400 nests substantially entirely within the first intermediate tower section 300 and the top tower section 500 nests substantially entirely within the second intermediate tower section 400. See also FIG. 16 in which the tower assembly 102 is shown collapsed with the near sidewalls removed to reveal the interior of the tower assembly 102. When the tower assembly 102 is retracted in this manner, the open, upper portions (e.g. 228, 328, 428 and 528, and 231, 331, 431 and 531) in the front and rear faces of each of the tower sections 200, 300, 400 and 500 are vertically aligned with each other and the work platform 104 extends longitudinally through the open, upper portions (e.g.

228, 328, 428 and 528, and 231, 331, 431 and 531) of all the tower sections overhangs the upper edges of the respective front and rear walls (e.g. walls 226, 326, 426, and 526, and 230, 330, 430 and 530).

Referring to FIG. 16, when the tower assembly 102 is retracted, carriages 350, 450 and 550 are generally stacked upon each other, and the upper edges of each tower section 200, 300, 400 and 500 are generally aligned in a common horizontal plane that contains the upper edges 214*a* and 214*b*. To help facilitate the upper edges of each tower section to be aligned when the tower is retracted, with the carriages 350, 450 and 550 stacking within the bottom tower section 200, the tower sections 300, 400 and 500 are progressively shorter (by approximately the height of the frames) and the heights of the sidewalls on the tower sections 300, 400 and 500 (e.g. 302*a/b*, 402*a/b* and 502*a/b*) are progressively shorter than the sidewalls on its supporting tower section. Alternatively, instead of making the tower sections 200, 300, 400 and 500 different heights, the tower assembly could be configured such that the tower sections 200, 300, 400 and 500 are substantially the same height, and the upper edges of the tower sections 200, 300, 400 and 500 are vertically staggered when the tower assembly is retracted.

Referring to FIG. 3, in the illustrated example, the work platform 104 is coupled to and vertically translates with the top tower section 500 and is supported by the top carriage 550. The work platform 104 includes a generally horizontal work surface 106 and a railing 108 that generally surrounds the perimeter of the work surface 106. The railing 108 is provided with an open access region 110 toward the rear end 112 of the work platform to allow a person to enter and exit the work platform 104.

Figure 4:
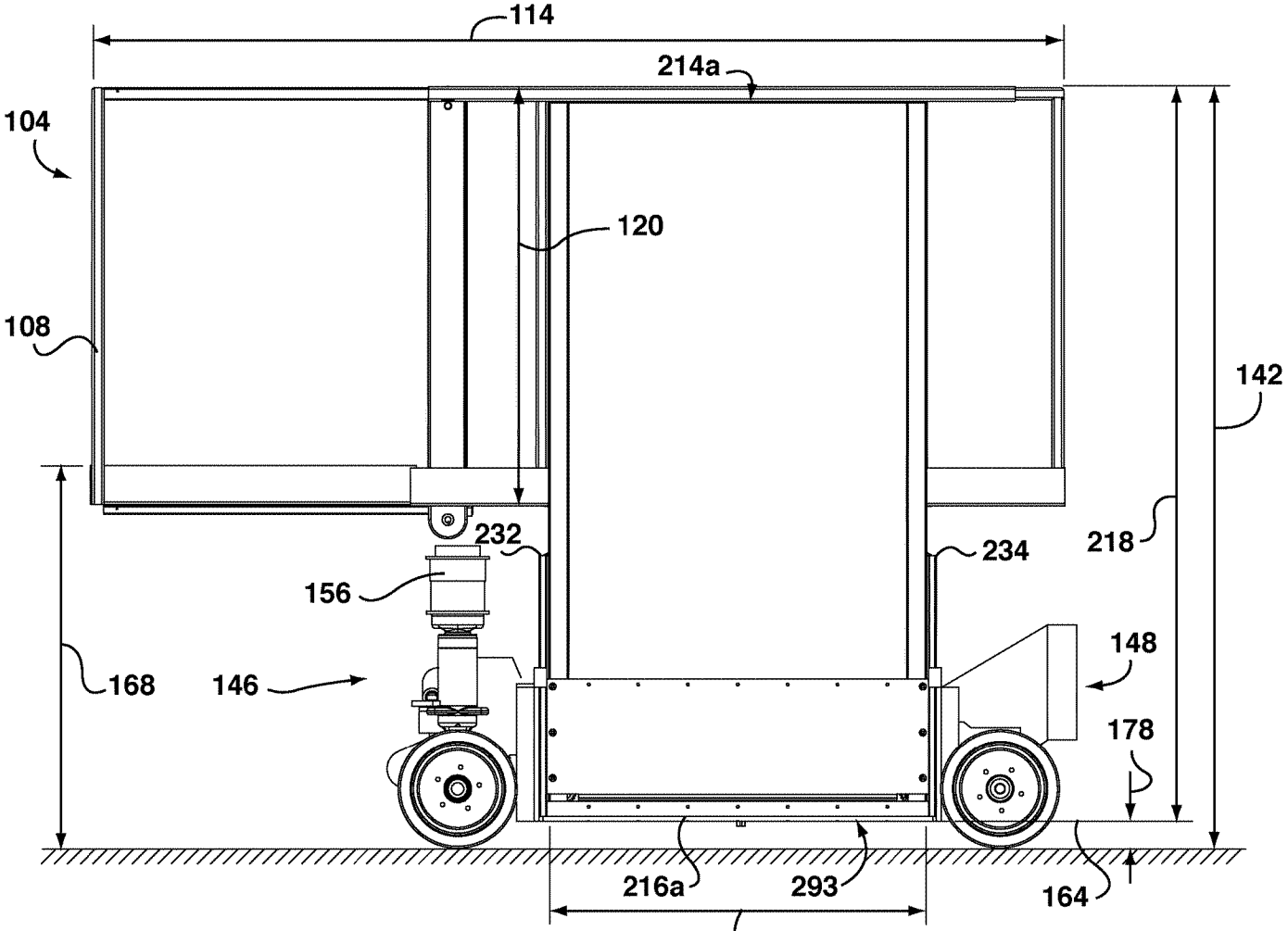
FIG. 4 is a side view of the lifting apparatus of FIG. 3.
Figure 5:
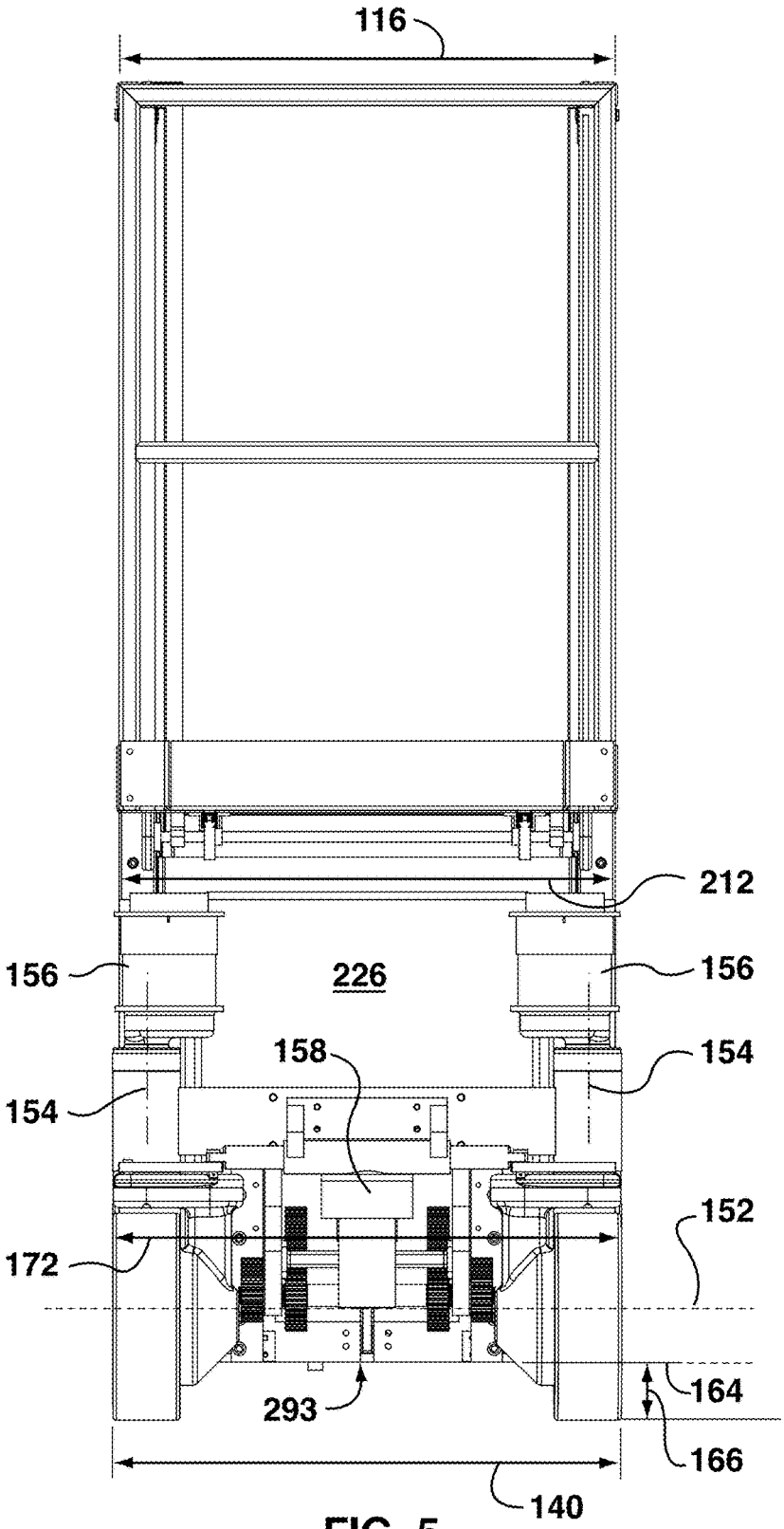
FIG. 5 is a front view of the lifting apparatus of FIG. 3.

Referring to FIG. 4, in the illustrated example the work platform 104 has an overall platform length 114 and an overall platform width 116 (FIG. 5). The overall platform length 114 may be any suitable length, including between about 30 cm and about 600 cm, and in the illustrated example is about 240 cm. The overall platform width may be any suitable width, including, for example, between about 30 cm and about 300 cm or more, and in the example illustrated is about 45 cm. Optionally, the work platform may be extendable in the longitudinal direction and the overall length 114 may be increased, for example to about 330 cm.

Figure 7:
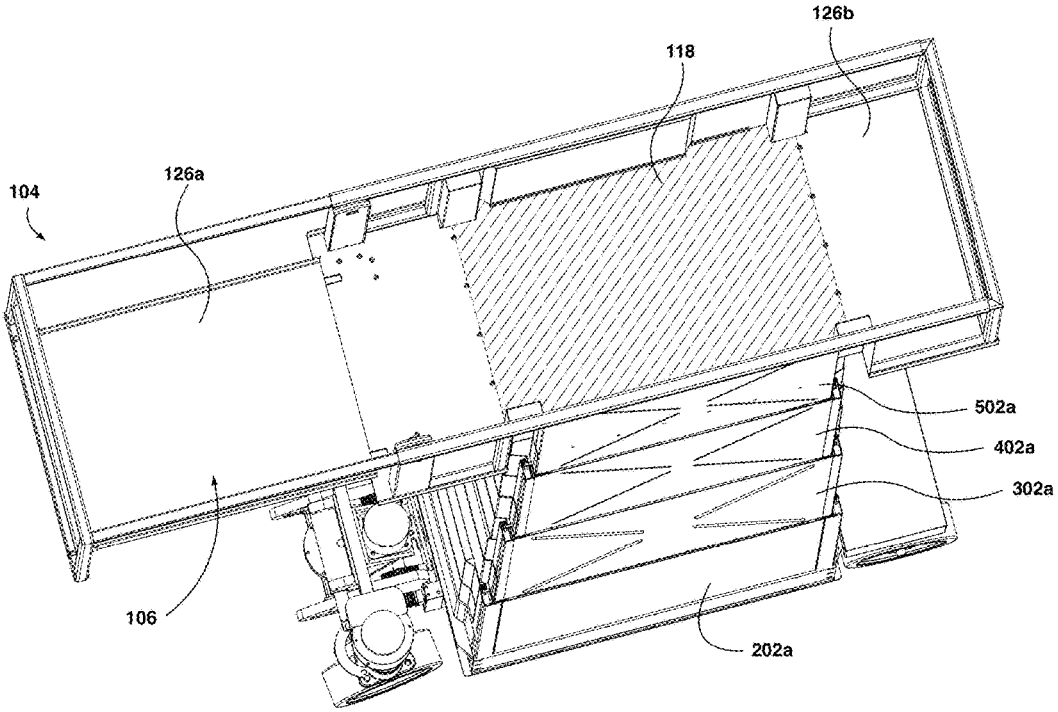
FIG. 7 is a top perspective view of the lifting apparatus of FIG. 6.

Referring to FIG. 7, in the illustrated example, the work surface 106 defines a first surface portion 118 that overlies the top carriage 550 and is sized to accommodate at least one person standing on the first surface portion. The first surface portion 118 is also sized so that when the top tower section 500 is in the lowered position the top carriage 550 and the first surface portion 118 are disposed laterally between the first and second bottom sidewalls 202*a* and 202*b* and are positioned within the interior 224 of the bottom tower section 200 (as shown in FIG. 3).

Also, in the example illustrated, when the tower assembly 102 is retracted, both the top carriage 550 and the first surface portion 118 of the work surface 106 are disposed at a lower elevation than the upper edges 214*a* and 214*b* of the sidewalls 202*a* and 202*b*. Referring to FIG. 4, in the illustrated example, when the top tower section 500 is lowered the first surface portion 118 is spaced below the upper edges 214*a* and 214*b* by an offset distance 120 that is generally equal to the height of the railing 108. In this configuration, when the tower assembly 102 is retracted the railing 108 is also partially nested within the bottom tower section 200 and the upper edge of the railing 108 is substantially flush with the upper edges 214*a* and 214*b* of the sidewalls 202*a* and 202*b*.

To fit within the interior 224 of the bottom tower section 200 the first surface portion 118 has a first surface portion length 122 that is less than the wall lengths 208*a* and 208*b*, and a first surface portion width 124 that is less than the bottom inner width 210. In the illustrated example, the first surface portion 118 is also disposed between the top sidewalls 502*a* and 502*b* and accordingly the first surface portion length 122 is substantially equal to the top sidewall lengths 508*a* and 508*b*, and the first surface portion width 124 is equal to the top tower section inner width 510. The first surface portion length 122 may be any suitable length (for example between about 30 cm and about 600 cm), and in the example illustrated is about 45 cm. The first surface portion width 124 may be any suitable width (for example between about 30 cm and about 300 cm), and in the example illustrated is about 45 cm.

As noted herein, providing front faces 220, 320, 420 and 520 of the tower sections 200, 300, 400 and 500 with upper portions that are generally free from fixed walls facilitates retraction of the work platform 104 into the interior of the tower sections in cases where the work platform has an overall work platform length 114 that is greater than the wall lengths 208*a* and 208*b* (i.e. protrudes beyond one or both ends of the tower periphery). Referring to FIG. 7, in the illustrated example, the first surface portion length 122 is less than the overall platform length 114 and the work surface 106 includes a second surface portion 126 that extends longitudinally outwardly from the first surface portion 118. This enables the area of the work surface 106 to be larger than the cross-sectional area of the bottom tower section 200. When the top tower section 500 is in the lowered position, the second surface portion 126 extends longitudinally beyond the perimeter of the bottom tower section 200 and is not disposed immediately between the first and second bottom sidewalls 202*a* and 202*b*. In the illustrated example, the second surface portion 126 extends both forwardly, region 126*a*, and rearwardly, region 126*b*, of the tower assembly 102. Alternatively, the second portion 126 need not extend in both directions and may only extend either forward or rearwardly of the tower assembly 102.

To help facilitate extension and retraction of the tower, the tower sections 300, 400 and 500 are configured to translate vertically relative to each other. In this configuration, constraining the movement for the tower sections 300, 400 and 500, so that they are permitted to translate vertically but are inhibited from tilting in at least one of the lateral and longitudinal directions, may help improve the stability of the lifting apparatus 100. For example, constraining the movement of the first intermediate tower section 300 so that all points/portions on the intermediate tower section 300 translate vertically in unison with each other may help prevent the first intermediate tower section 300 from tilting relative to the bottom tower section 200 when it is in a raised position, and optionally also while it is moving between raised and lowered positions. Providing similar constraints between the second intermediate tower section 400 and the first intermediate tower section 300, and between the top tower section 500 and the second intermediate tower section 400, may help inhibit tilting of the second intermediate tower section 400 and the top tower section 500 respectively. The combined effect of inhibiting the tilting of each vertically translatable tower section 300, 400 and 500 relative to the lower tower section within which the upper tower section translates may help increase the overall stability of the top tower section 500 when the tower assembly 102 is extended, and optionally as it is moving between the extended and retracted configurations and the top tower section 500 is moving between its lowered and raised positions.

The movement of the tower sections 300, 400 and 500 may be constrained using any suitable mechanism. Optionally, for example, the bottom tower section may include a bottom track that extends vertically and is supported by the first and second bottom sidewalls 202*a* and 202*b*. The bottom track may engage and support any other tower section that is coupled to the bottom tower section, such as the first intermediate tower section 300 in the example illustrated. The track may guide the movement of the first intermediate tower section 300 relative to the bottom tower section to facilitate vertical translation and engagement with the bottom track may constrain tilting or other types of lateral movements.

Optionally, the bottom track may include at least one bottom guide member connected to each of the first and second bottom sidewalls 202*a* and 202*b*. In this configuration, the first carriage 350 may include at least one first carriage roller engaging each bottom guide member. Optionally, two or more of the first carriage rollers can be linked together to rotate in unison with each other. Linking the first carriage rollers to rotate in unison may help inhibit the first carriage 350 from moving vertically relative to only one of the bottom sidewalls 202*a* and 202*b*. In this configuration, the first carriage roller engaging the guide member on the first bottom sidewall 202*a* is inhibited from rotating relative to its guide member unless the first carriage roller engaging the guide member on the second bottom sidewall 202*b* also rotates relative to its guide member. This may help prevent one side (or end) of the first carriage 350 from slipping vertically relative to the other side (or end) of the first carriage, which may also help inhibit tilting of the first carriage 350 (and the rest of the first intermediate tower section 300).

The first section track and the second section track may include guide members that are analogous to those in the track in the bottom tower section. In this configuration, the second carriage 450 and the top carriage 550 may include analogous second carriage rollers and top carriage rollers to engage the first section track and the second section track, respectively. For example, the first section track may include at least one first section guide member connected to each of the first section first and second sidewalls 302*a* and 302*b*, and the second carriage 450 may include at least one second carriage roller engaging each first section guide member. Each of the second carriage rollers may be linked together to rotate in unison with each other. Similarly, the second section track may include at least one second section guide member connected to each of the second section first and second sidewalls 402*a* and 402*b*, and the top carriage 550 may include at least one top carriage roller engaging each second section guide member. Each of the top carriage rollers may be linked together to rotate in unison with each other.

Configuring the tower assembly 102 to inhibit the relative tilting of each individual tower section 300, 400 and 500 may also help enable the stability of the tower to remain generally constant regardless of its degree/amount of extension. For example, the stability of the tower assembly 102 when it is partially extended (FIG. 6) may be substantially the same as the stability when the tower assembly 102 is in its maximum extension configuration (FIG. 1). In the illustrated example, when the tower assembly 102 is in its maximum extension configuration, the work surface 106 may be between about 580 cm and 670 cm above the ground.

Referring to FIG. 11, in the illustrated example, the bottom track includes first and second guide members 259 in the form of vertically extending racks 260 on the first and second bottom sidewalls 202*a* and 202*b*. In the illustrated configuration, the racks 260 are provided toward the corners of the bottom tower section 200, such that one rack 260 is disposed adjacent each of the front and rear edges of the first and second bottom sidewalls 202*a* and 202*b*.

Optionally, the first intermediate tower section 300 can be configured such that it is the first carriage 350 that engages and is constrained by the bottom track so that the first and second sides 352*a* and 352*b* of the first carriage will vertically translate substantially in unison with each other. This may help inhibit tilting of the first carriage 350, and therefore the rest of the first intermediate tower section 300 supported thereby, relative to the bottom tower section 200 in the lateral direction. The first carriage 350 may also be constrained in the longitudinal direction by the bottom track so that the first and second ends 354 and 356 will vertically translate substantially in unison with each other. This may help inhibit tilting of the first carriage 350, and therefore the rest of the first intermediate tower section 300 supported thereby, relative to the bottom tower section 200 in the longitudinal direction.

Similarly, the first intermediate tower section 300 may include a first section track to support and constrain the second intermediate tower section 400, and the second intermediate tower section 400 may include a second section track to support and constrain the top tower section 500.

In such a configuration, the second carriage 450 may be supported by and vertically translatable along the first section track and may be constrained by the first section track so that the first side 452*a*, second side 452*b*, first end 454 and second end 456 of the second carriage 450 will vertically translate substantially in unison with each other. This may help inhibit tilting of the second intermediate tower section 400 relative to the first intermediate tower section 300 in both the longitudinal direction and in the lateral direction. Similarly, the top carriage 550 may be supported by the second section track and may be vertically translatable along the second section track. The top carriage 550 may be constrained by the second section track so that the first side 552*a*, second side 552*b*, first end 554 and second end 556 of the top carriage 550 will vertically translate substantially in unison with each other. This may help inhibit tilting of the top tower section 500 relative to the second intermediate tower section 400 in the longitudinal and lateral directions.

As noted herein, optionally, each carriage 350, 450 and 550 may be provided with one or more rollers 363 for engaging an associated track. For example, the first carriage 350 may include one or more rollers to engage the bottom track. The rollers may help guide the first carriage 350 along the bottom track and may help facilitate vertical motion while helping to constrain tilting.

In the illustrated example the bottom track, first section track and second section track have generally the same configuration. The configuration of the bottom track, and its engagement with the first carriage 350 is explained in further detail herein, and the first section track and the second section track and the second carriage 450 and the top carriage 550 have analogous features and function in substantially the same manner. In the illustrated example the top tower section 500 does not include a track or guide members as it does not need to support any additional tower sections.

In the illustrated example, to engage the racks 260 in the bottom tower section 200, the rollers on the first carriage 350 are provided in the form of pinions 364 that have teeth configured to mesh with the teeth on the racks 260. Referring to FIG. 12, in the illustrated configuration the first carriage 350 includes four pinions 364 provided generally toward the corners of the first carriage 350. Each pinion 364 is aligned with one of the racks 260.

In the illustrated example, the pinions 364 located at the first end 354 of the first carriage 350 are both affixed to a common front shaft 366 so that they will rotate in unison with each other. Similarly, the pinions 364 at the second end 356 of the first carriage 350 are both affixed to a common rear shaft 368 so that they rotate in unison with each other. The first carriage 350 is also provided with a longitudinal connector member in the form of a shaft 370 that extends between, and is coupled to, the front and rear shafts 366 and 368. The longitudinal shaft 370 links the front and rear shafts 366 and 368 so that they rotate in unison with each other. The longitudinal shaft 370 is connected to the front shaft 366 via a front gear box 371, and the rear shaft 368 via a rear gear box 372. The front and rear gear boxes 371 and 372 are configured so that rotation of the longitudinal shaft 370 in a first direction, illustrated by arrow 374, causes equal, corresponding rotation of all four pinions in opposite directions, shown by arrows 376*a* and 376*b*.

With the front and rear shafts 366 and 368 connected by the longitudinal shaft 370, all of the pinions 364 on the first carriage 350 are linked to rotate in unison with each other. In this configuration, each corner of the first carriage 350 will be held in a fixed position relative to the other corners as the first carriage 350 translates along the racks 260, and engagement between the teeth on the pinions 364 and the teeth on the racks 260 will support the weight of the first intermediate tower section 300 and all the components above the first intermediate tower section 300. Alternatively, instead of a longitudinal shaft 370, the front and rear shafts 366 and 368 may be linked by another suitable mechanism that limits relative rotation between the front and rear shafts 366 and 368, including, for example, gear trains, chains and belts.

In the example illustrated, external forces urging the first carriage 350 to tilt (for example a lateral load exerted on the first intermediate tower section 300) will be resisted by engagement between the teeth of the pinions 364 and the teeth of the racks 260. For example, when the pinion teeth are meshed with the rack teeth, vertical translation of the pinions 364 relative to the racks 260 is restricted in both the up and down directions by adjacent rack teeth; relative movement is only possible by rotation of the pinions. Since any one of the pinions can only rotate if all the pinions rotate, upward forces tending to lift only the first side 352*a* of the first carriage 350, as illustrated using arrow 378*a*, will be resisted by the engagement between the pinions 364 on the first side 352*a* and the racks 260 on the first bottom sidewall 202*a*. The pinions 364 on the first side 352*a* cannot rotate, since the pinions on the second side 352*b* are, during tilting, prevented from rotating in a complementary direction as would be necessary for vertically translating the entire carriage. In fact, during tilting, the second side 352*b* will generally be subject to corresponding forces urging the second side 352*b* of the first carriage downward, shown using arrow 378*b*. Tilting the second side downward would require reverse rotation of rollers on the second side relative to those on the upwardly urged first side. Since the rollers can only rotate in unison, the downward force on the second side is resisted by the engagement between the pinions 364 on the second side 352*b* and the racks 260 on the second bottom sidewall 202*b*. With both the upward and downward forces 378*a* and 378*b* resisted, neither side of the carriage can move vertically relative to the other side, and so the first carriage 350 will resist tilting and may remain substantially horizontal. A similar result will be achieved if the first carriage 350 is subjected to an external force acting in the longitudinal direction, or forces with components acting in both the lateral and longitudinal directions.

The second carriage 450, top carriage 550, first section track and second section track include similar features identified by like reference characters incremented accordingly, and are connected in an analogous manner.

Optionally, at least a portion of each track, including, for example the guide members can be coupled to and supported by the bracing members on the tower sections. This may help provide a strong, stable support for the guide members, and may help support the weight of components that are being supported by the guide members. In the illustrated example each rack 260 is coupled to a corresponding one of the uprights 262 and extends along substantially the entire bottom tower section height 218.

Stabilizing the tower sections via the interaction between the tracks and carriages may allow the tower sections to have very little vertical overlap with each other when in the extended position, without materially reducing the stiffness and/or stability of the tower assembly 102. This is in contrast to known telescoping boom assemblies, for example, in which a relatively larger amount of overlap between sections when extended is required to provide the necessary strength and stability. Referring to FIGS. 1 and 18, in the illustrated example, when the tower assembly is extended there is very little vertical overlap between adjacent tower sections. This may help maximize the extended height of the tower assembly 102 for a given size of tower sections. As shown in FIG. 18, the vertical overlap 184 between tower sections when the tower assembly is extended is relatively small when compared to the height of the tower sections and may be less than about 15% or about 10% of the height of the associated tower section. For example, the vertical overlap 184 is about 7.5% of the height 418 of the second intermediate tower section 400. In the illustrated example, the overlap 184 is also less than twice the thickness 186 of the carriage 450 (which is about 7.5 cm in the illustrated example). The other tower sections have a similar configuration/relationship when extended.

The lifting apparatus 100 may be provided with any suitable type of elevating assembly that is operable to raise and lower the top tower section, while accommodating the engagement between the carriages and racks described herein. The elevating assembly may include a lift actuator, and optionally, the lift actuator may be an electric actuator, such as, for example, an electric motor. Optionally, the electric actuator may be the only lift actuator provided, and the elevating assembly may be free from hydraulic components (such as reservoirs, cylinders and hoses). Providing the lifting apparatus with an all-electric elevating assembly may eliminate the need to handle hydraulic fluid and may eliminate the risks of spilling or leaking hydraulic fluid. This may be advantageous if the lifting apparatus is used inside buildings and in other sensitive environments in which leaking or spilling hydraulic fluid is undesirable.

Optionally, the elevating assembly may be configured to act upon each tower section individually, or alternatively, may be configured to elevate two or more of the tower sections simultaneously. Elevating two or more tower sections simultaneously may help facilitate a relatively smoother extension of the tower assembly, as opposed to extending one tower section in its entirely, and bringing it to a stop, before elevating the next tower section.

Optionally, the elevating assembly may be a self-contained apparatus that is operable to elevate the tower sections without directly engaging other operating components of the tower, such as the rollers and guide members. Alternatively, the elevating assembly may utilize the rollers and guide members to help raise and lower the tower sections and to help stabilize the tower sections. For example, the lift actuator may be configured to drive some or all of the rollers in a tower section so that the tower section can climb the guide members in an underlying, supporting tower section. Optionally, the rollers in two or more tower sections may be linked so that they are all driven in unison and in the same direction by the lift actuator. Optionally, in addition to being driven in the same direction, the rollers may also be driven at substantially the same speed, so that the two or more tower sections are raised at substantially the same rate.

Referring to FIG. 11, in the illustrated example the elevating assembly includes a lift actuator in the form of an electric motor 128 that is configured to simultaneously drive the pinions 364, 464, and 564 on the first carriage 350, second carriage 450 and third carriage 550 respectively.

The electric motor 128 has an output shaft 130 and a drive sprocket 132 rotatable with the shaft 130. A drive chain 134*a* extends from the drive sprocket 132 to an input sprocket 136 that is provided on the first carriage 350. The input sprocket 136 (FIG. 13) is affixed to a drive shaft 380 which, via a drive gear box 382, is connected to the longitudinal shaft 370. Rotating the drive shaft 380 causes a corresponding rotation of the longitudinal shaft 370, which in turn causes corresponding rotation of the front and rear shafts 366 and 368 and the pinions 364.

Referring to FIG. 12, the drive gear box 382 includes a worm gear on the drive shaft 380 that meshes with and drives a spur gear or helical gear on the longitudinal shaft 370. The worm gear and spur gear are sized so that the gear ratio between the drive shaft 380 and the longitudinal shaft 370 is relatively high, such as for example, between about 20:1 and about 50:1, and in the illustrated example the gear ratio is about 30:1. Providing a high gear ratio may create a suitable mechanical advantage when the drive shaft 380 is driving the longitudinal shaft 370 in the first direction 374 which causes the first carriage 350 to climb the racks 260 to raise the first intermediate tower section 300. This may help translate relatively fast rotation of the drive shaft 380, as driven by the electric motor 128, into a torque on the longitudinal shaft 370 and the pinions 364 that is sufficient to lift the weight of the first intermediate tower section 300, and all other sections supported thereon. This may allow the drive chain 134*a* to be a relatively light-duty chain as it is merely transferring drive power, and is not itself lifting or supporting the weight of the first intermediate tower section 300 (or other portions of the tower).

Providing a relatively high gear ratio may also help facilitate configuring the elevating assembly as generally self-braking, as the rotational force that is required to drive the worm gear in reverse, via the spur gear, is relatively high. This mechanical disadvantage faced by the spur gear when trying to drive the worm gear and the corresponding resistance to forcing the pinions 364 to rotate in a second direction to lower the first carriage 350 along the racks 260, about 1:30 in the illustrated example, may enable the first carriage 350 to resist moving downwardly under its own weight, and/or when subjected to vertical loading.

To lower the first carriage 350, the electric motor 128 can be driven in reverse, thereby driving the worm gear, spur gear and longitudinal shaft 370 in reverse and causing the pinions 364 to climb down the racks 260. To control the speed at which the first carriage 350 climbs the racks 260, the speed of the electric motor may be varied and/or a transmission module may be used.

Referring to FIGS. 16-18, in the illustrated example, to provide drive power to the second and top carriages 450 and 550, the elevating assembly includes additional drive chains 134*b* and 134*c* extending between the first carriage 350 and second carriage 450, and the second carriage 450 and the top carriage 550 respectively. Both the second carriage 450 and the top carriage 550 include an analogous drive shaft 480 and 580 and drive gear boxes 482 and 582 coupling the drive shafts 480 and 580 to the longitudinal shafts 470 and 570, respectively.

In the illustrated example, the drive chains 134*a-c* are all linked together and are driven in unison by the electric motor 128. In this configuration, all of the carriages 350, 450 and 550 are driven upwards or downwards at the same time, and in the example illustrated, at substantially the same rate.

While illustrated using a single motor 128 and connecting chains, in other examples each tower section may be provided with a separate motor (for example an electric servo motor), and extension of the tower assembly 102 may be controlled by operating the plurality of motors together.

Referring to FIG. 3, in the illustrated example, when the tower assembly 102 is retracted the open, upper portions of the front and rear faces (i.e. the regions without fixed wall members) of the tower sections are substantially vertically registered with each other, and the work platform extends through each of the front and rear faces 220, 222, 320, 322, 420, 422, 520 and 522 and overhangs all of the front and rear walls 226, 230, 326, 330, 426, 430, 526 and 530.

When the tower assembly 102 is extended (FIG. 1) the work platform 104 will be raised out of the upper portions of the tower sections. In the absence of a cover member, when the tower assembly 102 is extended the upper portions in at least some of the tower sections may become exposed (see for example FIG. 9) and may remain open and uncovered. Having open regions which remain uncovered when the tower assembly 102 is extended may be undesirable in some applications. Optionally, instead of leaving the upper portions 228, 231, 328, 331, 428, and 431 uncovered, some or all of the bottom and intermediate tower sections 200, 300 and 400 may include suitable moveable covers (FIGS. 1 and 2), such as front and rear covers 284*a*, 284*b*, 384*a*, 384*b*, 484*a* and 484*b*, that can be deployed to cover the open, upper portions 228, 231, 328, 331, 428, and 431 when the tower assembly 102 extends.

Providing covers 284*a*, 284*b*, 384*a*, 384*b*, 484*a* and 484*b* that can be deployed to cover the upper portions 228, 231, 328, 331, 428 and 431 may help seal/enclose the interior of the tower assembly 102 when the tower assembly 102 is being extended and retracted, and when it is fully extended. Enclosing the bottom tower section 200, and some or all of the intermediate tower sections 300 and 400 if present, may help prevent objects from falling into the interior of the tower assembly 102, being caught between adjacent tower sections as the tower assembly 102 is retracted or otherwise interfering with the operation of the tower assembly 102. Optionally, the covers may be structural members with a desired tensile strength and/or stiffness. Providing structural cover members may help each tower section further resist inward and/or outward lateral deflection of its sidewalls, which may help increase the stiffness of the tower sections.

Optionally, the covers 284*a*, 284*b*, 384*a*, 384*b*, 484*a* and 484*b* may be moveably coupled to their respective tower sections 200, 300 and 400 and may be movable from a stowed position in which the covers 284*a*, 284*b*, 384*a*, 384*b*, 484*a* and 484*b* are generally clear of their respective open, upper portions, and a deployed position in which the covers 284*a*, 284*b*, 384*a*, 384*b*, 484*a* and 484*b* generally cover their respective open, upper portion.

Optionally, the cover on one tower section may be directly or indirectly coupled to an adjacent, higher tower section so that raising the adjacent higher tower section automatically moves the cover on the lower tower section toward its deployed position. For example, covers may be automatically deployed as tower assembly 102 is being extended so that open, upper portions 228, 231, 328, 331, 428 and 431 in the front and rear faces of each tower section are not left exposed because they are incrementally covered as the tower extends. When tower assembly 102 reaches its maximum extension, the covers may be fully deployed to cover substantially the entirety of the upper portions 228, 231, 328, 331, 428 and 431. When tower assembly 102 is only partially extended (FIG. 6) the vertical extent of the upper portions 228, 231, 328, 331, 428 and 431 between vertically adjacent tower sections may be less than when the tower assembly 102 is fully extended, and the covers need only be partially deployed so as to fill the relatively smaller vertical gap.

For example, in the illustrated example, the bottom covers 284*a* and 284*b* are coupled to the first intermediate tower section 300, which translates vertically when the tower is extended. As the first intermediate tower section 300 is raised relative to the bottom tower section 200 it automatically pulls the bottom covers 284*a* and 284*b* toward their deployed positions. Similarly, the first intermediate tower section covers 384*a* and 384*b* are coupled to the second intermediate tower section 400 and the second intermediate tower section covers 484*a* and 484*b* are coupled to the top tower section 500.

Referring to FIG. 8, in the illustrated example, the bottom front cover 284*a* includes a bottom first front cover panel 285*a* and a bottom second front cover panel 286*a* that are slidingly translatable within generally vertically extending bottom front channels 287*a* and 288*a* (FIG. 9*a*) in the first and second bottom sidewalls 202*a* and 202*b*. The bottom front channels 287*a* and 288*a* are provided with multiple abutment surfaces that help retain the front cover panels 285*a* and 286*a* within the bottom front channels 287*a* and 288*a* and help inhibit lateral translation of the panels 285*a* and 268*a* relative to the first and second bottom sidewalls 202*a* and 202*b*. In the illustrated example, the first and second front cover panels 285*a* and 286*a* are formed from 9 gauge sheet steel. In this configuration, because lateral movement of the first and second front cover panels 285*a* and 286*a* relative to the channels 287*a* and 288*a* is restricted in both directions (i.e. to the left and right as illustrated in FIG. 9*a*), the front cover panels 285*a* and 286*a* may help the first and second bottom sidewalls 202*a* and 202*b* resist both inward and outward lateral deflection and may help increase the stiffness of the bottom tower section 200.

In the illustrated example, the first and second bottom front cover panels 285*a* and 286*a* are vertically translatable relative to each other and to the first and second bottom sidewalls 202*a* and 202*b* between a respective lowered position (FIG. 9), corresponding to the stowed position, in which the panels 285*a* and 286*a* are generally horizontally stacked or overlapped with the bottom front wall 226, and a respective raised position, corresponding to the first deployed position (FIG. 8), in which the first and second front cover panels 285*a* and 286*a* are displaced vertically upward and are stacked to cover the open, upper portion 228.

The first and second front cover panels 285*a* and 286*a* are sized so that the combined heights of the first and second front cover panels 285*a* and 286*a* is generally equal to the height of the open, upper portion 228 in the front face. In the illustrated example, the first and second front cover panels 285*a* and 286*a* are generally the same height as each other, and as the bottom front wall 226 (each approximately a third of the height of the bottom sidewalls 202*a* and 202*b*). When tower assembly 102 is only partially raised, the first and second front cover panels 285*a* and 286*a* may vertically overlap each other and/or the bottom front wall 226 (FIG. 10) so that the total exposed height of the first and second front cover panels 285*a* and 286*a* and the bottom front wall 226 is less than the height of the bottom sidewalls 202*a* and 202*b*.

In the illustrated example, the bottom rear cover 284*b* is generally identical to the bottom front cover 284*a*, and includes corresponding first and second rear cover panels 285*b* and 286*b* that can slide in respective channels provided at the rear edges of the first and second bottom sidewalls 202*a* and 202*b* in an analogous manner. The first and second intermediate tower sections 300 and 400 also have similar front and rear covers, with vertically translating cover panels, which are identified by like reference characters, incremented accordingly.

Referring to FIG. 9, in the illustrated example the second front cover panel 286*a* and the second rear cover panel 286*b* are each provided with a longitudinally extending first panel catch portion 289*a* and 289*b*, respectively, and the first carriage 350 is provided with complementary front and back carriage catch portions. When the first carriage 350 is raised relative to the bottom tower section 200, the carriage catch portions contact the first panel catch portions 289*a* and 289*b*, thereby lifting the second front and rear cover panels 286*a* and 286*b* upwardly with the first carriage 350. As the first carriage 350 continues to rise, lower catch portions 291*a* and 291*b* (291*a* shown in phantom in FIG. 10) on the cover panels 286*a* and 286*b* engage corresponding second panel catch portions 292*a* and 292*b* (292*a* shown in FIG. 10) on the first front and rear cover panels 285*a* and 285*b*, respectively, thereby pulling the second front and rear cover panels 285*a* and 285*b* into position. When the first carriage 350 is lowered relative to the bottom tower section 200, the carriage catch portions can disengage the first panel catch portions 289*a* and 289*b* and the first and second front and rear cover panels 285*a*, 285*b*, 286*a* and 286*b* can return to their lowered positions under the influence of gravity.

Optionally, the lifting apparatus 100 may be configured as a slab machine designed to roll across generally smooth surfaces, such as floors and paved surfaces, and to fit through a standard internal/interior doorway. Configuring the apparatus 100 to fit through a standard doorway may help facilitate use of the lifting apparatus 100 inside buildings and to be moved from one room to another room without requiring significant modification to the building.

Referring to FIG. 5, in the illustrated example the lifting apparatus 100 is a slab machine and has an overall apparatus width 140 in the lateral direction. The overall apparatus width 140 may be any suitable width that can fit through a standard door, and in the example illustrated is about 81 cm. The lifting apparatus 100 also has an overall apparatus retracted height 142 in the vertical direction, which is measured when the tower assembly 102 is retracted (FIG. 4). The overall apparatus retracted height 142 may be any height that allows the lifting apparatus 100 to fit through a standard doorway, and in the example illustrated is about 205 cm.

In the example illustrated, the tower outer width 212 is about 81 cm which is about equal to the overall apparatus width 140, and the bottom tower section height 218 may be at least 80% of the overall apparatus retracted height 142, and in the illustrated example is about 195 cm which is about 95% of the apparatus retracted height 142. This may allow the bottom tower section 200 to extend substantially the overall apparatus width 140, and a majority of the overall apparatus retracted height 142 of the lifting apparatus 100. Providing a relatively wide bottom tower section 200, and subsequent tower sections mounted thereto, may help stiffen the tower assembly 102. Providing a relatively tall bottom tower section 200 may help facilitate extending the work platform 104 to a relatively higher height, as compared to a lifting apparatus with a relatively shorter bottom tower section.

Referring to FIG. 6, the lifting apparatus includes first and second wheel assemblies 146 and 148 (shown detached from the tower assembly 102 for clarity in FIG. 6) for rollingly engaging a surface and supporting the tower assembly 102 above the surface. In the illustrated example, the first wheel assembly 146 is connected to the front face 220 of the bottom tower section 200 and the second wheel assembly 148 is connected to the rear face 222 of the bottom tower section 200. In this configuration, a lower portion of the bottom tower section 200 is disposed horizontally between the first and second wheel assemblies 146 and 148 (in the longitudinal direction as illustrated).

Optionally, one or both of the wheel assemblies can be provided with steerable wheels. In the illustrated example, the first wheel assembly 146 includes two steerable wheels 150. Each wheel 150 is rotatable about a rotation axis 152 and can be steered by pivoting about respective pivot axes 154. In the illustrated example, the first wheel assembly 146 includes electric steering motors 156 to steer the wheels 150, and an electric propulsion motor 158 to drive rotation of the wheels 150 (see also FIG. 5).

The second wheel assembly 148 also includes two wheels 160 which are rotatable about a horizontal rotation axis 162. In the illustrated example, the wheels 160 are not steerable.

Referring to FIG. 4, in the illustrated example the axes 152 and 162 are generally at the same elevation and a horizontal plane 164 containing the bottom face 293 of the bottom tower section 200 is at a lower elevation than the rotation axes 152 and 162. In this configuration, the bottom face 293 of the bottom tower section 200 is relatively close to the surface, and in the example illustrated is less than about 10 cm above the surface (see height 166). In the illustrated example the racks 260 attached to the bottom tower section 200 extend substantially the entire height of the bottom tower section 200. In this configuration, the lower ends of the racks 260 are adjacent the bottom face 293 of the bottom tower section 200 and are also disposed at an elevation below the rotation axes 152 and 162.

Positioning the bottom face 293 of the bottom tower section at a relatively low elevation may help facilitate positioning other components of the lifting apparatus 100 at relatively low elevations. For example, referring to FIG. 16, in the illustrated example when the first intermediate tower section 300 is retracted within the bottom tower section 200, the first carriage 350 may be relatively close to the surface, and in the example illustrated is at a height 174 above the surface, which in the illustrated example is about 60 cm. Also, in the illustrated example, when the top tower section 500 is in its lowered position (FIG. 4) the work surface 106 is positioned at an elevation of about 100 cm above the surface. Providing the work surface 106 at about 100 cm, or less than 100 cm, above the surface may help reduce the entry height 168 of the work platform 104.

Referring to FIG. 4, in the illustrated example the second wheel assembly 148 is horizontally spaced apart from the first wheel assembly 146 by a wheel spacing distance 170 that is generally equal to the wall lengths 208*a* and 208*b*. Referring to FIG. 5, the wheel assemblies 146 and 148 have generally equal wheel assembly widths 172, which, in the example illustrated, are generally equal to the tower outer width 212.

Optionally, the first and second wheel assemblies 146 and 148 may be adjustable to raise and lower the tower assembly 102 relative to the surface (i.e. to change the height 178 between the bottom face 293 and the surface). In the illustrated example, each wheel assembly 146 and 148 includes a mounting plate 180 for attaching to the bottom tower section 200 (FIGS. 6 and 19). The mounting plates 180 can vertically translate relative to the wheels 150 and 160, and can be driven using any suitable mechanism. When the mounting plates 180 are raised, the distance between the bottom face 293 and the surface increases. When the mounting plates are lowered, the distance between the bottom face 293 and the surface decreases.

The mounting plates 180 can be moved to a variety of different positions. In the example illustrated, three different positions for the mounting plates 180 are shown in FIG. 19, the lowermost position being shown in solid lines, and two raised positions being shown in phantom.

For example, the first and second wheel assemblies can be adjusted to support the tower assembly at a travelling height 178 when the tower assembly is retracted (FIGS. 4 and 19) and the lifting apparatus 100 is propelling itself across the surface, or onto and off of a truck or other transport means. In the illustrated example, the travelling height 178 is about 6.4 cm.

The wheel assemblies 146 and 148 can then be lowered to support the tower assembly 102 at a lower, extension height 182 when the tower assembly 102 is at least partially extended (FIGS. 1 and 19). This may help provide some degree of pot hole protection as the entire bottom face 293 of the bottom tower section 200 can be lowered to be proximate the surface. For example, in the illustrated example the wheel assemblies 146 and 148 can be adjusted so that when the tower assembly 102 is at least partially extended the bottom face 293 of the bottom tower section is less than about 5 cm above the surface, and optionally is within about 1.3 cm of the surface. In this configuration, if one or more of the wheels 150, 160 were to roll into a pot hole, off a loading dock, etc. the bottom tower section 200 would only fall about 2.5 cm before the bottom face 293 of the bottom tower section 200 would contact the surface to stabilize the tower assembly 102.

Optionally, the wheel assemblies 146 and 148 may also be adjustable to lower the tower assembly 102 to a lowered, transport position (FIGS. 19 and 20) in which the bottom face 293 of the bottom tower section 200 is resting upon the surface. In this configuration, at least a portion of the weight of the tower assembly 102 can be transferred to the surface directly by the bottom tower section 200, instead of via the wheel assemblies 146 and 148. This configuration may be useful when the lifting apparatus 100 is being secured to a truck bed or other vehicle for transportation.

For example, to help secure the lifting apparatus 100 to a truck bed during transport the lifting apparatus 100 may be tied down or secured to the bed using tie downs, including for example, straps or chains. Such tie downs can exert significant downward forces on the lifting apparatus 100. By lowering the bottom face 293 to a position where it rests on the truck bed, at least a portion of these tie down forces can be carried by the bottom tower section, instead of via the wheel assemblies 146 and 148. This may reduce the wear on the bearings and other load bearing components of the wheel assemblies 146 and 148.

While illustrated as being attached to the front and rear faces of the bottom tower section, the first and second wheel assemblies may alternatively be connected to the first and second bottom sidewalls.

While the lifting apparatus 100 includes two intermediate tower sections between the bottom and top tower sections (for a total of four tower sections), in other examples a lifting apparatus may optionally include only one intermediate tower section, more than two intermediate tower sections or no intermediate tower section (i.e. the top tower section may be directly connected to the bottom tower section).

Optionally one or more portions of the top tower section may be integrated with the work platform. For example, the top carriage may be integrated with the work platform and may be positioned generally adjacent the lower side of the work surface.

Referring to FIGS. 21 and 22, a schematic illustration of another example of a bottom track having guide members 1259 and corresponding carriage 1350 is shown. The guide members 1259 and carriage 1350 are generally similar to guide members 259 and carriage 350 described herein, and like features are identified by like reference characters, incremented by 1000.

In this example, the guide members are provided in the form of generally vertically extending chains 1260 that are attached to the supporting tower section, for example to a bottom sidewall 1202*a*. The chains 1260 may be any suitable type of chain, and in the illustrated example are roller chains. The chains 1260 are anchored to the bottom sidewall 1202*a* at their top ends, and may also be anchored at their bottom ends and at one or more locations along their length. Like the racks 260, the chains 1260 extend substantially the entire height of the bottom sidewall 1202*a*.

In this example, the carriage 1350 is provided with rollers 1363 in the form of sprockets 1364 that are configured to engage the chains 1260. The sprockets 1364 at the first end 1354 of the carriage 1350 are affixed to a common front shaft 1366 so that they rotate in unison, and cannot rotate relative to each other. Similarly, the sprockets 1364 at the second end 1356 of the carriage 1350 are affixed to a common rear 1368 shaft to rotate in unison with each other.

To help the front and rear shafts 1366 and 1368 to rotate in unison, so that one cannot rotate relative to the other, in the illustrated example the carriage 1350 utilizes a longitudinal connector in the form of a transfer chain assembly 1371 to synchronize rotation of the front and rear shafts 1366 and 1368, instead of the longitudinal shaft 370.

Referring to FIG. 23, a schematic representation of another carriage 2350 and guide member in the form of a chain 2260 is shown. The guide members and carriage 2350 are similar to guide members and carriage 350, and like features are identified by like reference characters, incremented by 2000. In this example, the chain 2260 is configured to wrap partially around the sprocket 2364 and is guided by a pair of idling sprockets 2365. Wrapping the chain 2260 partially around the sprocket 2364 may help prevent skipping or slipping of the sprocket 2364 relative to the chain 2260.

Referring to FIG. 24, a schematic representation of another carriage 3350 and guide member in the form of a timing belt 3260 is shown. The guide member and carriage 3350 are generally similar to guide members and carriage 350 described herein, and like features are identified using like reference characters incremented by 3000. In this example, the guide member is provided as a timing belt 3260 and the roller is provided as a toothed wheel 3364 configured to mesh with the timing belt 3260. In the configuration illustrated, the timing belt 3260 is partially wrapped around the wheel 3364 and guided by idling wheels 3365 to help limit skipping and/or slippage of the wheel 3364 relative to the timing belt 3260 when loaded.

Referring to FIG. 25, another example of a mobile lifting apparatus 5100 includes a tower assembly 5102 having a bottom tower section 5200, a top tower section (nested within the bottom tower section 5200—See FIG. 26), and a work platform 5104 supported by the top tower section. The mobile lifting apparatus 5100 is generally similar to mobile lifting apparatus 100, and like features are identified by like reference characters incremented by 5000.

In the illustrated example the bottom tower section 5200 includes a first bottom sidewall 5202*a* and an opposing second bottom sidewall 5202*b* (FIG. 26) that is horizontally spaced apart from the first bottom sidewall 5202*a*. The first bottom sidewall 5202*a* has a first wall length 5208*a* that extends in the longitudinal direction. The second bottom sidewall 5202*b* has a corresponding second wall length. The first bottom sidewall 5202*a* extends vertically between an upper edge 5214*a* and lower edge 5216*a* to define a bottom tower section height 5218. The second bottom sidewall 5202*b* has an analogous configuration.

Referring to FIG. 27, the mobile lifting apparatus 5100 is shown with the tower assembly 5102 retracted and with the near sidewalls removed to reveal the interior of the tower assembly 5102. In the illustrated example, mobile lifting apparatus 5100 includes a bottom tower section 5200, a first intermediate tower section 5300, a second intermediate tower section 5400 and a top tower section 5500.

Referring also to FIG. 29, the first intermediate tower section 5300 is supported on a first (intermediate) carriage 5350, which engages the racks 5260 on the bottom tower section 5200. Similarly, the second intermediate tower section 5400 is support on a second (intermediate) carriage 5450 that engages racks 5360 on the first intermediate tower section, and the top tower section 5500 (not shown in FIG. 29) is supported on a third (top) carriage 5550 that engages racks 5460 on the second intermediate tower section 5400. In this example, the carriages 5350, 5450 and 5550 are provided with a plurality of rollers for engaging their associated racks.

Referring to FIG. 31, in the illustrated example, to engage the racks 5260 in the bottom tower section 5200, the rollers on the first carriage 5350 are provided in the form of pinions 5364 that have teeth configured to mesh with the teeth on the racks 5260. In the illustrated configuration the first carriage 5350 includes four pinions 5364 provided generally toward the corners of the first carriage 5350. Each pinion 5364 is aligned with one of the racks 5260.

In the illustrated example, the pinions 5364 located at the first end 5354 of the first carriage 5350 are both affixed to a common front shaft 5366 so that they will rotate in unison with each other. Similarly, the pinions 5364 at the second end 5356 of the first carriage 5350 are both affixed to a common rear shaft 5368 so that they rotate in unison with each other. The first carriage 5350 is also provided with a longitudinal connector member in the form of a shaft 5370 that extends between, and is coupled to, the front and rear shafts 5366 and 5368. The longitudinal shaft 5370 links the front and rear shafts 5366 and 5368 so that they rotate in unison with each other. The longitudinal shaft 5370 is connected to the front shaft 5366 via a front gear box 5371, and the rear shaft 5368 via a rear gear box 5372. The front and rear gear boxes 5371 and 5372 are configured so that rotation of the longitudinal shaft 5370 in a first direction, represented by arrow 5374, causes equal, corresponding rotation of all four pinions in opposite directions. In the example illustrated, upon rotation of the synchronizing shaft 5370 in the direction of arrow 5374, the two pinions 5364 attached to the front shaft 5366 rotate in a clockwise direction (arrow 5376*a*—as viewed from side 5352*a*), and the two pinions 5364 attached to the rear shaft 5368 rotate in the counterclockwise direction (arrow 5376*b*—as viewed from side 5352*a*), shown by arrows 5376*a* and 5376*b*.

With the front and rear shafts 5366 and 5368 connected by the longitudinal shaft 5370, all of the pinions 5364 on the first carriage 5350 are linked to rotate in unison with each other. In this configuration, each corner of the first carriage 5350 will be held in a fixed position relative to the other corners as the first carriage 5350 translates along the racks 5260, and engagement between the teeth on the pinions 5364 and the teeth on the racks 5260 will support the weight of the first intermediate tower section 5300 and all the components above the first intermediate tower section 5300.

If external forces urging the first carriage 5350 to tilt are applied to the first intermediate tower section 5300 (for example a lateral load exerted on the first intermediate tower section), such forces will be resisted by engagement between the teeth of the pinions 5364 and the teeth of the racks 5260. A similar result will be achieved if the first carriage 5350 is subjected to an external force acting in the longitudinal direction or forces with components acting in both the lateral and longitudinal directions.

The second carriage 5450 and third carriage 5550 include similar features as the first carriage, identified by like reference characters indexed accordingly (see FIGS. 34-37), and are connected in a similar manner. While only the first carriage 5350 is described in detail, it is understood that the other carriages 5450 and 5550 can include the same features and can function in the same manner.

Referring to FIG. 29, in the illustrated example, the mobile lifting apparatus 5100 includes an elevating assembly to raise and lower the first intermediate tower section 5300, second intermediate tower section 5400 and the top tower section 5500 relative to the bottom tower section 5200 so that the tower assembly 5102 can be moved between extended and retracted configurations.

In the illustrated example, the elevating assembly includes a lift actuator that includes three electric motors 5128*a*, 5128*b* and 5128*c*. In this example, instead of a single motor 128 in the bottom tower section 200 and drive chains extending between the carriages 350, 450 and 550 (as provided in the mobile lifting apparatus 100), each carriage 5350, 5450 and 5550 is provided with its own electric motor. The motors 5128*a*, 5128*b* and 5128*c* can be controlled using any suitable controller, and may be configured so that they are operable in unison (so that all of the carriages 5350, 5450 and 5550 are moved in unison) or so that one or more of the motors 5128*a*, 5128*b* and 5128*c* may be operated independently of the other motors. Providing individually operable motors may allow a user to move a particular carriage, such as the first carriage 5350 or the third carriage 5550, without having to move the other carriages. This may help increase the versatility of the mobile lifting apparatus 5100 by helping to facilitate independent positioning of each tower section, and may eliminate the need to lift the weight of the lower tower sections if only the top tower section need be extended. Alternatively, configuring the motors to be controlled in unison may allow the tower assembly 5102 to extend and retract in a generally uniform manner.

Referring to FIG. 32, in the illustrated example motor 5128*a* is mounted on the first carriage 5350, and can translate vertically along with the first carriage 5350 relative to the bottom tower section 5200, as shown in FIG. 30. Referring also to FIG. 33, which shows the first carriage 5350 with covers removed, a transmission, in the form of a planetary gear box 5386 connects an output shaft 5388 of the electric motor 5128*a* with the longitudinal shaft 5370 on the first carriage 5350. This configuration allows the motor 5128*a* to drive the shaft 5370, and thereby drive the connected shafts 5366 and 5368 and pinions 5364. Optionally, the motor 5128*a* can be configured so that it can be driven in two different directions, one direction causing the carriage 5350 to ascend the racks 5260 and raise the first intermediate tower section 5300, and an opposite direction causing the carriage 5350 to descend the racks 5260 and lower the first intermediate tower section 5300. Alternatively, the motor 5128*a* need only drive the carriage 5350 in one direction (e.g. upwards) and an alternative motive force (such as the force of gravity) may be used to move the carriage in the other direction (i.e. downwards).

The motor 5128*a* (and optionally motors 5128*b* and 5128*c*) can be provided with a braking mechanism that can be activated to impede and/or prevent rotation of the shaft 5388. In the illustrated configuration, preventing rotation of the shaft 5388 can also prevent rotation of the shafts 5366, 5368, 5370 and pinions 5364, thereby holding the first carriage 5350 in a fixed position relative to the racks 5260. This may allow the motor braking mechanism to be used as a carriage braking mechanism to help prevent unwanted movement of the first carriage 5350 (and analogously of the other carriages 5450 and 5550). Alternatively, or in addition to a braking mechanism associated with the motor, one or more of the gearbox 5386, shafts 5366, 5368 and 5370, gearboxes 5371 and 5372 or other suitable component may be provided with a braking mechanism.

The motor 5128*a* can be controlled using any suitable type of controller apparatus. Optionally, the controller apparatus may be a single controller that is connected to each of the motors 5128*a*, 5128*b* and 5128*c* using wires or other suitable connectors. Alternatively, the controller apparatus may include more than one controller. For example, the controller apparatus may include one controller per motor. Referring to FIG. 32, in the illustrated example, the controller apparatus for controlling the motors 5128*a*, 5128*b* and 5128*c* includes a respective motor controller 5390, 5490 and 5590 associated with each motor. Each controller 5390, 5490 and 5590 is mounted on the same carriage as the motor it is controlling and can be communicably linked to its motor using any suitable connector (such as a wire). Specifically, motor 5128*a* and controller 5390 are each mounted on, and move with, the first carriage 5350 (FIG. 32), the motor 5128*b* and controller 5490 are each mounted on, and move with, the second carriage 5450 (FIG. 35) and the motor 5128*c* and controller 5590 are each mounted on, and move with, the third carriage 5550 (FIG. 37).

Optionally, the controllers 5390, 5490 and 5590 can be communicably linked together so that they can operate in concert which can help provide coordinated movement of the carriages 5350, 5450 and 5550 in a desired manner, such as, for example so that the carriages 5350, 5450 and 5550 can move in unison. The controllers 5390, 5490 and 5590 can be linked using any suitable communication link, such as a wire and/or a wireless communication system.

Referring to FIG. 29, in the illustrated example, controllers 5390, 5490 and 5590 are communicably linked together using a cable track apparatus 5188 that contains a suitable number of communication and/or power transmission wires. The cable track apparatus 5188 also includes cables to provide power to the controllers 5390, 5490 and 5590 and motors 5128*a*, 5128*b* and 5128*c*. In the illustrated example, the cable track apparatus includes three track sections 5188*a*, 5188*b* and 5188*c* that are connected in series (i.e. in a daisy chain type configuration) to provide communication and electrical power transmission between the carriages 5350, 5450 and 5550. In this configuration, the lower track section 5188*a* extends between the bottom tower section 5200 and the first carriage 5350, the middle track section 5188*b* extends between the first carriage 5350 and the second carriage 5450, and the upper track section 5188*c* extends between the second carriage 5450 and the third carriage 5550. Providing multiple cable track sections 5188*a-c* in series may facilitate communication and power transfer between all of the controllers 5390, 5490 and 5590 and motors 5128*a*, 5128*b* and 5128*c*, while eliminating the need to run longer cables directly from the bottom tower section 5200 to the second carriage 5450 and/or third carriage 5550. This may help reduce the length of cable required to connect the controllers 5390, 5490 and 5590 and motors 5128*a*, 5128*b* and 5128*c*, and may help simplify the cable configuration.

Referring to FIGS. 27 and 28, when the tower assembly 5102 is retracted the carriages 5350, 5450 and 5550 are generally stacked upon each other, and the upper edges of each tower section 5200, 5300, 5400 and 5500 are generally aligned in a common horizontal plane that contains the upper edges 5214*a* and 5214*b*. Stacking the carriages 5350, 5450 and 5550 may help minimize the overall retracted size of the mobile lifting apparatus 5100.

Referring to FIG. 30, in the illustrated example, the motor 5128*a* has a height 5192*a* that is greater than a height 5392 of the first carriage 5350. In this configuration, portions of the motor 5128*a* protrude above the upper surface of the first carriage 5350. Similarly, the motor 5128*b* has a height 5192*b* that is greater than the height 5492 of the second carriage 5450. However, instead of protruding significantly above the second carriage 5450, the motor 5128*b* is mounted so that it extends below the second carriage 5450, between the first and second carriages 5350 and 5450 when in the positions illustrated. To help facilitate the stacking of the carriages 5350 and 5450 as shown in FIG. 28, the carriages 5350 and 5450 are provided with respective recesses 5394 (FIG. 32) and 5495 (FIG. 35).

The recess 5394 is generally registered beneath the motor 5128*b* on the second carriage 5450 and is sized to receive at least a portion of the motor 5128*b* when the tower assembly 5102 is retracted. Similarly, the recess 5494 is generally registered above the motor 5128*a* and is sized to receive at least a portion of the motor 5128*a* when the tower assembly 5102 is retracted. In this configuration, when the second carriage 5450 approaches the first carriage 5350, portions of the motor 5128*b* that extend below the second carriage 5450 can be received within the recess 5394 so that the motor 5128*b* is partially nested within the first carriage 5350, and portions of the motor 5128*a* that extend above the first carriage 5350 are received within the recess 5494 so that the motor 5128*a* is partially nested within the second carriage 5450. This arrangement may help facilitate the stacking of the carriages 5350 and 5450 and provide a reduced height when stacked. In the illustrated example, the recesses 5394 and 5494 also receive portions of the cable track apparatus when the carriages 5350, 5450 and 5550 are stacked.

While illustrated as through-holes in the carriages 5350 and 5450, the recesses 5394 and 5495 need not be configured as through holes. Instead, the recesses may be formed as cavities or chambers that are sized to accommodate portions of the motors 5128*b* and 5128*a*, but do not extend all the way through the carriages 5350 and 5450.

Referring to FIG. 36, in the illustrated example, the motor 5128*c* and the gearbox 5586 are mounted in such a way that neither the motor 5128*c* nor the gearbox 5586 extend below the carriage 5550. In this example, the motor 5128*c* has a height 5192*c* (FIG. 30) that is greater than the carriage height 5592, and the motor 5158*c* is mounted substantially above the carriage 5550, and in the headspace region between the upper side of the carriage 5550 and the work platform 5104. Referring to FIG. 28, in this configuration when the third carriage 5550 is lowered toward the second carriage 5450 the motor 5128*c* is not positioned between the carriages 5550 and 5450, and will not interfere with the stacking of the carriages 5550 and 5450. The carriage 5550 is provided with recess 5594 which can accommodate upstanding portions of the cable track apparatus, but the recess 5594 need not be sized to accommodate a portion of a motor. This configuration can allow the carriages 5350, 5450 and 5550 to be stacked relatively closely together in the vertical direction, and optionally the carriages 5350, 5450 and 5550 can be placed in close vertical proximity with each other, or placed in physical contact with each other. For example, a downward facing surface of the carriage 5450 (such as the bottom edges of the frame members supporting the shafts 5466, 5468, 5470 and the motor 5128*b*) can be configured to be adjacent and/or rest upon an upward facing surface of the carriage 5350 (such as the top surfaces of the frame members supporting the shafts 5366, 5368, 5370 and the motor 5128*a*) when the carriages 5350 and 5450 are lowered into the retracted position. Resting an upper one of the carriages on a lower one of the carriages may help remove some of the loading from the pinions and racks when the tower is retracted. This may help reduce wear on the pinions, racks and connected driving members.

Stacking the carriages 5350, 5450 and 5550 closely together in the vertical direction (for example as illustrated in FIG. 27) may help reduce the overall height of the carriages 5350, 5450 and 5550 in the retracted configuration. This may help reduce the overall height of the tower assembly 5102 when retracted. Alternatively, one or more of the carriages 5350, 5450 and 5550 can be provided with recesses to accommodate some or all of the motor 5128*c* when the carriages are stacked.

Alternatively, the carriages 5350, 5450 and 5550 need not be stacked on each other or in close proximity when the tower assembly 5102 is retracted. Instead, the carriages 5350, 5450 and 5550 may be vertically spaced apart from each other when the tower assembly 5102 is retracted.

Optionally, some or all of the carriages can be provided with an alignment mechanism to help facilitate a desired alignment between a carriage and its respective track. For example, the alignment mechanism may help maintain a desired lateral spacing between the carriage and its track. This may help facilitate the desired engagement between the rollers on the carriage and the track, which may help inhibit tilting of the carriage relative to the track. For example, the use of an alignment mechanism may help keep the teeth on the pinions sufficiently engaged with the teeth on the racks.

This may help reduce backlash between the racks and pinions and may help inhibit tilting or shifting of the carriages relative to the racks.

The alignment mechanism may be of any suitable configuration that can help facilitate alignment of the carriage relative to its track, preferably without unduly inhibiting or restricting the translation of the carriage along the track when the tower is raised or lowered. Optionally, the alignment mechanism can include one or more alignment tracks, provided on one of the carriages or the tower sections, and one or more followers provided on the other one of the carriages or the tower sections to engage the alignment tracks. The followers may be any suitable members, including, for example, sliders, pads, rollers, bushings, wheels, pinions or other members that can engage the alignment tracks.

Optionally, the alignment mechanism may be provided on only some of the tower sections and the carriages that engage the tower sections, such as, for example, only on the bottom tower section or only on the top tower section. Alternatively, the alignment mechanism may be provided on all of the tower sections and carriages in the mobile lifting apparatus.

An alignment mechanism may be used in combination with some or all of the features of the mobile lifting apparatuses 100 and 5100 described herein.

Referring to FIG. 38, portions of another example of a mobile lifting apparatus, including a portion of a tower section 6200 and a portion of a corresponding carriage 6350, are illustrated. The tower section 6200 and carriage 6350 are similar to tower section 200 and carriage 350 respectively, and like features are identified by like reference characters incremented by 6000. While only a single tower section and carriage are illustrated for descriptive purposes, the features of the alignment mechanism may be incorporated in some or all of the other tower sections and carriages.

In the illustrated example, the tower section 6200 includes a rack 6260 for engaging a corresponding pinion on the carriage 6350. The mobile lifting apparatus also includes an example of an alignment mechanism 6600 to help facilitate alignment of the carriage 6350 with the tower section 6200. In the illustrated example, the alignment mechanism 6600 includes an alignment track in the form of a rail 6602 provided on tower section 6200, and a complementary follower in the form of roller 6604. The roller 6604 is configured to engage the rail 6602, and to roll along the length of the rail 6602 as the carriage 6350 translates relative to the tower section 6200. The rail 6602 extends parallel to the rack 6260, and in the illustrated example is integrally formed with the rack 6260.

Referring also to FIG. 39, in the illustrated example the roller 6604 is rotatable about a roller axis 6612 that is generally orthogonal to the axis of rotation 6614 of the front shaft 6366 (and the pinions mounted on the front shaft 6366). In this configuration, engagement between the roller 6604 and the rail 6602 can inhibit movement of the carriage 6350 toward the rail 6602 (to the left as illustrated in FIG. 39). This may help inhibit shifting of the pinion relative to the rack 6260 in a direction that is parallel to the teeth on the rack 6260. This may help maintain desired engagement between the pinion and the rack 6260. Additional respective rollers 6604 may be provided at some or all of the other corners of the carriage 6350. This may help increase the stability of the mobile lifting apparatus, and/or may help keep the carriage 6350 in its desired position relative to the tower section 6200 (e.g. laterally centered relative to the tower section 6200).

Optionally, in addition to, or as an alternative to resisting lateral movement of the carriage 6350, the alignment mechanism can be configured to inhibit movement of the carriage 6350 in at least one other direction (e.g. a longitudinal direction) relative to the tower section 6200. For example, the alignment mechanism may be configured to inhibit forward movement of the carriage, rearward movement of the carriage or both forward and rearward movement of the carriage relative to the tower section 6200. Inhibiting movement of the carriage 6350 relative to the tower section 6200 in at least two directions may help increase the stability of the mobile lifting apparatus, and/or may help keep the carriage 6350 in its desired position relative to the tower section 6200 (e.g. laterally and longitudinally centered relative to the tower section 6200).

Referring to FIG. 39, in the illustrated example, the roller 6604 includes a roller engagement member in the form of a central groove 6606 that is sized to receive a corresponding engagement portion of the rail 6602. The groove 6606 is bounded by a pair of inclined roller abutment surfaces 6608*a* and 6608*b*. When the roller 6604 engages the rail 6602, each roller abutment surface 6608*a* and 6608*b* bears against a corresponding rail abutment surface 6610*a* and 6610*b*. In this configuration, engagement between the roller abutment surface 6608*a* and the rail abutment surface 6610*a* inhibits rearward movement of the carriage 6350 relative to the tower section 6620 (upwards as illustrated in FIG. 39), and engagement between the roller abutment surface 6608*b* and the rail abutment surface 6610*b* inhibits rearward movement of the carriage 6350 relative to the tower section 6200 (downwards as illustrated in FIG. 39).

In the illustrated example, the rail 6602 includes a third abutment surface 6610*c* that is positioned to abut an outer, third roller abutment surface 6608*c*. Engagement between abutment surfaces 6608*c* and 6610*c* may also help inhibit rearward movement of the carriage 6350 relative to the tower section 6200.

In other examples, the rail engagement member may be provided as a groove or slot, and the roller engagement member may include a tongue or other suitable protrusion that can be received within the groove or slot.

While illustrated as being integrally formed with each other in this example, alternatively, the rail and rack need not be integrally formed and instead may be provided as separate members.

Referring to FIG. 40, portions of another example of a mobile lifting apparatus, including a portion of a tower section 7200 and a portion of a corresponding carriage 7350, are illustrated. The tower section 7200 and carriage 7350 are similar to tower section 200 and carriage 350 respectively, and like features are identified using like reference characters incremented by 7000.

In the illustrated example, the tower section 7200 includes a rack 7260 for engaging a corresponding pinion on the carriage 7350. The mobile lifting apparatus also includes an example of an alignment mechanism 7600 to help facilitate alignment of the carriage 7350 with the tower section 7200. In the illustrated example, the alignment mechanism 7600 includes an alignment track in the form of a rail 7602 provided on tower section 7200, and a complementary follower in the form of a pair of rollers 7604. The rollers 7604 are spaced apart from each other in the vertical direction (i.e. a direction parallel to the rail) and configured to engage the rail 7602 at two vertically spaced apart locations. This may help inhibit tilting of the carriage 7350 relative to the tower section 7200. The rollers 7604 are configured to roll along the length of the rail 7602 as the carriage 7350 translates relative to the tower section 7200. The rail 7602 extends parallel to the rack 7260, and in the illustrated example is integrally formed with the rack 7260.

Referring also to FIG. 41, in the illustrated example each roller 7604 is rotatable about a respective roller axis 7612 that is disposed at an angle 7613 to the axis of rotation 7614 of the front shaft 7366 (and the pinions mounted on the front shaft 7366). The angle 7613 in the example illustrated is about 45 degrees, but may be between about 5 degrees and about 90 degrees, and between about 30 degrees and about 60 degrees in other examples.

In this configuration, engagement between the rollers 7604 and the rail 7602 can inhibit movement of the carriage 7350 toward the rail 7602 (to the left as illustrated in FIG. 41). This may help inhibit shifting of the pinion relative to the rack 7260 in a direction that is parallel to the teeth on the rack 7260. This may help maintain desired engagement between the pinion and the rack 7260. Additional respective rollers 7604 may be provided at some or all of the other corners of the carriage 7350 (for example, a total of eight rollers 7604 per carriage when provided at all four corners). This may help increase the stability of the mobile lifting apparatus, and/or may help keep the carriage 7350 in its desired position relative to the tower section 7200 (e.g. laterally centered relative to the tower section 7200).

Referring to FIG. 41, in the illustrated example, each roller 7604 includes a roller engagement member in the form of a central groove 7606 that is sized to receive a corresponding engagement portion of the rail 7602. The groove 7606 is bounded by a pair of inclined roller abutment surfaces 7608*a* and 7608*b*. When the rollers 7604 engage the rail 7602, each roller abutment surface 7608*a* and 7608*b* bears against a corresponding rail abutment surface 7610*a* and 7610*b*. In this configuration, engagement between roller abutment surface 7608*a* and rail abutment surface 7610*a* inhibits rearward movement of the carriage 7350 relative to the tower section 7620 (upwards as illustrated in FIG. 419), and engagement between roller abutment surface 7608*b* and rail abutment surface 7610*b* inhibits rearward movement of the carriage 7350 relative to the tower section 7200 (downwards as illustrated in FIG. 41).

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred examples and examples, but should be given the broadest interpretation consistent with the description as a whole.

The invention claimed is:

1. A mobile lifting apparatus for raising and lowering one or more persons, comprising:

a) a bottom tower section having a first bottom sidewall and an opposed second bottom sidewall spaced laterally apart from the first bottom sidewall, the first and second bottom sidewalls having respective upper edges;

b) a top tower section coupled to and vertically translatable relative to the bottom tower section;

c) a work platform coupled to and vertically translatable with the top tower section, the work platform including a generally horizontal work surface for supporting at least one person; and d) an elevating assembly operable to translate the top tower section relative to the bottom tower section between a raised position in which the work surface is at an elevation above the bottom tower section, and a lowered position in which the top tower section and the work surface are at least partially nested within the bottom tower section between the first and second bottom sidewalls with the work surface at an elevation below the upper edges of the first and second bottom sidewalls for reducing an entry and exit height of the work platform, wherein the first and second bottom sidewalls extend longitudinally between a bottom front face and a longitudinally spaced apart bottom rear face of the bottom tower section, the bottom front face including a bottom front wall extending laterally between respective lower portions of the first and second bottom sidewalls, and an upper portion vertically intermediate an upper end of the bottom front wall and the upper edges of the first and second bottom sidewalls and bounded laterally by respective upper portions of the first and second bottom sidewalls, the work platform overhanging the bottom front wall and extending longitudinally through the upper portion when the top tower section is in the lowered position.

2. The lifting apparatus of claim 1, wherein the work platform includes a safety railing generally surrounding the perimeter of the work surface, the railing at least partially nested within the bottom tower section between the first and second bottom sidewalls when the top tower section is in the lowered position.

3. The lifting apparatus of claim 2, wherein the railing has a railing upper edge fixed at a railing height above the work surface, and when the top tower section is in the lowered position, the work surface is spaced below the upper edges of the first and second bottom sidewalls by an offset distance generally equal to the railing height.

4. The lifting apparatus of claim 1, wherein the work surface includes a first surface portion longitudinally inboard of the first and second bottom side walls and at least one second surface portion extending longitudinally outboard of the first and second bottom side walls.

5. The lifting apparatus of claim 1, wherein the top tower section includes a first top sidewall and an opposed second top sidewall spaced laterally apart from the first top sidewall, the first and second top sidewalls laterally bounding the work surface and having upper edges spaced above the work surface.

6. The lifting apparatus of claim 1, further comprising a bottom cover movably coupled to the bottom tower section, the bottom cover generally clear of the upper portion of the bottom front face when the top tower section is in the lowered position and generally covering the upper portion of the bottom front face when the top tower section is in the raised position.

7. The lifting apparatus of claim 6, wherein the bottom cover includes a first bottom cover panel and a second bottom cover panel each vertically translatable relative to the first and second bottom sidewalls, the panels generally overlapping the bottom front wall in horizontally offset relation and clear of the upper portion of the bottom front face when the top tower section is in the lowered position, and the panels vertically displaced relative to one another and the bottom front wall and generally covering the upper portion of the bottom front face when the top tower section is in the raised position.

8. The lifting apparatus of claim 1, further comprising at least one intermediate tower section coupling the top and bottom tower sections and vertically translatable relative to each of the top and bottom tower sections, the at least one intermediate tower section including a first intermediate sidewall and an opposed second intermediate sidewall spaced laterally apart from the first intermediate sidewall, and wherein the at least one intermediate tower section extends vertically between the bottom tower section and the top tower section when the top tower section is in the raised position, and when the top tower section is in the lowered position the top tower section and the work surface are at least partially nested within the at least one intermediate tower section between the first and second intermediate sidewalls and the at least one intermediate tower section is at least partially nested within the bottom tower section between the first and second bottom sidewalls.

9. The lifting apparatus of claim 1, further comprising a pair of wheel assemblies mounted to longitudinally opposite faces of the bottom tower section for supporting the bottom tower section above a ground surface, the pair of wheel assemblies generally laterally inboard and longitudinally outboard of the bottom tower section, and each wheel assembly including at least one wheel rotatable about a respective axis for rollingly engaging the ground surface, and wherein the bottom tower section has a bottom face opposite the upper edges of the first and second sidewalls, the bottom face at an elevation below each wheel axis.

10. The lifting apparatus of claim 9, wherein at least one of the wheel assemblies includes at least two wheels and at least one electric motor for at least one of steering and driving rotation of at least one of the wheels, each motor mounted external the bottom tower section at an elevation above the bottom face of the bottom tower section.

11. The lifting apparatus of claim 1, wherein the lifting apparatus is all-electric and free of hydraulic components.

12. The lifting apparatus of claim 1, wherein when the top tower section is in the lowered position, the lifting apparatus has an overall apparatus height and the work surface is at a work surface height less than half of the overall apparatus height.

13. The lifting apparatus of claim 12, wherein the first and second bottom sidewalls extend vertically between respective upper and lower edges and define a bottom tower section height, the bottom tower section height at least 80% of the overall apparatus height.

14. A lifting apparatus for raising and lowering one or more persons, comprising:

a) a bottom tower section including a first bottom sidewall, an opposed second bottom sidewall spaced horizontally apart from the first bottom sidewall, and a plurality of vertically extending and horizontally spaced apart bottom guide members fixed relative to the bottom sidewalls;

b) at least one intermediate tower section coupled and vertically translatable relative to the bottom tower section, the at least one intermediate tower section including an intermediate carriage having a plurality of intermediate carriage rollers each in engagement with a respective bottom guide member, the intermediate carriage rollers linked together to roll vertically along respective bottom guide members in unison for facilitating vertical translation and inhibiting tilting of the intermediate tower section relative to the bottom tower section;

c) the at least one intermediate tower section further including a first intermediate sidewall, an opposed second intermediate sidewall spaced horizontally apart from the first intermediate sidewall, and a plurality of vertically extending and horizontally spaced apart intermediate guide members fixed relative to the intermediate sidewalls;

d) a top tower section coupled and vertically translatable relative to the intermediate and bottom tower sections, the top tower section including a top carriage having a plurality of top carriage rollers each in engagement with a respective intermediate guide member, the top carriage rollers linked together to roll vertically along respective intermediate guide members in unison for facilitating vertical translation and inhibiting tilting of the top tower section relative to the intermediate tower section;

e) a work platform coupled to and vertically translatable with the top tower section, the work platform including a generally horizontal work surface for supporting at least one person; and f) an elevating assembly operable to raise and lower the at least one intermediate tower section and the top tower section relative to one another and the bottom tower section.

15. The lifting apparatus of claim 14, wherein the elevating assembly includes a lift actuator operable to drive rotation of the intermediate and top carriage rollers for raising and lowering the at least one intermediate tower section and the top tower section relative to one another and the bottom tower section.

16. The lifting apparatus of claim 15, wherein the lift actuator is operable to simultaneously drive the intermediate carriage rollers and the top carriage rollers for vertically translating the top tower section relative to the at least one intermediate tower section and the at least one intermediate tower section relative to the bottom tower section simultaneously.

17. The lifting apparatus of claim 15, wherein the lift actuator includes an intermediate motor mounted on and movable with the intermediate carriage and operable to drive rotation of the intermediate carriage rollers for vertically translating the at least one intermediate tower section relative to the bottom tower section, and a top motor mounted on and movable with the top carriage and operable to drive rotation of the top carriage rollers for vertically translating the top tower section relative to the at least one intermediate tower section, the top motor operable independently of the intermediate motor.

18. The lifting apparatus of claim 17, further comprising an intermediate controller mounted on and movable with the at least one intermediate carriage for controlling the intermediate motor, and a top controller mounted on and movable with the top carriage for controlling the top carriage motor.

19. The lifting apparatus of claim 14, wherein each roller is rotatable in a respective first direction for raising a respective tower section and in a respective second direction for lowering the respective tower section, and each carriage includes a respective gear train linking the carriage rollers of that carriage, and at least one of the gear trains is self-braking to resist rotation of respective carriage rollers in the second direction and inhibit lowering of the respective carriage.

20. The lifting apparatus of claim 14, wherein the elevating assembly is operable to translate the top tower section relative to the bottom tower section between a raised position in which the work surface is at an elevation above the bottom tower section, and a lowered position in which the top carriage, the intermediate carriage, and the work surface are nested within the bottom tower section between the first and second bottom sidewalls with the work surface at an elevation below upper edges of the first and second bottom sidewalls for reducing an entry and exit height of the work platform.

21. The lifting apparatus of claim 20, wherein when the top tower section is in the lowered position the lifting apparatus has an overall apparatus height, and the work surface is at a height less than half of the overall height, the top carriage is generally below the work surface, and the intermediate carriage is generally below the top carriage.

22. The lifting apparatus of claim 14, wherein each bottom sidewall extends vertically between respective upper and lower edges and defines a bottom tower section height, and each bottom guide member has a vertical extent generally equal to the bottom tower section height.

23. The lifting apparatus of claim 14, wherein the first and second bottom sidewalls each include at least one bracing member to resist deflection of the bottom sidewalls and the bottom guide members.

24. The lifting apparatus of claim 23, wherein each bottom guide member is fixed to a respective bracing member.

25. The lifting apparatus of claim 23, wherein each bottom sidewall includes a front edge and a rear edge spaced longitudinally apart from the front edge, and the at least one bracing member includes a front upright adjacent each front edge and a rear upright adjacent each rear edge.

26. The lifting apparatus of claim 14, wherein the at least one intermediate tower section comprises a lower intermediate tower section including the intermediate carriage and an upper intermediate tower section movably supported by the lower intermediate tower section and including the first and second sidewalls and the intermediate guide members.

27. The lifting apparatus of claim 14, wherein each guide member includes a vertically extending rack, and each carriage roller includes a pinion engaging a respective rack.

28. The lifting apparatus of claim 14, wherein the lifting apparatus is all-electric and free of hydraulic components.

* * * * *